US011415316B2

(12) United States Patent
Kendrick et al.

(10) Patent No.: US 11,415,316 B2
(45) Date of Patent: Aug. 16, 2022

(54) COMBUSTION SYSTEM WITH PERFORATED FLAME HOLDER AND SWIRL STABILIZED PREHEATING FLAME

(71) Applicant: ClearSign Combustion Corporation, Seattle, WA (US)

(72) Inventors: Donald Kendrick, Bellevue, WA (US); Christopher A. Wiklof, Everett, WA (US)

(73) Assignee: ClearSign Technologies Cosporation, Tulsa, OK (US)

( * ) Notice: Subject to any disclaimer, the term of this patent is extended or adjusted under 35 U.S.C. 154(b) by 102 days.

(21) Appl. No.: 16/557,574

(22) Filed: Aug. 30, 2019

(65) Prior Publication Data

US 2020/0056781 A1 Feb. 20, 2020

Related U.S. Application Data

(63) Continuation of application No. PCT/US2018/020485, filed on Mar. 1, 2018.

(60) Provisional application No. 62/466,123, filed on Mar. 2, 2017, provisional application No. 62/466,111, filed on Mar. 2, 2017.

(51) Int. Cl.
*F23D 11/40* (2006.01)
*F23D 11/44* (2006.01)

(52) U.S. Cl.
CPC ..... *F23D 11/446* (2013.01); *F23D 11/406* (2013.01)

(58) Field of Classification Search
CPC ..... F23D 11/446; F23D 11/406
USPC ..... 431/2, 328
See application file for complete search history.

(56) References Cited

U.S. PATENT DOCUMENTS 4,008,041 A * 2/1977 Roffe ..... F23D 11/402 392/397
4,014,469 A * 3/1977 Sato ..... F23D 14/54 239/404
4,483,673 A 11/1984 Murai et al.
4,643,667 A * 2/1987 Fleming ..... F23D 14/16 431/328

(Continued)

FOREIGN PATENT DOCUMENTS

EP 0478305 12/1997
EP 0672868 6/2000

(Continued)

OTHER PUBLICATIONS

Pei-Feng Hsu, "A Low NOx Porous Ceramics Burner Performance Study," California Energy Commission Public Interest Energy Research Program, Dec. 2007, San Diego State University Foundation.

(Continued)

*Primary Examiner* — Avinash A Savani
(74) *Attorney, Agent, or Firm* — Christopher A. Wiklof; James Larsen; Launchpad IP, Inc.

(57) ABSTRACT

A combustion system supports a swirl-stabilized preheating flame with a preheating fuel and an oxidant. The combustion system preheats a perforated flame holder with the preheating flame. After the perforated flame holder has been preheated to the threshold temperature, the combustion system outputs a primary fuel. The perforated flame holder receives a mixture of the primary fuel and the oxidant supports a combustion reaction of the primary fuel and the oxidant.

47 Claims, 36 Drawing Sheets

(56) References Cited

U.S. PATENT DOCUMENTS

| | | | | |
|---|---|---|---|---|
| 4,673,349 | A | 6/1987 | Abe et al. | |
| 5,409,375 | A | 4/1995 | Butcher | |
| 5,439,372 | A | 8/1995 | Duret et al. | |
| 5,641,282 | A | 6/1997 | Lee et al. | |
| 5,718,573 | A | 2/1998 | Knight et al. | |
| 5,993,192 | A | 11/1999 | Schmidt et al. | |
| 6,129,545 | A | 10/2000 | Kahlke et al. | |
| 6,270,336 | B1 | 8/2001 | Terashima et al. | |
| 6,752,620 | B2 | 6/2004 | Heier et al. | |
| 2004/0050207 | A1* | 3/2004 | Wooldridge | C01G 1/02 75/362 |
| 2004/0231766 | A1* | 11/2004 | Moriai | F02K 9/42 149/1 |
| 2006/0292510 | A1 | 12/2006 | Krauklis et al. | |
| 2008/0124666 | A1 | 5/2008 | Stocker et al. | |
| 2009/0053664 | A1 | 2/2009 | Staller et al. | |
| 2010/0126176 | A1 | 5/2010 | Kim et al. | |
| 2011/0111356 | A1 | 5/2011 | Claerbout et al. | |
| 2013/0330676 | A1* | 12/2013 | Park | F23D 14/16 431/11 |
| 2016/0245509 | A1 | 8/2016 | Karkow et al. | |
| 2016/0298838 | A1 | 10/2016 | Karkow et al. | |
| 2016/0298840 | A1 | 10/2016 | Karkow et al. | |
| 2016/0348899 | A1 | 12/2016 | Karkow et al. | |
| 2017/0268772 | A1 | 9/2017 | Lang, Sr. et al. | |
| 2018/0003378 | A1 | 1/2018 | Karkow et al. | |
| 2018/0087774 | A1 | 3/2018 | Karkow et al. | |
| 2019/0049107 | A1 | 2/2019 | Colannino et al. | |
| 2019/0137096 | A1 | 5/2019 | Kendrick et al. | |
| 2019/0257516 | A1 | 8/2019 | Karkow et al. | |
| 2019/0323707 | A1 | 10/2019 | Kamani et al. | |

FOREIGN PATENT DOCUMENTS

| | | |
|---|---|---|
| EP | 1916477 | 4/2008 |
| WO | WO 2015/054323 | 4/2015 |
| WO | WO 2015/123149 | 8/2015 |
| WO | WO 2015/123701 | 8/2015 |
| WO | WO 2018/160869 | 9/2018 |

OTHER PUBLICATIONS

PCT International Search Report and Written Opinion dated Jun. 12, 2018, for PCT International Patent Application No. PCT/US2018/020485, filed Mar. 1, 2018, 30 pages.

PCT International Search Report and Written Opinion dated Jun. 14, 2018, for PCT International Patent Application No. PCT/US2018/020503, filed Mar. 1, 2018, 31 pages.

* cited by examiner

COMBUSTION SYSTEM WITH PERFORATED FLAME HOLDER AND SWIRL STABILIZED PREHEATING FLAME

CROSS REFERENCE TO RELATED APPLICATIONS

The present application is a Continuation Application which claims priority benefit under 35 U.S.C. § 120 (pre-AIA) of International Patent Application No. PCT/US2018/020485, entitled "COMBUSTION SYSTEM WITH PERFORATED FLAME HOLDER AND SWIRL STABILIZED PREHEATING FLAME," filed Mar. 1, 2018. International Patent Application No. PCT/US2018/020485 claims priority benefit from U.S. Provisional Patent Application No. 62/466,111, entitled "COMBUSTION SYSTEM WITH PERFORATED FLAME HOLDER AND SWIRL STABILIZED PREHEATING FLAME," filed Mar. 2, 2017. International Patent Application No. PCT/US2018/020485 also claims priority benefit from U.S. Provisional Patent Application No. 62/466,123, entitled "FUEL NOZZLE WITH AUGMENTED FUEL/AIR MIXING," filed Mar. 2, 2017. Each of the foregoing applications, to the extent not inconsistent with the disclosure herein, is incorporated by reference.

SUMMARY

According to an embodiment, a combustion system includes a perforated flame holder positioned in a furnace volume, an oxidant source configured to output an oxidant into a furnace volume, and one or more preheating fuel distributors configured to output a preheating fuel into the furnace volume during a preheating operating state of the combustion system. The one or more preheating fuel distributors are configured to support a swirl-stabilized preheating flame of the preheating fuel and the oxidant. The combustion system also includes one or more primary fuel distributors positioned peripherally to the one or more preheating fuel distributors and configured to output a primary fuel into the furnace volume during a standard operating state of the combustion system. The perforated flame holder is positioned to be preheated by the preheating flame during the preheating state and to receive a mixture of the primary fuel and the oxidant during the standard operating state. The perforated flame holder is configured to hold a combustion reaction of the fuel and the oxidant within the perforated flame holder.

According to an embodiment, a method for operating a combustion system includes outputting an oxidant into a furnace volume and outputting a preheating fuel into the furnace volume. The method includes supporting a swirl-stabilized preheating flame of the preheating fuel and the oxidant and preheating a perforated flame holder with the preheating flame. The method also includes outputting a primary fuel into the furnace volume, receiving a mixture of the primary fuel and the oxidant in the perforated flame holder, and supporting a combustion reaction of the primary fuel and the oxidant in the perforated flame holder.

DETAILED DESCRIPTION

Figure 1A:
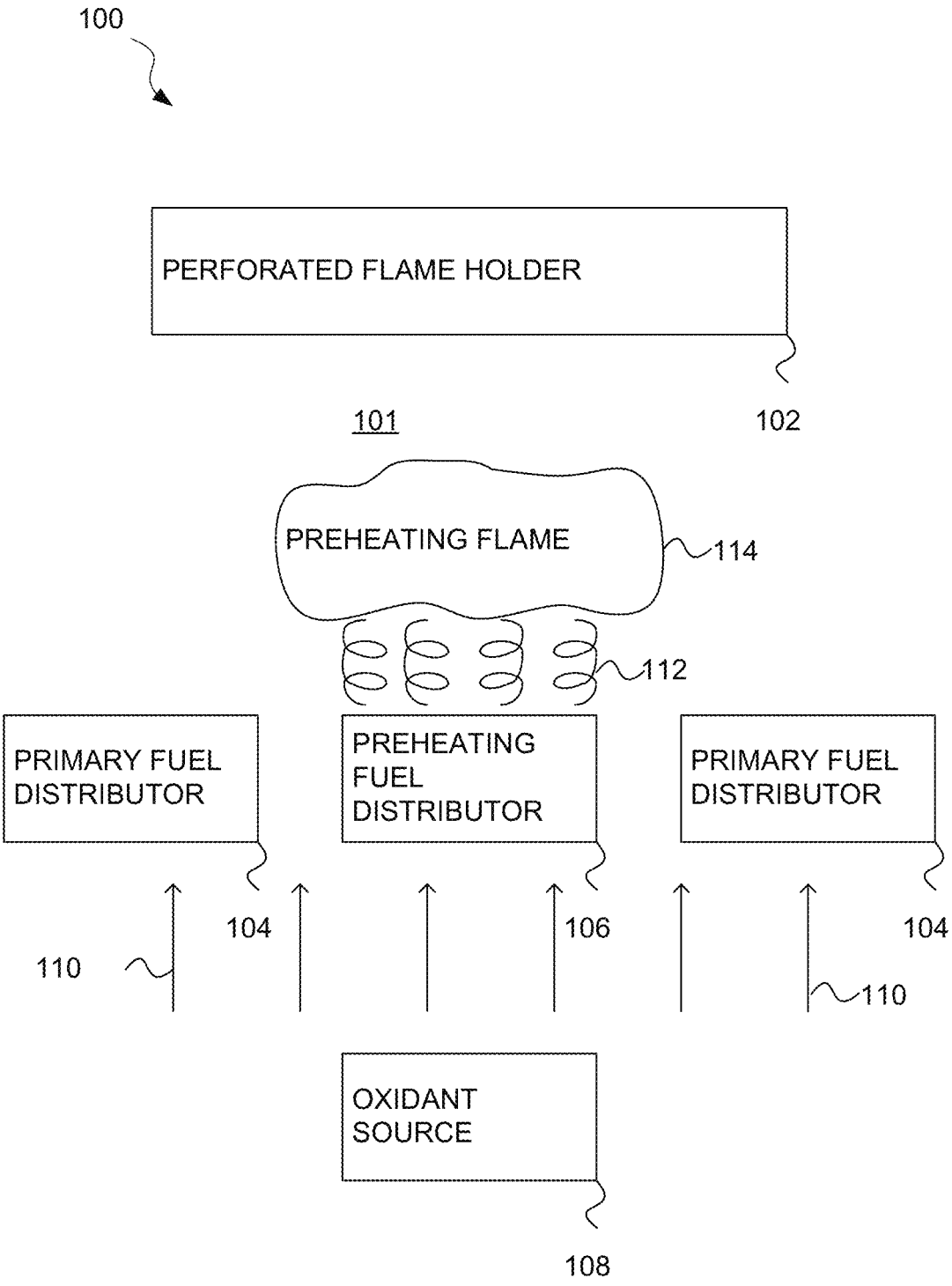
FIG. 1A is a block diagram of a combustion system in a preheating state, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

FIG. 1A is a block diagram of a combustion system 100 in a preheating state, according to an embodiment. The combustion system 100 includes a perforated flame holder 102 positioned in a furnace volume 101, one or more primary fuel distributors 104, and one or more preheating fuel distributors 106. The primary fuel distributors 104 are positioned peripherally to the preheating fuel distributor 106. The combustion system 100 also includes an oxidant source 108.

In the preheating state, the oxidant source 108 outputs an oxidant 110 into the furnace volume 101. The preheating fuel distributor 106 outputs a preheating fuel 112 into the furnace volume 101. The preheating fuel distributor 106 imparts a swirling motion to at least one of the preheating fuel 112 and the oxidant 110. The preheating fuel distributor 106 supports a swirl-stabilized preheating flame 114 with the preheating fuel 112 and the oxidant 110.

According to an embodiment, the preheating fuel distributor 106 imparts a swirling motion to the oxidant 110 as the oxidant 110 passes adjacent to or through the preheating fuel distributor 106. The swirling oxidant 110 interacts with the preheating fuel 112 and mixes with the preheating fuel 112. The swirling motion of the oxidant 110 enhances mixing of the oxidant 110 and the preheating fuel 112. The combustion system 100 ignites the mixture of the preheating fuel 112 and the oxidant 110, thereby starting the preheating flame 114. The swirling motion imparted to the oxidant 110 causes the preheating flame 114 to be swirl-stabilized. The swirl-stabilized preheating flame 114 remains at a stable position relative to the preheating fuel distributor 106 and the perforated flame holder 102. According to an embodiment, the swirl-stabilized preheating flame 114 can be held in the stable position without additional flame holding structures to hold the preheating flame 114 in the stable position.

According to an embodiment, the preheating fuel distributor 106 outputs the preheating fuel 112 into the furnace volume 101 with a swirling motion. The swirling preheating fuel 112 mixes with the oxidant 110. The swirling motion of the preheating fuel 112 enhances the mixing of the oxidant 110 and the preheating fuel 112. The combustion system 100 ignites the mixture of the preheating fuel 112 and the oxidant 110, thereby initializing the preheating flame 114. The swirling motion imparted to the preheating fuel 112 causes the preheating flame 114 to be swirl-stabilized such that the swirl-stabilized preheating flame 114 remains at a stable position relative to the preheating fuel distributor 106 and the perforated flame holder 102.

According to an embodiment, the preheating fuel distributor 106 imparts a swirling motion to both the oxidant 110 and the preheating fuel 112. The swirling motion of both the oxidant 110 and the preheating fuel 112 causes enhanced mixing of the preheating fuel 112 and the oxidant 110. The combustion system 100 ignites the mixture of the preheating fuel 112 and the oxidant 110, thereby initializing the preheating flame 114. The swirling motion imparted to the preheating fuel 112 and the oxidant 110 causes the preheating flame 114 to be swirl-stabilized such that the swirl-stabilized preheating flame 114 remains at a stable position relative to the preheating fuel distributor 106 and the perforated flame holder 102.

According to an embodiment, the perforated flame holder 102 is positioned to be preheated by the preheating flame 114. In particular, the perforated flame holder 102 receives heat from the preheating flame 114. The heat received by the perforated flame holder 102 preheats the perforated flame holder 102 to a threshold temperature in preparation for the combustion system 100 to enter the standard operating state. The threshold temperature corresponds to a temperature at which the perforated flame holder 102 can sustain a combustion reaction of the primary fuel and the oxidant 110 within the perforated flame holder 102.

Figure 1B:
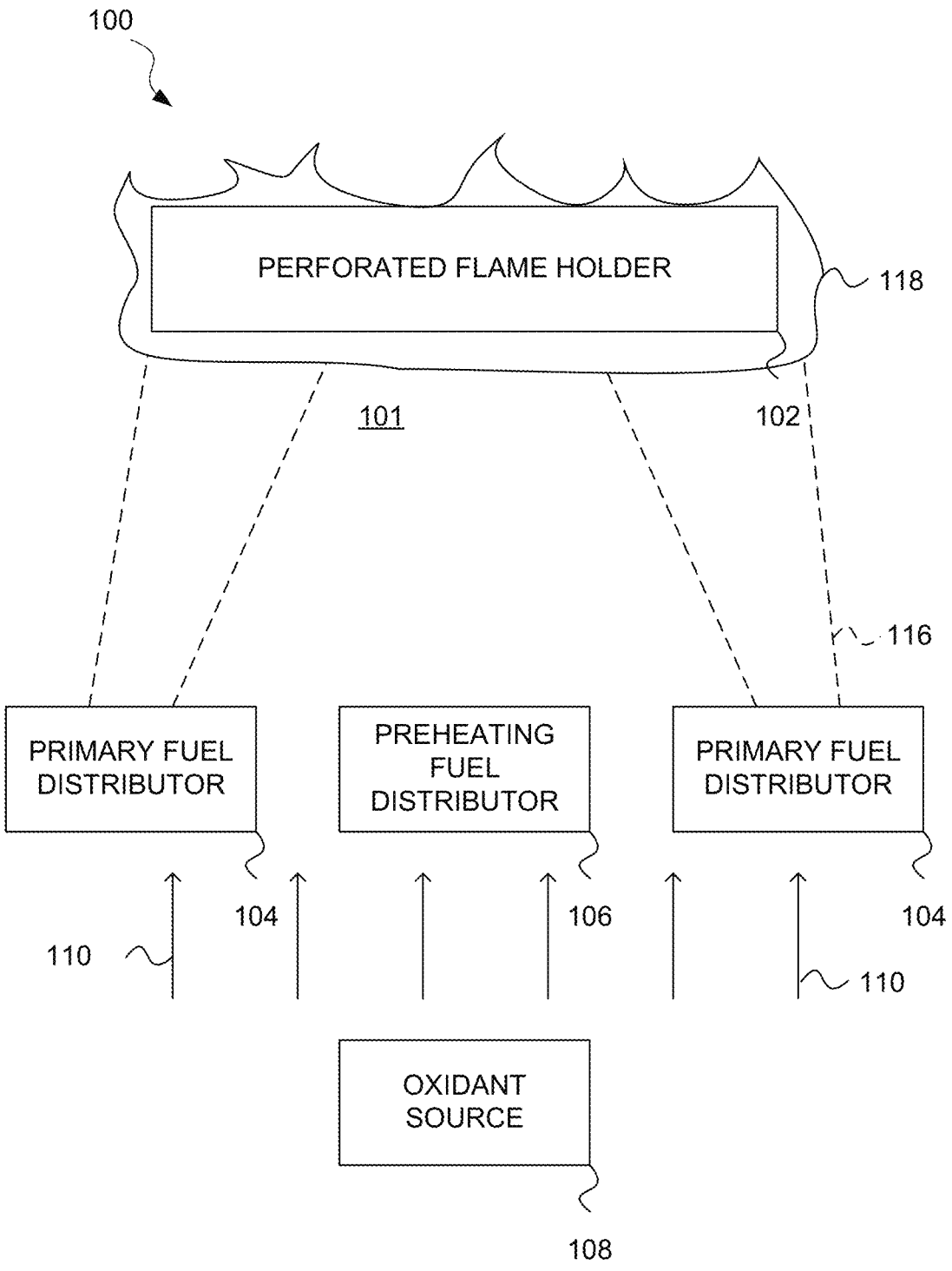
FIG. 1B is a block diagram of the combustion system of FIG. 1A in a standard operating state, according to an embodiment.

FIG. 1B is a block diagram of the combustion system 100 in a standard operating state, according to an embodiment. In the standard operating state the preheating fuel distributor 106 has ceased outputting the preheating fuel 112, thereby removing the preheating flame 114. In the standard operating state, the primary fuel distributors 104 output a primary fuel 116 into the furnace volume 101. In the standard operating state, the oxidant source 108 continues to output the oxidant 110 into the furnace volume 101.

According to an embodiment, the primary fuel 116 mixes with the oxidant 110 in a furnace volume 101. The perforated flame holder 102 is positioned to receive a mixture of the primary fuel 116 and the oxidant 110. Because the perforated flame holder 102 has been preheated to the threshold temperature during the preheating state, the perforated flame holder 102 is at a sufficient temperature to sustain a combustion reaction 118 of the primary fuel 116 and the oxidant 110.

According to an embodiment, the perforated flame holder 102 sustains the combustion reaction 118 of the primary fuel 116 and the oxidant 110 at least partially within the perforated flame holder 102. The perforated flame holder 102 can also sustain a combustion reaction 118 outside of the perforated flame holder 102 adjacent to the perforated flame holder 102. For example, the perforated flame holder 102 can sustain the combustion reaction 118 downstream, upstream, and/or on the sides of the perforated flame holder 102. According to an embodiment, the perforated flame holder 102 can hold the combustion reaction 118 primarily within the perforated flame holder 102 while also holding a portion of the combustion reaction 118 outside of the perforated flame holder 102.

According to an embodiment, the primary fuel distributors 104 impart a swirling motion to one or both of the oxidant 110 and the primary fuel 116. The primary fuel distributors 104 can impart a swirling motion that is less pronounced than a swirling motion imparted by the preheating fuel distributor 106. The swirling motion imparted by the primary fuel distributors 104 can cause enhanced mixing of the oxidant 110 and the primary fuel 116 as the primary fuel 116 travels toward the perforated flame holder 102. The enhanced mixing can enable placing the perforated flame holder 102 closer to the primary fuel distributors 104 than might be possible in the absence of the swirling motion. This is because the swirling motion imparted by the primary fuel distributors 104 can enable the primary fuel 116 and the oxidant 110 to mix in a shorter distance, thereby enabling the perforated flame holder 102 to sustain the combustion reaction 118. Because the primary fuel 116 and the oxidant 110 can be mixed in a shorter distance, the perforated flame holder 102 can be positioned closer to the primary fuel distributors 104 than might otherwise be possible. This in turn can enable a more compact and efficient combustion system 100.

According to an embodiment, the primary fuel distributors 104 are positioned peripherally to the preheating fuel distributor 106. Thus, according to an embodiment, the primary fuel distributors 104 can be positioned such that the primary fuel distributors 104 collectively surround the preheating fuel distributor 106. According to an embodiment, the combustion system 100 can include multiple preheating fuel distributors 106. The primary fuel distributors 104 can collectively laterally surround the plurality of preheating fuel distributors 106.

Although the above description has described separate preheating and primary fuels 112, 116, the preheating fuel 112 and the primary fuel 116 can be a same type of fuel. For example, a single fuel source may supply fuel to both the preheating fuel distributor 106 and the primary fuel distributors 104. The fuel source can selectively supply fuel to the primary and preheating fuel distributors by selectively opening and closing valves in the various operating states of the combustion system 100. Alternatively, the preheating fuel 112 and the primary fuel 116 can be different fuels.

According to an embodiment, the perforated flame holder 102 includes a plurality of parallel perforations extending from an input surface to an output surface of the perforated flame holder 102.

According to an embodiment, the perforated flame holder is a reticulated ceramic perforated flame holder.

According to an embodiment, the combustion system 100 includes multiple perforated flame holders 102 each positioned to be preheated by the preheating flame 114 in the preheating state and to support a combustion reaction 118 of the primary fuel 116 and the oxidant 110 in standard operating state. According to an embodiment, the perforated flame holders 102 can be separated by gaps. According to an embodiment, the perforated flame holders 102 can support a combustion reaction upstream, downstream within, and between the perforated flame holders 102.

Those of skill in the art will recognize, in light of the present disclosure, that structures, components, combinations, and processes other than those described above can be utilized in a combustion system 100 in accordance with principles of the present disclosure without departing from the scope of the present disclosure.

Figure 2:
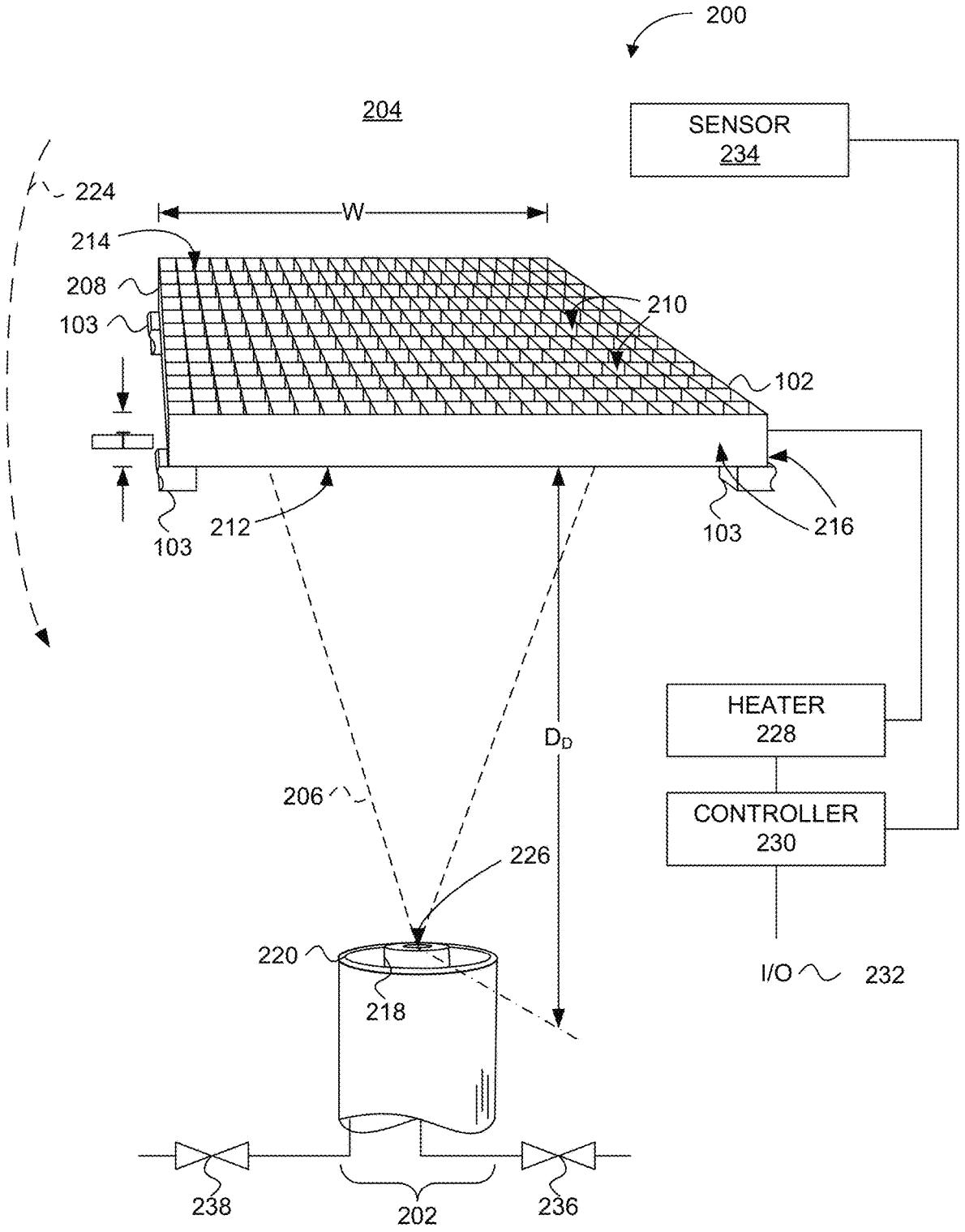
FIG. 2 is a simplified diagram of a burner system including a perforated flame holder configured to hold a combustion reaction, according to an embodiment.

FIG. 2 is a simplified diagram of a burner system 200 including a perforated flame holder 102 configured to hold a combustion reaction, according to an embodiment. As used herein, the terms perforated flame holder, perforated reaction holder, porous flame holder, porous reaction holder, duplex, and duplex tile shall be considered synonymous unless further definition is provided.

Experiments performed by the inventors have shown that perforated flame holders 102 described herein can support very clean combustion. Specifically, in experimental use of systems 200 ranging from pilot scale to full scale, output of oxides of nitrogen (NOx) was measured to range from low single digit parts per million (ppm) down to undetectable (less than 1 ppm) concentration of NOx at the stack. These remarkable results were measured at 3% (dry) oxygen ($O_2$) concentration with undetectable carbon monoxide (CO) at stack temperatures typical of industrial furnace applications (1400-1600° F.). Moreover, these results did not require any extraordinary measures such as selective catalytic reduction (SCR), selective non-catalytic reduction (SNCR), water/steam injection, external flue gas recirculation (FGR), or other heroic extremes that may be required for conventional burners to even approach such clean combustion.

According to embodiments, the burner system 200 includes a fuel and oxidant source 202 disposed to output fuel and oxidant into a combustion volume 204 to form a fuel and oxidant mixture 206. As used herein, the terms fuel and oxidant mixture and fuel stream may be used interchangeably and considered synonymous depending on the context, unless further definition is provided. As used herein, the terms combustion volume, combustion chamber, furnace volume, and the like shall be considered synonymous unless further definition is provided. The perforated flame holder 102 is disposed in the combustion volume 204 and positioned to receive the fuel and oxidant mixture 206.

Figure 3:
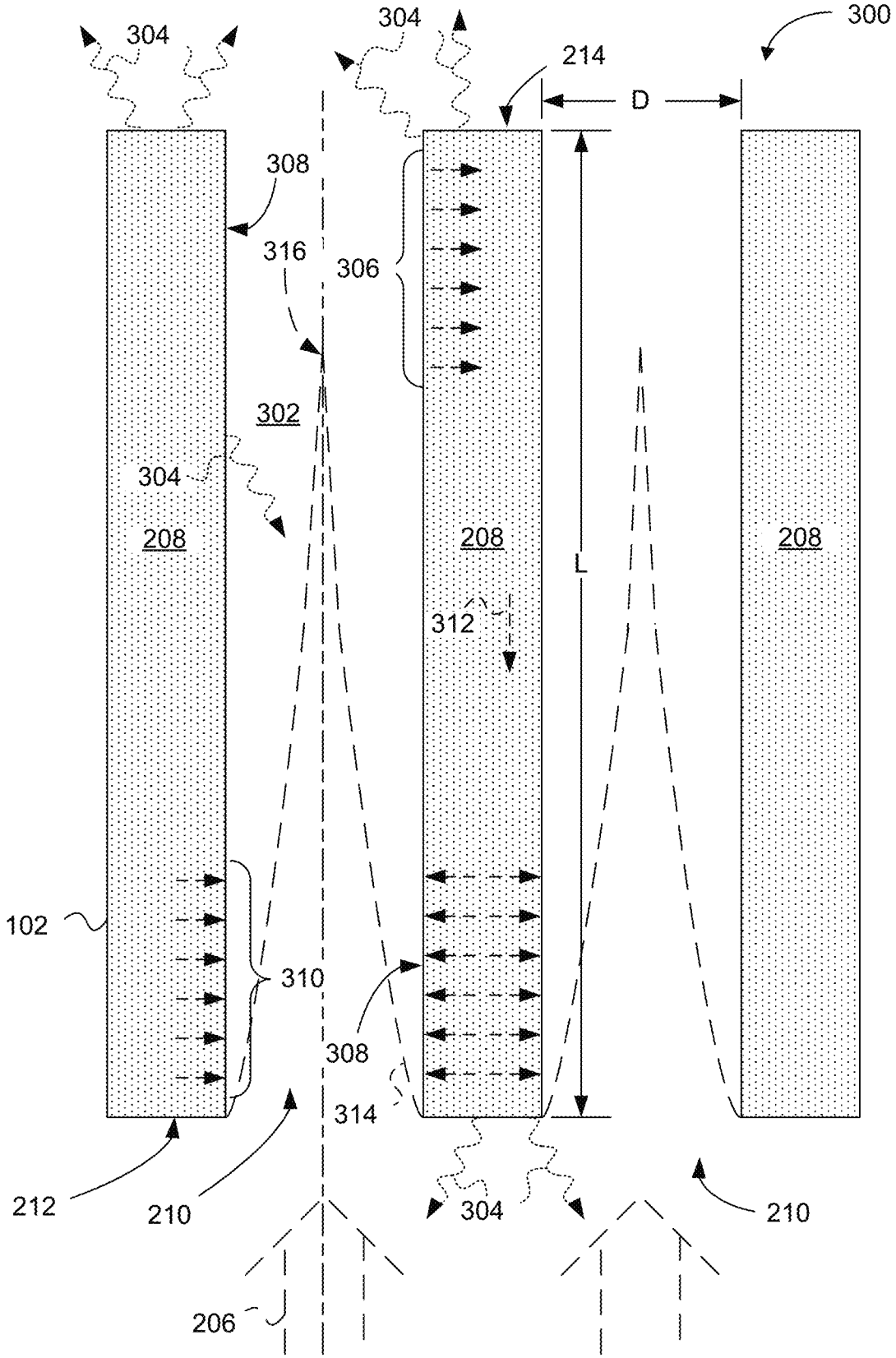
FIG. 3 is a side sectional diagram of a portion of the perforated flame holder of FIGS. 1A-1B and 2, according to an embodiment.

FIG. 3 is a side sectional diagram 300 of a portion of the perforated flame holder 102 of FIGS. 1A-1B and 2, according to an embodiment. Referring to FIGS. 2 and 3, the perforated flame holder 102 includes a perforated flame holder body 208 defining a plurality of perforations 210 aligned to receive the fuel and oxidant mixture 206 from the fuel and oxidant source 202. As used herein, the terms perforation, pore, aperture, elongated aperture, and the like, in the context of the perforated flame holder 102, shall be considered synonymous unless further definition is provided. The perforations 210 are configured to collectively hold a combustion reaction 302 supported by the fuel and oxidant mixture 206.

The fuel can include hydrogen, a hydrocarbon gas, a vaporized hydrocarbon liquid, an atomized hydrocarbon liquid, or a powdered or pulverized solid. The fuel can be a single species or can include a mixture of gas(es), vapor(s), atomized liquid(s), and/or pulverized solid(s). For example, in a process heater application the fuel can include fuel gas or byproducts from the process that include carbon monoxide (CO), hydrogen ($H_2$), and methane ($CH_4$). In another application the fuel can include natural gas (mostly $CH_4$) or propane ($C_3H_8$). In another application, the fuel can include #2 fuel oil or #6 fuel oil. Dual fuel applications and flexible fuel applications are similarly contemplated by the inventors. The oxidant can include oxygen carried by air, flue gas, and/or can include another oxidant, either pure or carried by a carrier gas. The terms oxidant and oxidizer shall be considered synonymous herein.

According to an embodiment, the perforated flame holder body 208 can be bounded by an input face 212 disposed to receive the fuel and oxidant mixture 206, an output face 214 facing away from the fuel and oxidant source 202, and a peripheral surface 216 defining a lateral extent of the perforated flame holder 102. The plurality of perforations 210 which are defined by the perforated flame holder body 208 extend from the input face 212 to the output face 214. The plurality of perforations 210 can receive the fuel and oxidant mixture 206 at the input face 212. The fuel and oxidant mixture 206 can then combust in or near the plurality of perforations 210 and combustion products can exit the plurality of perforations 210 at or near the output face 214.

According to an embodiment, the perforated flame holder 102 is configured to hold a majority of the combustion reaction 302 within the perforations 210. For example, on a steady-state basis, more than half the molecules of fuel output into the combustion volume 204 by the fuel and oxidant source 202 may be converted to combustion products between the input face 212 and the output face 214 of the perforated flame holder 102. According to an alternative interpretation, more than half of the heat or thermal energy output by the combustion reaction 302 may be output between the input face 212 and the output face 214 of the perforated flame holder 102. As used herein, the terms heat, heat energy, and thermal energy shall be considered synonymous unless further definition is provided. As used above, heat energy and thermal energy refer generally to the released chemical energy initially held by reactants during the combustion reaction 302. As used elsewhere herein, heat, heat energy and thermal energy correspond to a detectable temperature rise undergone by real bodies characterized by heat capacities. Under nominal operating conditions, the perforations 210 can be configured to collectively hold at least 80% of the combustion reaction 302 between the input face 212 and the output face 214 of the perforated flame holder 102. In some experiments, the inventors produced a combustion reaction 302 that was apparently wholly contained in the perforations 210 between the input face 212 and the output face 214 of the perforated flame holder 102. According to an alternative interpretation, the perforated flame holder 102 can support combustion between the input face 212 and output face 214 when combustion is "time-averaged." For example, during transients, such as before the perforated flame holder 102 is fully heated, or if too high a (cooling) load is placed on the system, the combustion may travel somewhat downstream from the output face 214 of the perforated flame holder 102. Alternatively, if the cooling load is relatively low and/or the furnace temperature reaches a high level, the combustion may travel somewhat upstream of the input face 212 of the perforated flame holder 102.

While a "flame" is described in a manner intended for ease of description, it should be understood that in some instances, no visible flame is present. Combustion occurs primarily within the perforations 210, but the "glow" of combustion heat is dominated by a visible glow of the perforated flame holder 102 itself. In other instances, the inventors have noted transient "huffing" or "flashback" wherein a visible flame momentarily ignites in a region lying between the input face 212 of the perforated flame holder 102 and the fuel nozzle 218, within the dilution region $D_D$. Such transient huffing or flashback is generally short in duration such that, on a time-averaged basis, a majority of combustion occurs within the perforations 210 of the perforated flame holder 102, between the input face 212 and the output face 214. In still other instances, the inventors have noted apparent combustion occurring downstream from the output face 214 of the perforated flame holder 102, but still a majority of combustion occurred within the perforated flame holder 102 as evidenced by continued visible glow from the perforated flame holder 102 that was observed.

The perforated flame holder 102 can be configured to receive heat from the combustion reaction 302 and output a portion of the received heat as thermal radiation 304 to heat-receiving structures (e.g., furnace walls and/or radiant section working fluid tubes) in or adjacent to the combustion volume 204. As used herein, terms such as radiation, thermal radiation, radiant heat, heat radiation, etc. are to be construed as being substantially synonymous, unless further definition is provided. Specifically, such terms refer to blackbody-type radiation of electromagnetic energy, primarily at infrared wavelengths, but also at visible wavelengths owing to elevated temperature of the perforated flame holder body 208.

Referring especially to FIG. 3, the perforated flame holder 102 outputs another portion of the received heat to the fuel and oxidant mixture 206 received at the input face 212 of the perforated flame holder 102. The perforated flame holder body 208 may receive heat from the combustion reaction 302 at least in heat receiving regions 306 of perforation walls 308. Experimental evidence has suggested to the inventors that the position of the heat receiving regions 306, or at least the position corresponding to a maximum rate of receipt of heat, can vary along the length of the perforation walls 308. In some experiments, the location of maximum receipt of heat was apparently between ⅓ and ½ of the distance from the input face 212 to the output face 214 (i.e., somewhat nearer to the input face 212 than to the output face 214). The inventors contemplate that the heat receiving regions 306 may lie nearer to the output face 214 of the perforated flame holder 102 under other conditions. Most probably, there is no clearly defined edge of the heat receiving regions 306 (or for that matter, the heat output regions 310, described below). For ease of understanding, the heat receiving regions 306 and the heat output regions 310 will be described as particular regions 306, 310.

The perforated flame holder body 208 can be characterized by a heat capacity. The perforated flame holder body 208 may hold thermal energy from the combustion reaction 302 in an amount corresponding to the heat capacity multiplied by temperature rise, and transfer the thermal energy from the heat receiving regions 306 to heat output regions 310 of the perforation walls 308. Generally, the heat output regions 310 are nearer to the input face 212 than are the heat receiving regions 306. According to one interpretation, the perforated flame holder body 208 can transfer heat from the heat receiving regions 306 to the heat output regions 310 via thermal radiation, depicted graphically as 304. According to another interpretation, the perforated flame holder body 208 can transfer heat from the heat receiving regions 306 to the heat output regions 310 via heat conduction along heat conduction paths 312. The inventors contemplate that multiple heat transfer mechanisms including conduction, radiation, and possibly convection may be operative in transferring heat from the heat receiving regions 306 to the heat output regions 310. In this way, the perforated flame holder 102 may act as a heat source to maintain the combustion reaction 302, even under conditions where a combustion reaction 302 would not be stable when supported from a conventional flame holder.

The inventors believe that the perforated flame holder 102 causes the combustion reaction 302 to begin within thermal boundary layers 314 formed adjacent to walls 308 of the perforations 210. Insofar as combustion is generally understood to include a large number of individual reactions, and since a large portion of combustion energy is released within the perforated flame holder 102, it is apparent that at least a majority of the individual reactions occur within the perforated flame holder 102. As the relatively cool fuel and oxidant mixture 206 approaches the input face 212, the flow is split into portions that respectively travel through individual perforations 210. The hot perforated flame holder body 208 transfers heat to the fluid, notably within thermal boundary layers 314 that progressively thicken as more and more heat is transferred to the incoming fuel and oxidant mixture 206. After reaching a combustion temperature (e.g., the auto-ignition temperature of the fuel), the reactants continue to flow while a chemical ignition delay time elapses, over which time the combustion reaction 302 occurs. Accordingly, the combustion reaction 302 is shown as occurring within the thermal boundary layers 314. As flow progresses, the thermal boundary layers 314 merge at a merger point 316. Ideally, the merger point 316 lies between the input face 212 and output face 214 that define the ends of the perforations 210. At some position along the length of a perforation 210, the combustion reaction 302 outputs more heat to the perforated flame holder body 208 than it receives from the perforated flame holder body 208. The heat is received at the heat receiving region 306, is held by the perforated flame holder body 208, and is transported to the heat output region 310 nearer to the input face 212, where the heat is transferred into the cool reactants (and any included diluent) to bring the reactants to the ignition temperature.

In an embodiment, each of the perforations 210 is characterized by a length L defined as a reaction fluid propagation path length between the input face 212 and the output face 214 of the perforated flame holder 102. As used herein, the term reaction fluid refers to matter that travels through a perforation 210. Near the input face 212, the reaction fluid includes the fuel and oxidant mixture 206 (optionally including nitrogen, flue gas, and/or other "non-reactive" species). Within the combustion reaction region, the reaction fluid may include plasma associated with the combustion reaction 302, molecules of reactants and their constituent parts, any non-reactive species, reaction intermediates (including transition states), and reaction products. Near the output face 214, the reaction fluid may include reaction products and byproducts, non-reactive gas, and excess oxidant.

The plurality of perforations 210 can be each characterized by a transverse dimension D between opposing perforation walls 308. The inventors have found that stable combustion can be maintained in the perforated flame holder 102 if the length L of each perforation 210 is at least four times the transverse dimension D of the perforation. In other embodiments, the length L can be greater than six times the transverse dimension D. For example, experiments have been run where L is at least eight, at least twelve, at least sixteen, and at least twenty-four times the transverse dimension D. Preferably, the length L is sufficiently long for thermal boundary layers 314 to form adjacent to the perforation walls 308 in a reaction fluid flowing through the perforations 210 to converge at merger points 316 within the perforations 210 between the input face 212 and the output face 214 of the perforated flame holder 102. In experiments, the inventors have found L/D ratios between 12 and 48 to work well (i.e., produce low NOx, produce low CO, and maintain stable combustion).

The perforated flame holder body 208 can be configured to convey heat between adjacent perforations 210. The heat conveyed between adjacent perforations 210 can be selected to cause heat output from the combustion reaction portion 302 in a first perforation 210 to supply heat to stabilize a combustion reaction portion 302 in an adjacent perforation 210.

Referring especially to FIG. 2, the fuel and oxidant source 202 can further include a fuel nozzle 218, configured to output fuel, and an oxidant source 220 configured to output a fluid including the oxidant. For example, the fuel nozzle 218 can be configured to output pure fuel. The oxidant source 220 can be configured to output combustion air carrying oxygen, and optionally, flue gas.

The perforated flame holder 102 can be held by a perforated flame holder support structure 222 configured to hold the perforated flame holder 102 at a dilution distance $D_D$ away from the fuel nozzle 218. The fuel nozzle 218 can be configured to emit a fuel jet selected to entrain the oxidant to form the fuel and oxidant mixture 206 as the fuel jet and oxidant travel along a path to the perforated flame holder 102 through the dilution distance $D_D$ between the fuel nozzle 218 and the perforated flame holder 102. Additionally or alternatively (particularly when a blower is used to deliver oxidant contained in combustion air), the oxidant or combustion air source can be configured to entrain the fuel and the fuel and oxidant travel through the dilution distance $D_D$. In some embodiments, a flue gas recirculation path 224 can be provided. Additionally or alternatively, the fuel nozzle 218 can be configured to emit a fuel jet selected to entrain the oxidant and to entrain flue gas as the fuel jet travels through the dilution distance $D_D$ between the fuel nozzle 218 and the input face 212 of the perforated flame holder 102.

The fuel nozzle 218 can be configured to emit the fuel through one or more fuel orifices 226 having an inside diameter dimension that is referred to as "nozzle diameter." The perforated flame holder support structure 222 can support the perforated flame holder 102 to receive the fuel and oxidant mixture 206 at the distance $D_D$ away from the fuel nozzle 218 greater than 20 times the nozzle diameter. In another embodiment, the perforated flame holder 102 is disposed to receive the fuel and oxidant mixture 206 at the distance $D_D$ away from the fuel nozzle 218 between 100 times and 1100 times the nozzle diameter. Preferably, the perforated flame holder support structure 222 is configured to hold the perforated flame holder 102 at a distance about 200 times or more of the nozzle diameter away from the fuel nozzle 218. When the fuel and oxidant mixture 206 travels about 200 times the nozzle diameter or more, the mixture is sufficiently homogenized to cause the combustion reaction 302 to produce minimal NOx.

The fuel and oxidant source 202 can alternatively include a premix fuel and oxidant source, according to an embodiment. A premix fuel and oxidant source can include a premix chamber (not shown), a fuel nozzle configured to output fuel into the premix chamber, and an oxidant (e.g., combustion air) channel configured to output the oxidant into the premix chamber. A flame arrestor can be disposed between the premix fuel and oxidant source and the perforated flame holder 102 and be configured to prevent flame flashback into the premix fuel and oxidant source.

The oxidant source 220, whether configured for entrainment in the combustion volume 204 or for premixing, can include a blower configured to force the oxidant through the fuel and oxidant source 202.

The support structure 222 can be configured to support the perforated flame holder 102 from a floor or wall (not shown) of the combustion volume 204, for example. In another embodiment, the support structure 222 supports the perforated flame holder 102 from the fuel and oxidant source 202. Alternatively, the support structure 222 can suspend the perforated flame holder 102 from an overhead structure (such as a flue, in the case of an up-fired system). The support structure 222 can support the perforated flame holder 102 in various orientations and directions.

The perforated flame holder 102 can include a single perforated flame holder body 208. In another embodiment, the perforated flame holder 102 can include a plurality of adjacent perforated flame holder sections that collectively provide a tiled perforated flame holder 102.

The perforated flame holder support structure 222 can be configured to support the plurality of perforated flame holder sections. The perforated flame holder support structure 222 can include a metal superalloy, a cementatious, and/or ceramic refractory material. In an embodiment, the plurality of adjacent perforated flame holder sections can be joined with a fiber reinforced refractory cement.

The perforated flame holder 102 can have a width dimension W between opposite sides of the peripheral surface 216 at least twice a thickness dimension T between the input face 212 and the output face 214. In another embodiment, the perforated flame holder 102 can have a width dimension W between opposite sides of the peripheral surface 216 at least three times, at least six times, or at least nine times the thickness dimension T between the input face 212 and the output face 214 of the perforated flame holder 102.

In an embodiment, the perforated flame holder 102 can have a width dimension W less than a width of the combustion volume 204. This can allow the flue gas circulation path 224 from above to below the perforated flame holder 102 to lie between the peripheral surface 216 of the perforated flame holder 102 and the combustion volume wall (not shown).

Referring again to both FIGS. 2 and 3, the perforations 210 can be of various shapes. In an embodiment, the perforations 210 can include elongated squares, each having a transverse dimension D between opposing sides of the squares. In another embodiment, the perforations 210 can include elongated hexagons, each having a transverse dimension D between opposing sides of the hexagons. In yet another embodiment, the perforations 210 can include hollow cylinders, each having a transverse dimension D corresponding to a diameter of the cylinder. In another embodiment, the perforations 210 can include truncated cones or truncated pyramids (e.g., frustums), each having a transverse dimension D radially symmetric relative to a length axis that extends from the input face 212 to the output face 214. In some embodiments, the perforations 210 can each have a lateral dimension D equal to or greater than a quenching distance of the flame based on standard reference conditions. Alternatively, the perforations 210 may have lateral dimension D less then than a standard reference quenching distance.

In one range of embodiments, each of the plurality of perforations 210 has a lateral dimension D between 0.05 inch and 1.0 inch. Preferably, each of the plurality of perforations 210 has a lateral dimension D between 0.1 inch and 0.5 inch. For example the plurality of perforations 210 can each have a lateral dimension D of about 0.2 to 0.4 inch.

The void fraction of a perforated flame holder 102 is defined as the total volume of all perforations 210 in a section of the perforated flame holder 102 divided by a total volume of the perforated flame holder 102 including body 208 and perforations 210. The perforated flame holder 102 should have a void fraction between 0.10 and 0.90. In an embodiment, the perforated flame holder 102 can have a void fraction between 0.30 and 0.80. In another embodiment, the perforated flame holder 102 can have a void fraction of about 0.70. Using a void fraction of about 0.70 was found to be especially effective for producing very low NOx.

The perforated flame holder 102 can be formed from a fiber reinforced cast refractory material and/or a refractory material such as an aluminum silicate material. For example, the perforated flame holder 102 can be formed to include mullite or cordierite. Additionally or alternatively, the perforated flame holder body 208 can include a metal superalloy such as Inconel or Hastelloy. The perforated flame holder body 208 can define a honeycomb. Honeycomb is an industrial term of art that need not strictly refer to a hexagonal cross section and most usually includes cells of square cross section. Honeycombs of other cross sectional areas are also known.

The inventors have found that the perforated flame holder 102 can be formed from VERSAGRID® ceramic honeycomb, available from Applied Ceramics, Inc. of Doraville, S.C.

The perforations 210 can be parallel to one another and normal to the input and output faces 212, 214. In another embodiment, the perforations 210 can be parallel to one another and formed at an angle relative to the input and output faces 212, 214. In another embodiment, the perforations 210 can be non-parallel to one another. In another embodiment, the perforations 210 can be non-parallel to one another and non-intersecting. In another embodiment, the perforations 210 can be intersecting. The body 208 can be one piece or can be formed from a plurality of sections.

In another embodiment, which is not necessarily preferred, the perforated flame holder 102 may be formed from reticulated ceramic material. The term "reticulated" refers to a netlike structure. Reticulated ceramic material is often made by dissolving a slurry into a sponge of specified porosity, allowing the slurry to harden, and burning away the sponge and curing the ceramic.

In another embodiment, which is not necessarily preferred, the perforated flame holder 102 may be formed from a ceramic material that has been punched, bored or cast to create channels.

In another embodiment, the perforated flame holder 102 can include a plurality of tubes or pipes bundled together. The plurality of perforations 210 can include hollow cylinders and can optionally also include interstitial spaces between the bundled tubes. In an embodiment, the plurality of tubes can include ceramic tubes. Refractory cement can be included between the tubes and configured to adhere the tubes together. In another embodiment, the plurality of tubes can include metal (e.g., superalloy) tubes. The plurality of tubes can be held together by a metal tension member circumferential to the plurality of tubes and arranged to hold the plurality of tubes together. The metal tension member can include stainless steel, a superalloy metal wire, and/or a superalloy metal band.

The perforated flame holder body 208 can alternatively include stacked perforated sheets of material, each sheet having openings that connect with openings of subjacent and superjacent sheets. The perforated sheets can include perforated metal sheets, ceramic sheets and/or expanded sheets. In another embodiment, the perforated flame holder body 208 can include discontinuous packing bodies such that the perforations 210 are formed in the interstitial spaces between the discontinuous packing bodies. In one example, the discontinuous packing bodies include structured packing shapes. In another example, the discontinuous packing bodies include random packing shapes. For example, the discontinuous packing bodies can include ceramic Raschig ring, ceramic Berl saddles, ceramic Intalox saddles, and/or metal rings or other shapes (e.g. Super Raschig Rings) that may be held together by a metal cage.

The inventors contemplate various explanations for why burner systems including the perforated flame holder 102 provide such clean combustion.

According to an embodiment, the perforated flame holder 102 may act as a heat source to maintain a combustion reaction even under conditions where a combustion reaction would not be stable when supported by a conventional flame holder. This capability can be leveraged to support combustion using a leaner fuel-to-oxidant mixture than is typically feasible. Thus, according to an embodiment, at the point where the fuel stream 206 contacts the input face 212 of the perforated flame holder 102, an average fuel-to-oxidant ratio of the fuel stream 206 is below a (conventional) lower combustion limit of the fuel component of the fuel stream 206—lower combustion limit defines the lowest concentration of fuel at which a fuel and oxidant mixture 206 will burn when exposed to a momentary ignition source under normal atmospheric pressure and an ambient temperature of 25° C. (77° F.).

The perforated flame holder 102 and systems including the perforated flame holder 102 described herein were found to provide substantially complete combustion of CO (single digit ppm down to undetectable, depending on experimental conditions), while supporting low NOx. According to one interpretation, such a performance can be achieved due to a sufficient mixing used to lower peak flame temperatures (among other strategies). Flame temperatures tend to peak under slightly rich conditions, which can be evident in any diffusion flame that is insufficiently mixed. By sufficiently mixing, a homogenous and slightly lean mixture can be achieved prior to combustion. This combination can result in reduced flame temperatures, and thus reduced NOx formation. In one embodiment, "slightly lean" may refer to 3% $O_2$, i.e. an equivalence ratio of ~0.87. Use of even leaner mixtures is possible, but may result in elevated levels of $O_2$. Moreover, the inventors believe perforation walls 308 may act as a heat sink for the combustion fluid. This effect may alternatively or additionally reduce combustion temperatures and lower NOx.

According to another interpretation, production of NOx can be reduced if the combustion reaction 302 occurs over a very short duration of time. Rapid combustion causes the reactants (including oxygen and entrained nitrogen) to be exposed to NOx-formation temperature for a time too short for NOx formation kinetics to cause significant production of NOx. The time required for the reactants to pass through the perforated flame holder 102 is very short compared to a conventional flame. The low NOx production associated with perforated flame holder combustion may thus be related to the short duration of time required for the reactants (and entrained nitrogen) to pass through the perforated flame holder 102.

Figure 4:
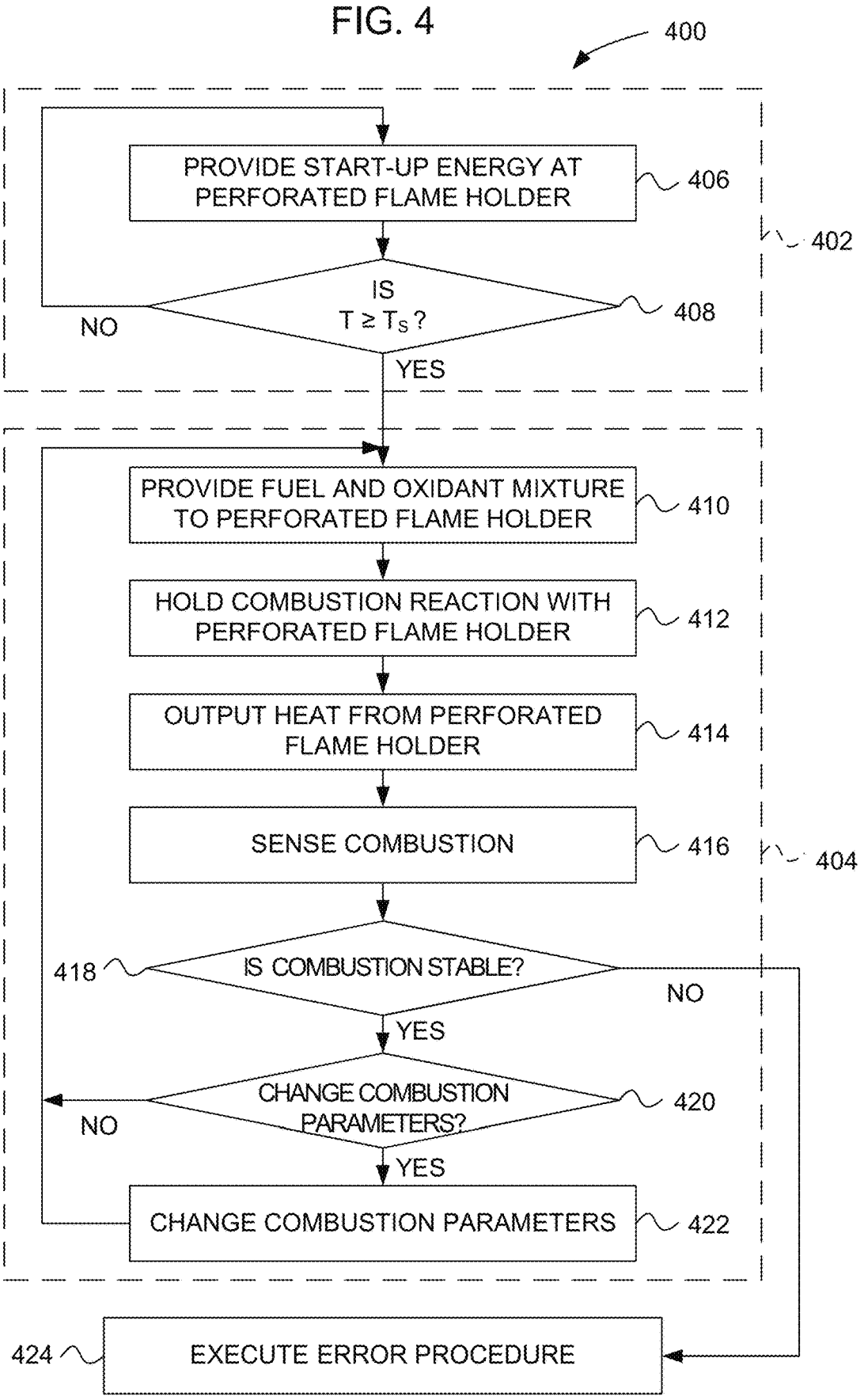
FIG. 4 is a flow chart showing a method for operating a burner system including the perforated flame holder of FIGS. 1A-3, according to an embodiment.

FIG. 4 is a flow chart showing a method 400 for operating a burner system including the perforated flame holder shown and described herein, according to an embodiment. To operate a burner system including a perforated flame holder, the perforated flame holder is first heated to a temperature sufficient to maintain combustion of the fuel and oxidant mixture.

According to a simplified description, the method 400 begins with step 402, wherein the perforated flame holder is preheated to a start-up temperature, $T_S$. After the perforated flame holder is raised to the start-up temperature, the method proceeds to step 404, wherein the fuel and oxidant are provided to the perforated flame holder and combustion is held by the perforated flame holder.

According to a more detailed description, step 402 begins with step 406, wherein start-up energy is provided at the perforated flame holder. Simultaneously or following providing start-up energy, a decision step 408 determines whether the temperature T of the perforated flame holder is at or above the start-up temperature, $T_S$. As long as the temperature of the perforated flame holder is below its start-up temperature, the method loops between steps 406 and 408 within the preheat step 402. In step 408, if the temperature T of at least a predetermined portion of the perforated flame holder is greater than or equal to the start-up temperature, the method 400 proceeds to overall step 404, wherein fuel and oxidant is supplied to and combustion is held by the perforated flame holder.

Step 404 may be broken down into several discrete steps, at least some of which may occur simultaneously.

Proceeding from step 408, a fuel and oxidant mixture is provided to the perforated flame holder, as shown in step 410. The fuel and oxidant may be provided by a fuel and oxidant source that includes a separate fuel nozzle and oxidant (e.g., combustion air) source, for example. In this approach, the fuel and oxidant are output in one or more directions selected to cause the fuel and oxidant mixture to be received by the input face of the perforated flame holder. The fuel may entrain the combustion air (or alternatively, the combustion air may dilute the fuel) to provide a fuel and oxidant mixture at the input face of the perforated flame holder at a fuel dilution selected for a stable combustion reaction that can be held within the perforations of the perforated flame holder.

Proceeding to step 412, the combustion reaction is held by the perforated flame holder.

In step 414, heat may be output from the perforated flame holder. The heat output from the perforated flame holder may be used to power an industrial process, heat a working fluid, generate electricity, or provide motive power, for example.

In optional step 416, the presence of combustion may be sensed. Various sensing approaches have been used and are contemplated by the inventors. Generally, combustion held by the perforated flame holder is very stable and no unusual sensing requirement is placed on the system. Combustion sensing may be performed using an infrared sensor, a video sensor, an ultraviolet sensor, a charged species sensor, thermocouple, thermopile, flame rod, and/or other combustion sensing apparatuses. In an additional or alternative variant of step 416, a pilot flame or other ignition source may be provided to cause ignition of the fuel and oxidant mixture in the event combustion is lost at the perforated flame holder.

Proceeding to decision step 418, if combustion is sensed not to be stable, the method 400 may exit to step 424, wherein an error procedure is executed. For example, the error procedure may include turning off fuel flow, re-executing the preheating step 402, outputting an alarm signal, igniting a stand-by combustion system, or other steps. If, in step 418, combustion in the perforated flame holder is determined to be stable, the method 400 proceeds to decision step 420, wherein it is determined if combustion parameters should be changed. If no combustion parameters are to be changed, the method loops (within step 404) back to step 410, and the combustion process continues. If a change in combustion parameters is indicated, the method 400 proceeds to step 422, wherein the combustion parameter change is executed. After changing the combustion parameter(s), the method loops (within step 404) back to step 410, and combustion continues.

Combustion parameters may be scheduled to be changed, for example, if a change in heat demand is encountered. For example, if less heat is required (e.g., due to decreased electricity demand, decreased motive power requirement, or lower industrial process throughput), the fuel and oxidant flow rate may be decreased in step 422. Conversely, if heat demand is increased, then fuel and oxidant flow may be increased. Additionally or alternatively, if the combustion system is in a start-up mode, then fuel and oxidant flow may be gradually increased to the perforated flame holder over one or more iterations of the loop within step 404.

Referring again to FIG. 2, the burner system 200 includes a heater 228 operatively coupled to the perforated flame holder 102. As described in conjunction with FIGS. 3 and 4, the perforated flame holder 102 operates by outputting heat to the incoming fuel and oxidant mixture 206. After combustion is established, this heat is provided by the combustion reaction 302; but before combustion is established, the heat is provided by the heater 228.

Various heating apparatuses have been used and are contemplated by the inventors. In some embodiments, the heater 228 can include a flame holder configured to support a flame disposed to heat the perforated flame holder 102. The fuel and oxidant source 202 can include a fuel nozzle 218 configured to emit a fuel stream 206 and an oxidant source 220 configured to output oxidant (e.g., combustion air) adjacent to the fuel stream 206. The fuel nozzle 218 and oxidant source 220 can be configured to output the fuel stream 206 to be progressively diluted by the oxidant (e.g., combustion air). The perforated flame holder 102 can be disposed to receive a diluted fuel and oxidant mixture 206 that supports a combustion reaction 302 that is stabilized by the perforated flame holder 102 when the perforated flame holder 102 is at an operating temperature. A start-up flame holder, in contrast, can be configured to support a start-up flame at a location corresponding to a relatively unmixed fuel and oxidant mixture that is stable without stabilization provided by the heated perforated flame holder 102.

The burner system 200 can further include a controller 230 operatively coupled to the heater 228 and to a data interface 232. For example, the controller 230 can be configured to control a start-up flame holder actuator configured to cause the start-up flame holder to hold the start-up flame when the perforated flame holder 102 needs to be pre-heated and to not hold the start-up flame when the perforated flame holder 102 is at an operating temperature (e.g., when $T \geq T_S$).

Various approaches for actuating a start-up flame are contemplated. In one embodiment, the start-up flame holder includes a mechanically-actuated bluff body configured to be actuated to intercept the fuel and oxidant mixture 206 to cause heat-recycling and/or stabilizing vortices and thereby hold a start-up flame; or to be actuated to not intercept the fuel and oxidant mixture 206 to cause the fuel and oxidant mixture 206 to proceed to the perforated flame holder 102. In another embodiment, a fuel control valve, blower, and/or damper may be used to select a fuel and oxidant mixture flow rate that is sufficiently low for a start-up flame to be jet-stabilized; and upon reaching a perforated flame holder 102 operating temperature, the flow rate may be increased to "blow out" the start-up flame. In another embodiment, the heater 228 may include an electrical power supply operatively coupled to the controller 230 and configured to apply an electrical charge or voltage to the fuel and oxidant mixture 206. An electrically conductive start-up flame holder may be selectively coupled to a voltage ground or other voltage selected to attract the electrical charge in the fuel and oxidant mixture 206. The attraction of the electrical charge was found by the inventors to cause a start-up flame to be held by the electrically conductive start-up flame holder.

In another embodiment, the heater 228 may include an electrical resistance heater configured to output heat to the perforated flame holder 102 and/or to the fuel and oxidant mixture 206. The electrical resistance heater can be configured to heat up the perforated flame holder 102 to an operating temperature. The heater 228 can further include a power supply and a switch operable, under control of the controller 230, to selectively couple the power supply to the electrical resistance heater.

An electrical resistance heater 228 can be formed in various ways. For example, the electrical resistance heater 228 can be formed from KANTHAL® wire (available from Sandvik Materials Technology division of Sandvik AB of Hallstahammar, Sweden) threaded through at least a portion of the perforations 210 defined by the perforated flame holder body 208. Alternatively, the heater 228 can include an inductive heater, a high-energy beam heater (e.g. microwave or laser), a frictional heater, electro-resistive ceramic coatings, or other types of heating technologies.

Other forms of start-up apparatuses are contemplated. For example, the heater 228 can include an electrical discharge igniter or hot surface igniter configured to output a pulsed ignition to the oxidant and fuel. Additionally or alternatively, a start-up apparatus can include a pilot flame apparatus disposed to ignite the fuel and oxidant mixture 206 that would otherwise enter the perforated flame holder 102. The electrical discharge igniter, hot surface igniter, and/or pilot flame apparatus can be operatively coupled to the controller 230, which can cause the electrical discharge igniter or pilot flame apparatus to maintain combustion of the fuel and oxidant mixture 206 in or upstream from the perforated flame holder 102 before the perforated flame holder 102 is heated sufficiently to maintain combustion.

The burner system 200 can further include a sensor 234 operatively coupled to the control circuit 230. The sensor 234 can include a heat sensor configured to detect infrared radiation or a temperature of the perforated flame holder 102. The control circuit 230 can be configured to control the heating apparatus 228 responsive to input from the sensor 234. Optionally, a fuel control valve 236 can be operatively coupled to the controller 230 and configured to control a flow of fuel to the fuel and oxidant source 202. Additionally or alternatively, an oxidant blower or damper 238 can be operatively coupled to the controller 230 and configured to control flow of the oxidant (or combustion air).

The sensor 234 can further include a combustion sensor operatively coupled to the control circuit 230, the combustion sensor being configured to detect a temperature, video image, and/or spectral characteristic of a combustion reaction held by the perforated flame holder 102. The fuel control valve 236 can be configured to control a flow of fuel from a fuel source to the fuel and oxidant source 202. The controller 230 can be configured to control the fuel control valve 236 responsive to input from the combustion sensor 234. The controller 230 can be configured to control the fuel control valve 236 and/or oxidant blower or damper to control a preheat flame type of heater 228 to heat the perforated flame holder 102 to an operating temperature. The controller 230 can similarly control the fuel control valve 236 and/or the oxidant blower or damper to change the fuel and oxidant mixture 206 flow responsive to a heat demand change received as data via the data interface 232.

Figure 5A:
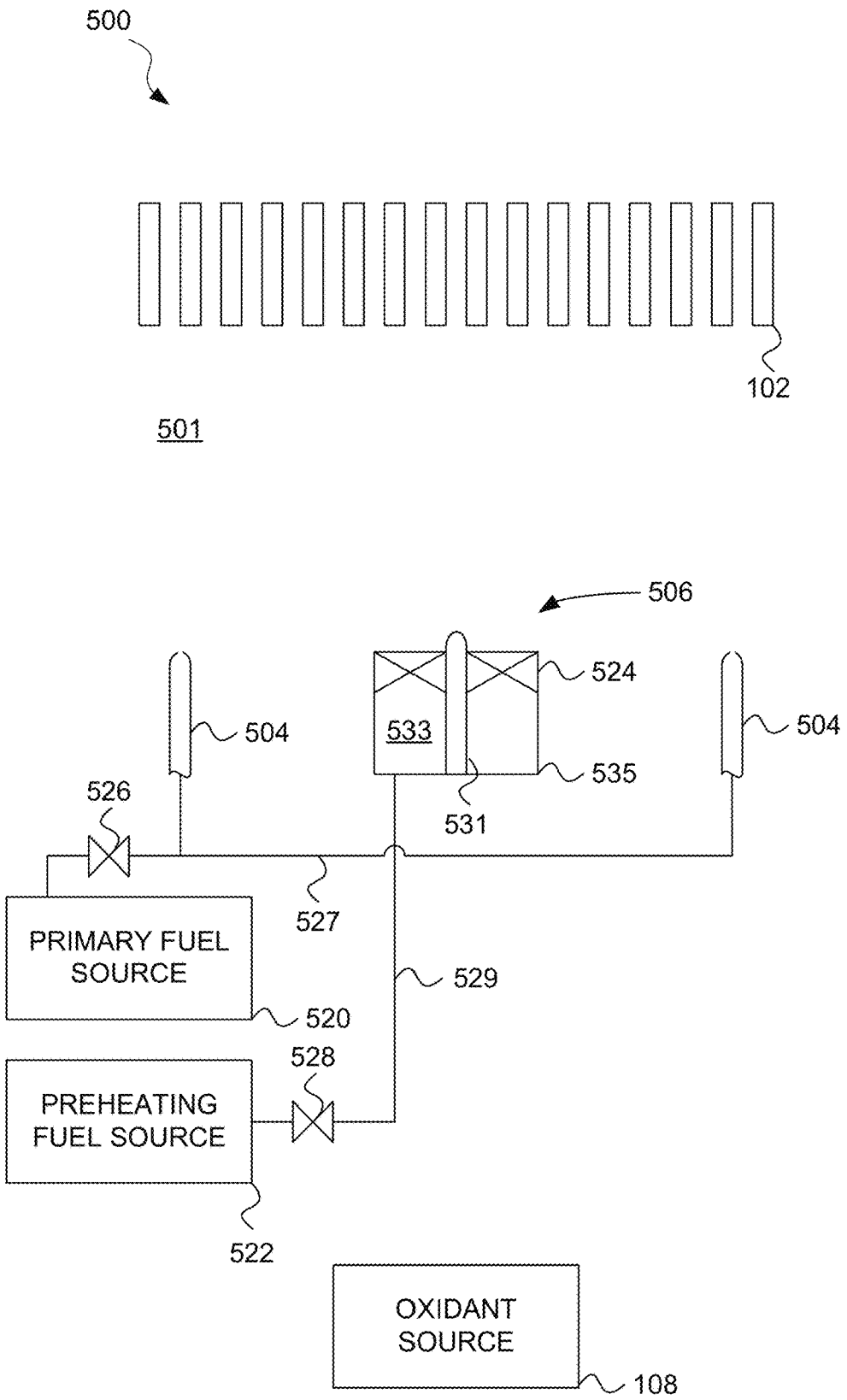
FIGS. 5A-5H are illustrations of a combustion system in various states of operation, according to an embodiment.

FIG. 5A is an illustration of a combustion system 500, according to an embodiment. The combustion system 500 includes a perforated flame holder 102 positioned in a furnace volume 501. The combustion system 500 includes a preheating fuel distributor 506 and a plurality of primary fuel distributors 504 positioned peripheral to the preheating fuel distributor 506. The combustion system 500 also includes a primary fuel source 520 and a preheating fuel source 522. The primary fuel source 520 is operatively connected to the primary fuel distributors 504 by a fuel line 527. A valve 526 connects the primary fuel source 520 to the fuel line 527. The preheating fuel source 522 is operatively connected to the preheating fuel distributor 506 by a fuel line 529. A valve 528 connects the preheating fuel source 522 to the fuel line 529. The combustion system 500 also includes an oxidant source 108.

According to an embodiment, the combustion system 500 can operate in a preheating state and in a standard operating state. In the preheating state, the oxidant source 108 outputs an oxidant 110 into the furnace volume 501 and the preheating fuel distributor 506 outputs a preheating fuel 112 into the furnace volume 501. In the preheating state, the preheating fuel distributor 506 supports a swirl-stabilized preheating flame 114 in the furnace volume 501. The swirl-stabilized preheating flame 114 preheats the perforated flame holder 102 to the threshold temperature. After the perforated flame holder 102 has been preheated to the threshold temperature, the combustion system 500 enters the standard operating state by removing the swirl-stabilized preheating flame 114. In the standard operating state, the primary fuel distributor 504 outputs the primary fuel 116 into the furnace volume 501. In the standard operating state the oxidant source 108 continues to output the oxidant into the furnace volume 501. The perforated flame holder 102 is positioned to receive a mixture of the primary fuel 116 and the oxidant 110 and to support a combustion reaction of the primary fuel 116 and the oxidant 110 within the perforated flame holder 102.

Figure 5B:
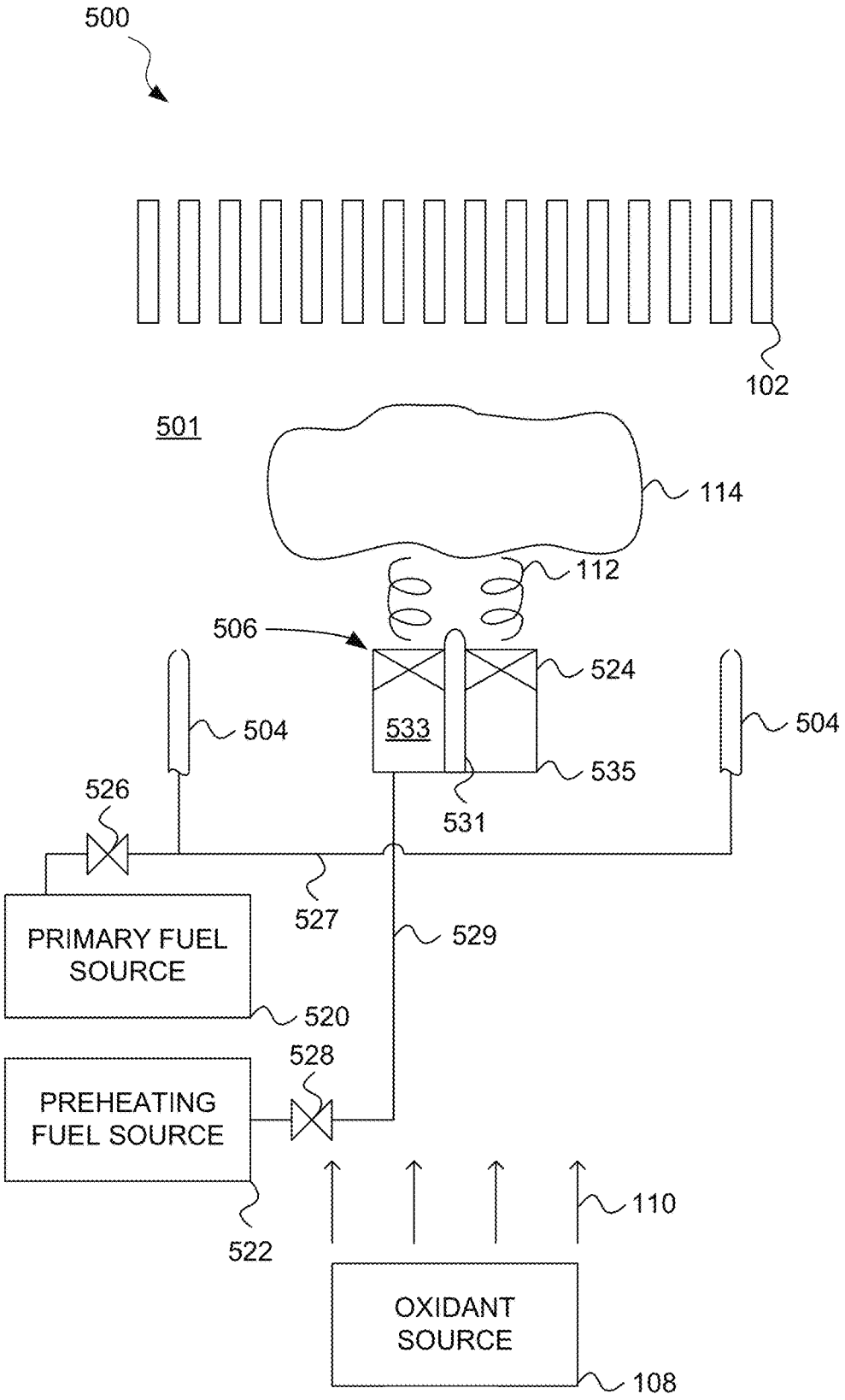

FIG. 5B is an illustration of the combustion system 500 in the preheating state, according to an embodiment. In the preheating state, the oxidant source 108 outputs an oxidant 110. The valve 528 is opened, such that the preheating fuel source 522 can supply the preheating fuel 112 to the preheating fuel distributor 506 via the fuel line 529. The preheating fuel distributor 506 outputs the preheating fuel 112 into the furnace volume 501. The preheating fuel distributor 506 imparts a swirling motion to one or both of the preheating fuel 112 and the oxidant 110. The preheating fuel distributor 506 supports a swirl-stabilized preheating flame 114 of the preheating fuel 112 and the oxidant 110. The preheating flame 114 preheats the perforated flame holder 102 to a threshold temperature.

According to an embodiment, the preheating fuel distributor 506 includes a swirler 524 coupled to a central hub 531. The preheating fuel distributor 506 includes an outer wall 535 that defines an interior conduit 533. The swirler 524 is positioned to impart a swirling motion to one or both of the preheating fuel 112 and the oxidant 110. The interior conduit 533 passes one or both of the preheating fuel 112 and the oxidant 110 to the swirler 524.

According to an embodiment, the preheating fuel distributor 506 imparts a swirling motion to the oxidant 110. In particular, the oxidant source 108 outputs the oxidant 110. A portion of the oxidant 110 enters the interior conduit 533 of the preheating fuel distributor 506. The interior conduit 533 passes the oxidant 110 through the swirler 524. The swirler 524 imparts a swirling motion to the oxidant 110. The oxidant 110 is therefore passed from the swirler 524 with a swirling motion. The preheating fuel distributor 506 also outputs the preheating fuel 112. The swirling oxidant 110 interacts with the preheating fuel 112 and mixes with the preheating fuel 112. The swirling motion of the oxidant 110 enhances mixing of the oxidant 110 and the preheating fuel 112. The combustion system 500 ignites the mixture of the preheating fuel 112 and the oxidant 110, thereby starting the preheating flame 114. The swirling motion imparted to the oxidant 110 causes the preheating flame 114 to be swirl-stabilized. The swirl-stabilized preheating flame 114 remains at a stable position relative to the preheating fuel distributor 506 and the perforated flame holder 102. According to an embodiment, the swirl-stabilized preheating flame 114 can be held in the stable position without additional flame holding structures to hold the preheating flame 114 in a stable position.

According to an embodiment, the preheating fuel distributor 506 outputs the preheating fuel 112 into the furnace volume 501 with a swirling motion. For example, the fuel line 529 may supply the preheating fuel 112 into the interior conduit 533 upstream from the swirler 524. The interior conduit 533 passes the preheating fuel 112 through the swirler 524. As the preheating fuel 112 is passed to the swirler 524, the swirler 524 imparts a swirling motion to the preheating fuel 112. As the preheating fuel 112 is output into the furnace volume 501 with a swirling motion, the preheating fuel 112 interacts with the oxidant 110 and mixes with the oxidant 110. The swirling motion of the preheating fuel 112 enhances the mixing of the oxidant 110 and the preheating fuel 112. The combustion system 500 ignites the mixture of the preheating fuel 112 and the oxidant 110, thereby initializing the preheating flame 114. The swirling motion imparted to the preheating fuel 112 causes the preheating flame 114 to be swirl-stabilized such that the swirl-stabilized preheating flame 114 remains at a stable position relative to the preheating fuel distributor 506 and the perforated flame holder 102.

According to an embodiment, the preheating fuel distributor 506 imparts a swirling motion to both the oxidant 110 and the preheating fuel 112. For example, the preheating fuel distributor 506 can pass both the oxidant 110 and the preheating fuel 112 to the swirler 524. As both the oxidant 110 and the preheating fuel 112 are passed through the swirler 524, the swirler 524 imparts a swirling motion to both the oxidant 110 and the preheating fuel 112. The swirling motion of both the oxidant 110 and the preheating fuel 112 causes enhanced mixing of the preheating fuel 112 and the oxidant 110. The combustion system 500 ignites the mixture of the preheating fuel 112 and the oxidant 110, thereby initializing the preheating flame 114. The swirling motion imparted to the preheating fuel 112 and the oxidant 110 causes the preheating flame 114 to be swirl-stabilized such that the swirl-stabilized preheating flame 114 remains at a stable position relative to the preheating fuel distributor 506 and the perforated flame holder 102.

According to an embodiment, the preheating fuel distributor 506 does not pass the preheating fuel 112 through the swirler 524. Instead, the fuel line 529 supplies the preheating fuel 112 into an interior of the central hub 531. The preheating fuel 112 passes through the interior of the central hub 531 and is output from an orifice at a downstream end of the central hub 531. The preheating fuel distributor 506 can impart a swirling motion to the preheating fuel 112 as it exits the central hub 531, for example, by including a fuel nozzle at the end of the central hub 531 that is structured to impart a swirling motion to the preheating fuel 112. Alternatively, the preheating fuel distributor 506 outputs the preheating fuel 112 without directly imparting a swirling motion to the preheating fuel 112. Instead, the swirling motion of the oxidant 110 can cause enhanced mixing of the oxidant 110 and the preheating fuel 112. The swirling motion of the oxidant 110 may impart a swirling motion to the preheating fuel 112.

According to an embodiment, the combustion system 500 may include multiple preheating fuel distributors 506 positioned between the primary fuel distributors 504. Each of the preheating fuel distributors 506 can output a preheating fuel 112 and can impart a swirling motion to one or both of the preheating fuel 112 and the oxidant 110. The multiple preheating fuel distributors 506 collectively support the swirl-stabilized preheating flame 114.

Figure 5C:
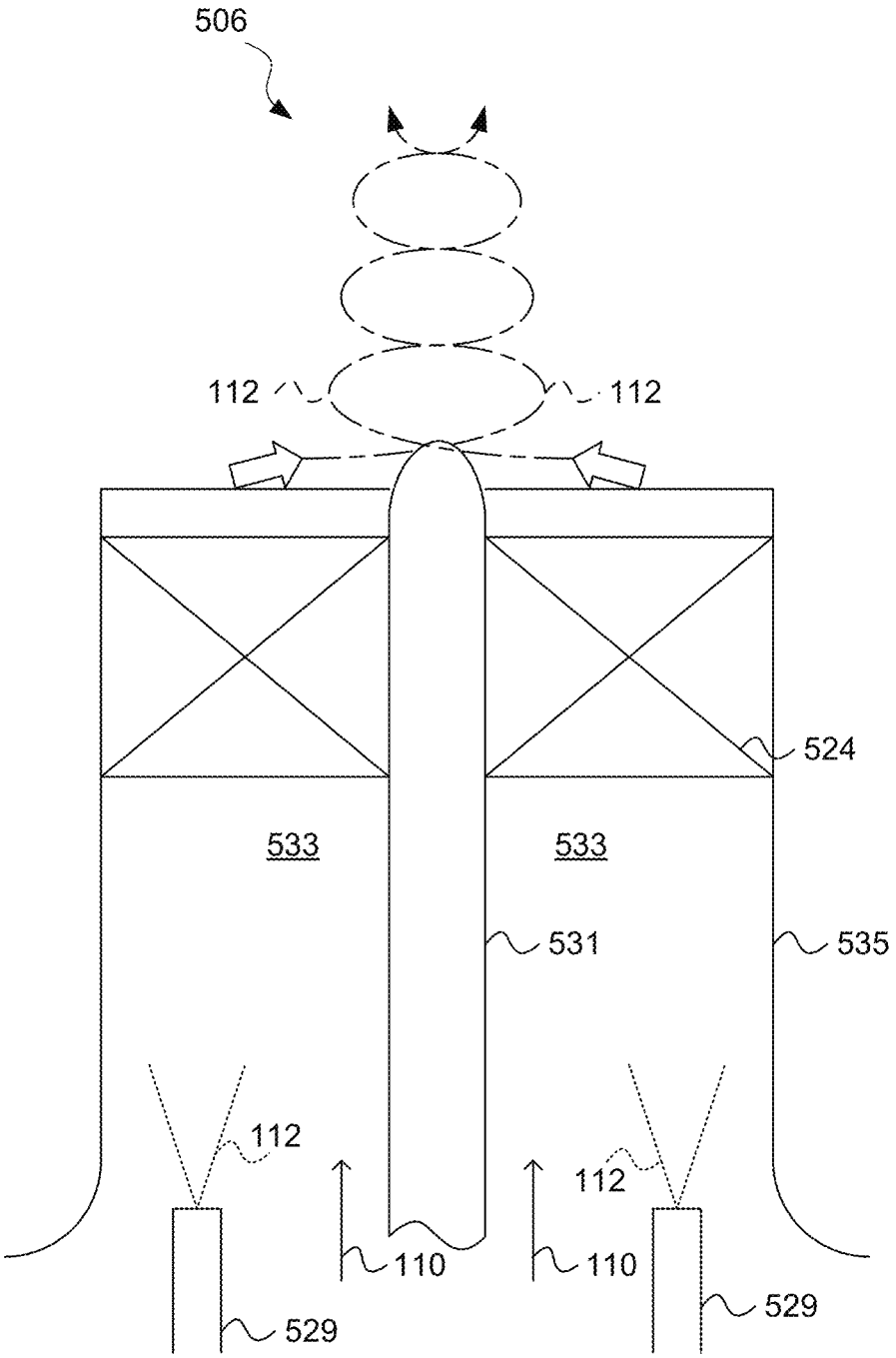

FIG. 5C is an enlarged cross-sectional diagram of the preheating fuel distributor 506 of the combustion system 500 during the preheating state, according to an embodiment. The interior conduit 533 is positioned to receive both oxidant 110 and preheating fuel 112. In particular, the oxidant source 108 outputs oxidant 110 into the combustion volume 501 such that a portion of the oxidant 110 enters the conduit 533. The preheating fuel source 522 supplies preheating fuel 112 into the conduit 533 via the fuel line 529. The preheating fuel 112 and the oxidant 110 travel through the conduit 533 and pass through the swirler 524. The swirler 524 imparts a swirling motion to both the preheating fuel 112 and the oxidant 110. The preheating fuel distributor 506 outputs both the oxidant 110 and the preheating fuel 112 and supports the swirl-stabilized preheating flame 114 with the preheating fuel 112 and the oxidant 110.

Figure 5D:
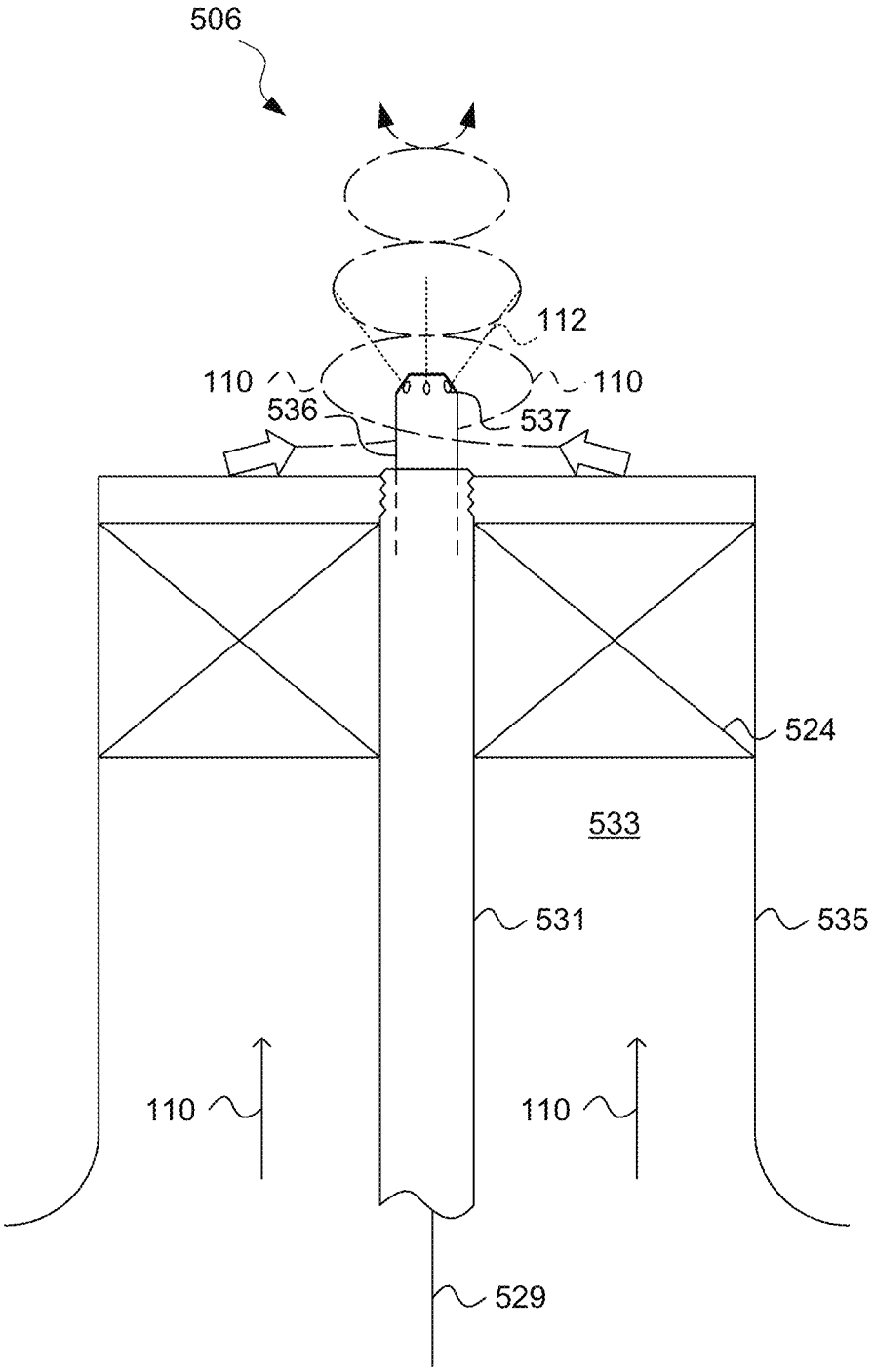

FIG. 5D is an enlarged cross-sectional diagram of a preheating fuel distributor 506 of the combustion system 500 during the preheating state, according to an alternate embodiment. The conduit 533 is positioned to receive the oxidant 110 as described in relation to FIG. 5C. The oxidant 110 is passed through the swirler 524. The swirler 524 imparts a swirling motion to the oxidant 110. The preheating fuel source 522 supplies the preheating fuel 112 into the central hub 531 via the fuel line 529. The central hub 531 can be a fuel riser. The preheating fuel 112 passes through the central hub 531 and is output from the central hub 531 via a fuel nozzle 536 including one or more orifices 537. When the preheating fuel 112 is output from the central hub 531, the swirling oxidant 110 interacts with the preheating fuel 112. The swirling motion of the oxidant 110 causes the preheating fuel 112 and the oxidant 110 to mix. The preheating fuel distributor 506 supports a swirl-stabilized preheating flame 114 with the preheating fuel 112 and the oxidant 110.

Figure 5E:
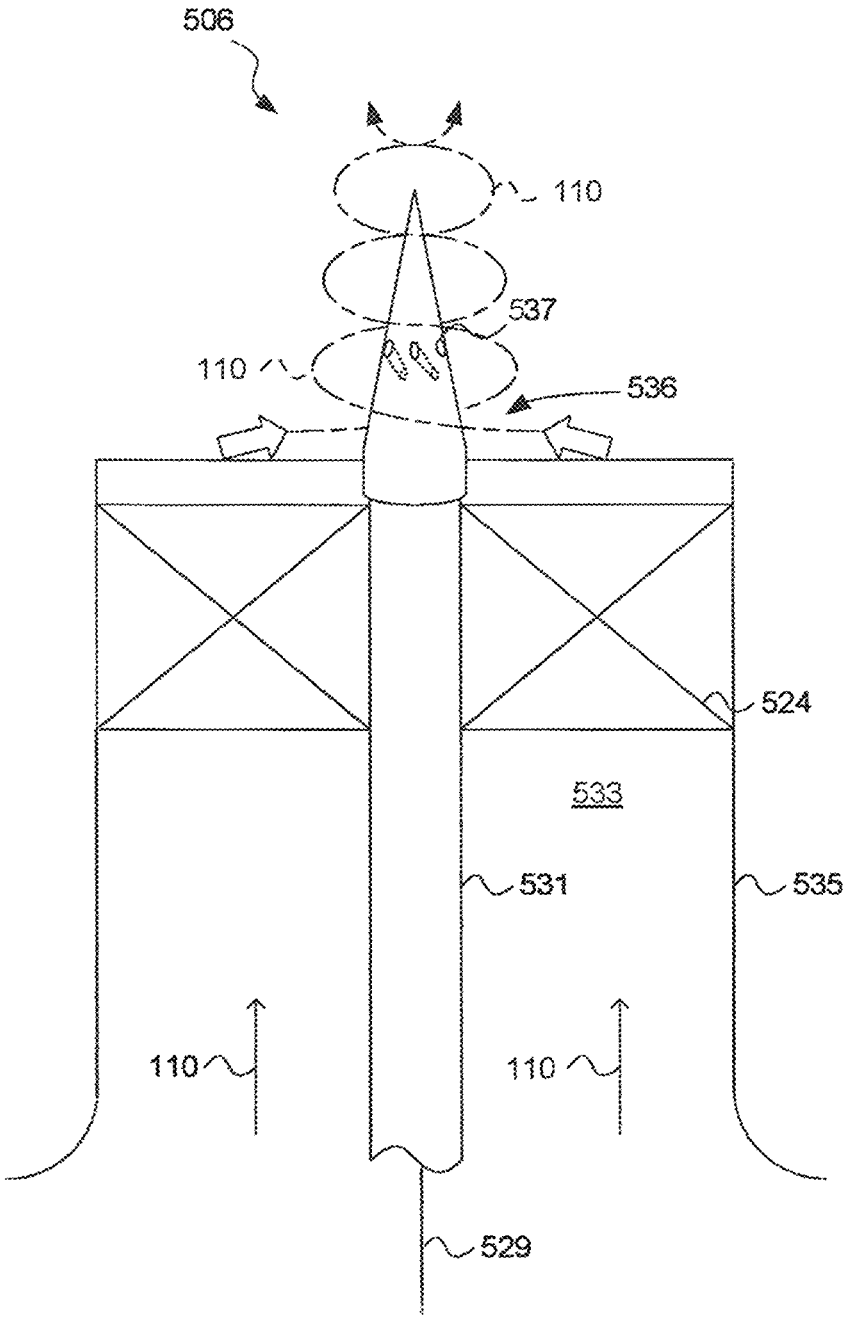

FIG. 5E is an enlarged cross-sectional diagram of a preheating fuel distributor 506 of the combustion system 500 during the preheating state, according to an alternate embodiment. The conduit 533 is positioned to receive the oxidant 110 as described in relation to FIG. 5C. The oxidant 110 is passed through the swirler 524. The swirler 524 imparts a swirling motion to the oxidant 110. The preheating fuel source 522 supplies the preheating fuel 112 into the central hub 531 via the fuel line 529 as described in relation to FIG. 5D. The preheating fuel distributor 506 includes an aerodynamic fuel nozzle 536 coupled to the central hub 531. The aerodynamic fuel nozzle 536 includes a plurality of orifices 537 each communicatively coupled to a compound angle fuel channel within the aerodynamic fuel nozzle 536. The aerodynamic fuel nozzle 536 outputs from each orifice 537 the preheating fuel 112 with a swirling motion. The swirling preheating fuel 112 interacts with the swirling oxidant 110. The swirling motion of the preheating fuel 112 and the swirling oxidant 110 causes the preheating fuel 112 to mix with the oxidant 110. The preheating fuel distributor 506 supports a swirl-stabilized preheating flame 114 with the preheating fuel 112 and the oxidant 110.

Figure 5F:
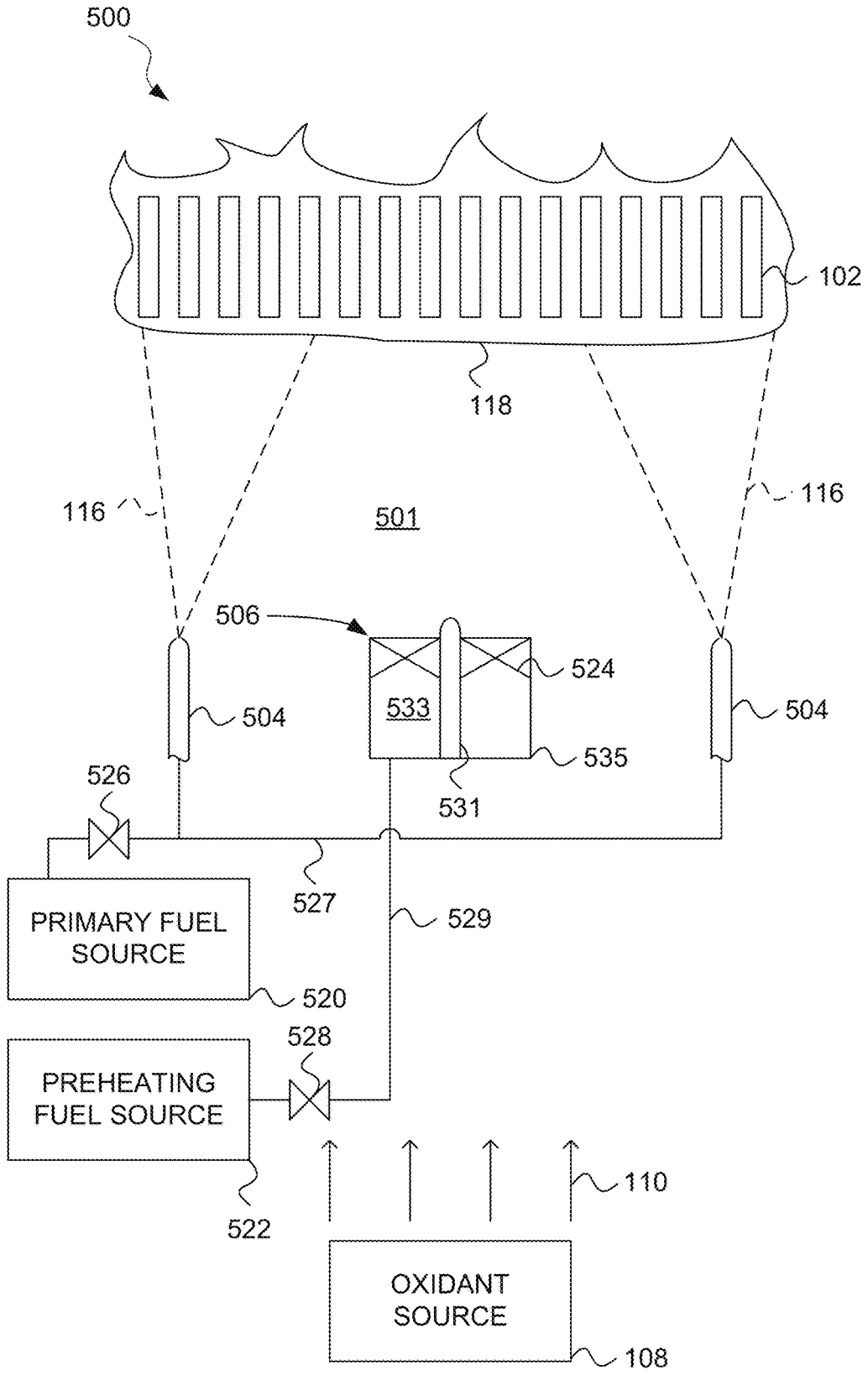

FIG. 5F is an illustration of the combustion system 500 of FIG. 5A in the standard operating state, according to an embodiment. In the standard operating state the preheating fuel distributor 506 has ceased outputting the preheating fuel 112, thereby removing the swirl-stabilized preheating flame 114. This can be accomplished by closing the valve 528, thereby preventing the preheating fuel source 522 from supplying the preheating fuel 112 to the preheating fuel distributor 506 and the fuel line 529. In the standard operating state, the valve 526 is open, thereby enabling the primary fuel source 520 to supply the primary fuel 116 to the primary fuel distributors 504. In the standard operating state, the primary fuel distributors 504 output the primary fuel 116 into the furnace volume 501. In the standard operating state, the oxidant source 108 continues to output the oxidant 110 into the furnace volume 501.

According to an embodiment, the primary fuel 116 mixes with the oxidant 110 in the furnace volume 501. The perforated flame holder 102 is positioned to receive a mixture of the primary fuel 116 and the oxidant 110. Because the perforated flame holder 102 has been preheated to the threshold temperature during the preheating state, the perforated flame holder 102 is at a sufficient temperature to sustain a combustion reaction 118 of the primary fuel 116 and the oxidant 110.

According to an embodiment, the perforated flame holder 102 sustains the combustion reaction 118 of the primary fuel 116 and the oxidant 110 at least partially within the perforated flame holder 102. The perforated flame holder 102 can also sustain a combustion reaction 118 outside of the perforated flame holder 102 adjacent to the perforated flame holder 102. For example, the perforated flame holder 102 can sustain the combustion reaction 118 downstream, upstream, and/or on the sides of the perforated flame holder 102. According to an embodiment, the perforated flame holder 102 can hold the combustion reaction 118 primarily within the perforated flame holder 102 while also holding a portion of the combustion reaction 118 outside of the perforated flame holder 102.

According to an embodiment, each primary fuel distributor 504 includes a respective fuel nozzle configured to output a stream of the primary fuel 116. The plurality of fuel nozzles are positioned peripherally around the preheating fuel distributor 506. Each stream of the primary fuel 116 mixes with the oxidant 110 such that the perforated flame holder 102 receives a mixture of the primary fuel 116 and the oxidant 110. The perforated flame holder 102 sustains a combustion reaction 118 of the primary fuel 116 and the oxidant 110.

According to an embodiment, each primary fuel distributor 504 corresponds to an orifice in a primary fuel manifold that surrounds the preheating fuel distributor 506. The fuel line 527 can include the primary fuel manifold or can feed into the primary fuel manifold. The primary fuel manifold can include an annular shape. In the standard operating state, each orifice outputs a stream of the primary fuel 116. Each stream of the primary fuel 116 mixes with the oxidant 110. The perforated flame holder 102 receives a mixture of the primary fuel 116 and the oxidant 110 and sustains a combustion reaction 118 of the primary fuel 116 and the oxidant 110.

Figure 5G:
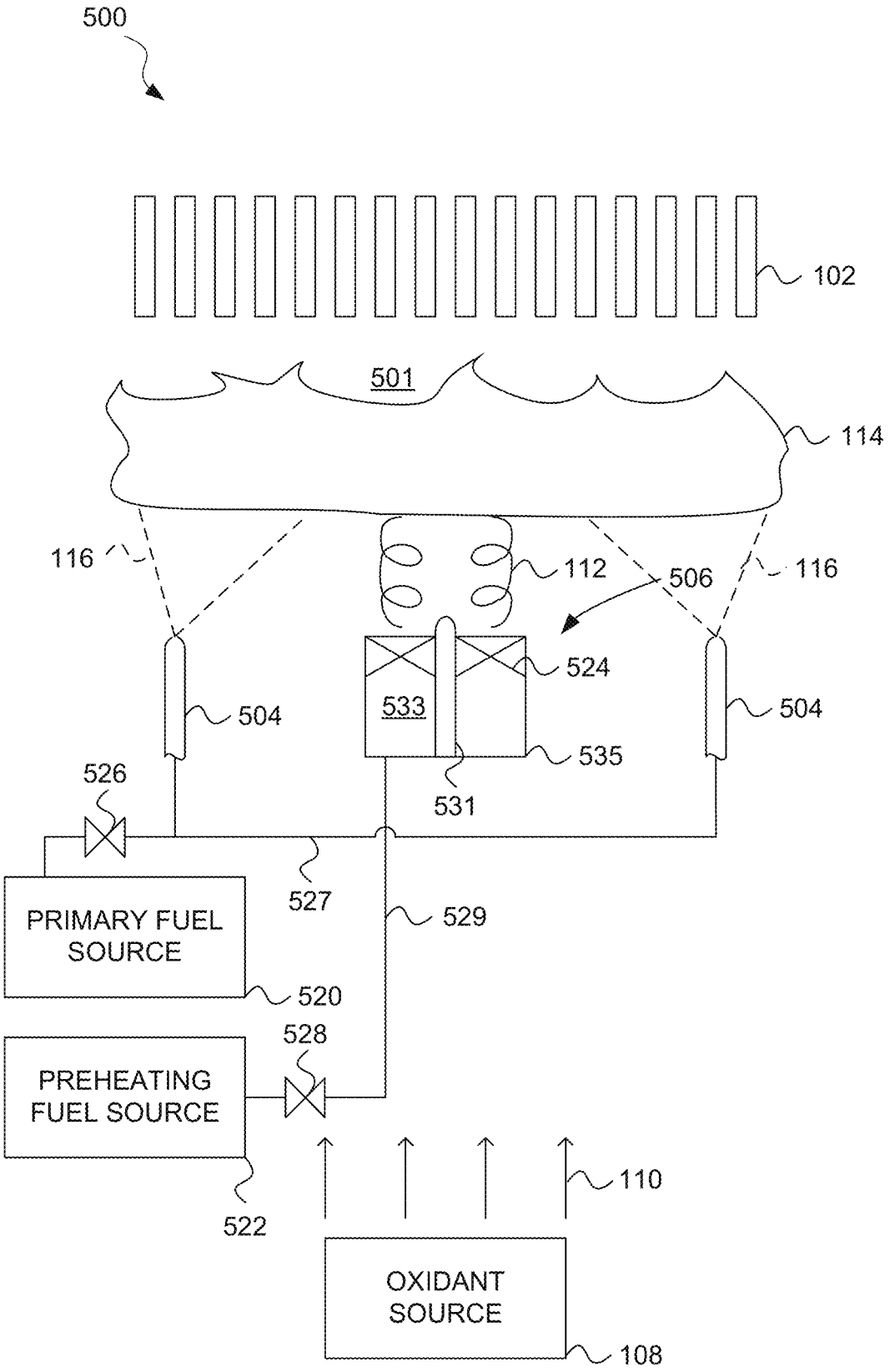

FIG. 5G is an illustration of the combustion system 500 in a standard operating state, according to an alternate embodiment. In FIG. 5G, the preheating fuel distributor 506 supports a swirl-stabilized preheating flame 114 with the preheating fuel 112 and the oxidant 110 as described in relation to FIG. 5B. Differently than in FIG. 5B, the primary fuel distributors 504 output the primary fuel 116 during the preheating state. Because the preheating fuel distributor 506 is supporting a swirl-stabilized preheating flame 114, the primary fuel 116 is ignited by the swirl-stabilized preheating flame 114 and contributes to the swirl-stabilized preheating flame 114. This can result in a swirl-stabilized preheating flame 114 that heats the perforated flame holder 102 more uniformly, more reliably, and more rapidly. After the perforated flame holder 102 has been heated to the threshold temperature, the combustion system 500 exits the preheating phase by closing the valve 528 such that the preheating fuel distributor 506 no longer outputs the preheating fuel 112. This causes the swirl-stabilized preheating flame 114 to extinguish. The combustion system 500 then enters the standard operating state during which the primary fuel distributors 504 continue to output the primary fuel 116. However, because the swirl-stabilized preheating flame 114 is no longer present, the primary fuel 116 does not ignite until the primary fuel 116 is received with the oxidant 110 at the perforated flame holder 102.

Figure 5H:
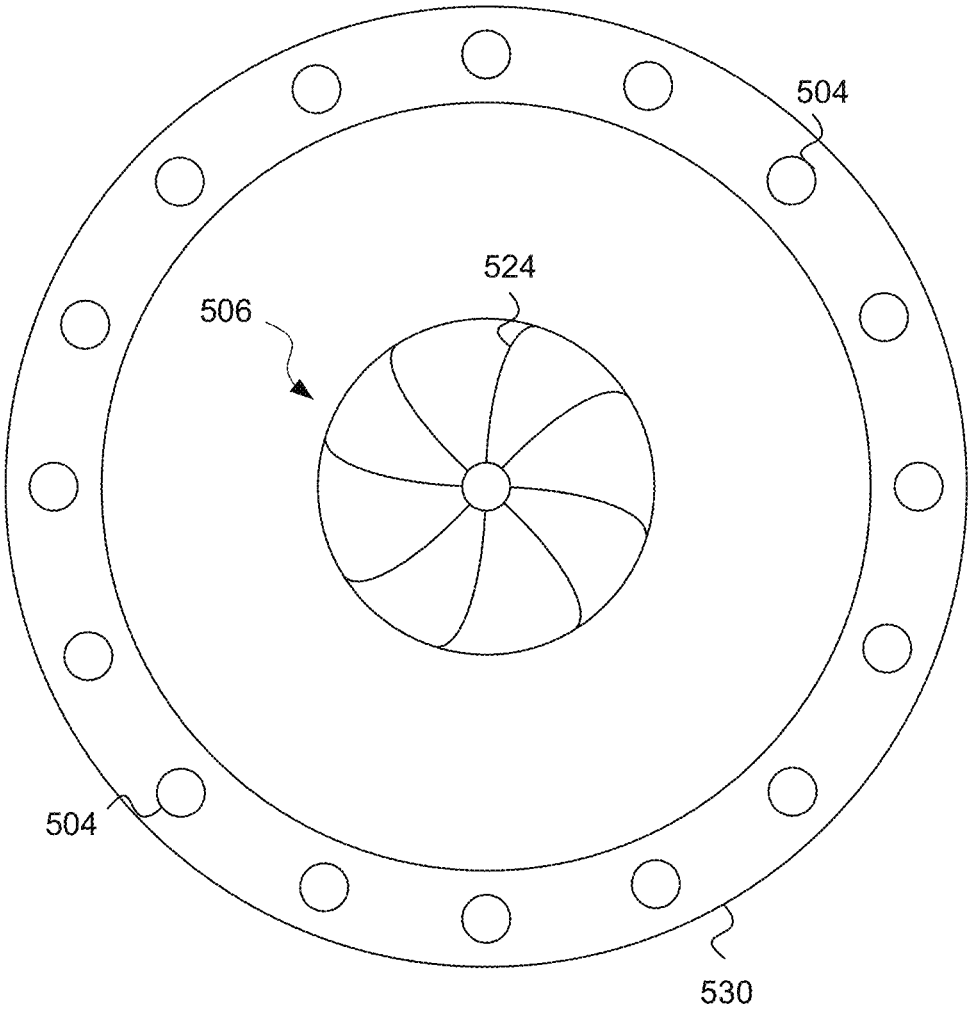

FIG. 5H is a top view of the primary fuel distributors 504 and the preheating fuel distributor 506, according to an embodiment. The top view of FIG. 5H shows the preheating fuel distributor 506 including the swirler 524 surrounded by a primary fuel manifold 530. A plurality of primary fuel distributors 504 are coupled to the primary fuel manifold 530 or are a part of the primary fuel manifold 530. The primary fuel distributors 504 can include fuel nozzles coupled to the primary fuel manifold 530. Alternatively, the primary fuel distributors 504 can include orifices in the primary fuel manifold 530. According to an embodiment, the combustion system 500 can include multiple concentric rings of primary fuel manifolds 530 surrounding the preheating fuel distributor 506. Each primary fuel manifold 530 can include or can be coupled to a plurality of primary fuel distributors 504. While the primary fuel distributors 504 are positioned peripherally to the preheating fuel distributor 506, the primary fuel distributors 504 can also be positioned above, below, or approximately at a same elevation as the preheating fuel distributor 506.

Figure 6A:
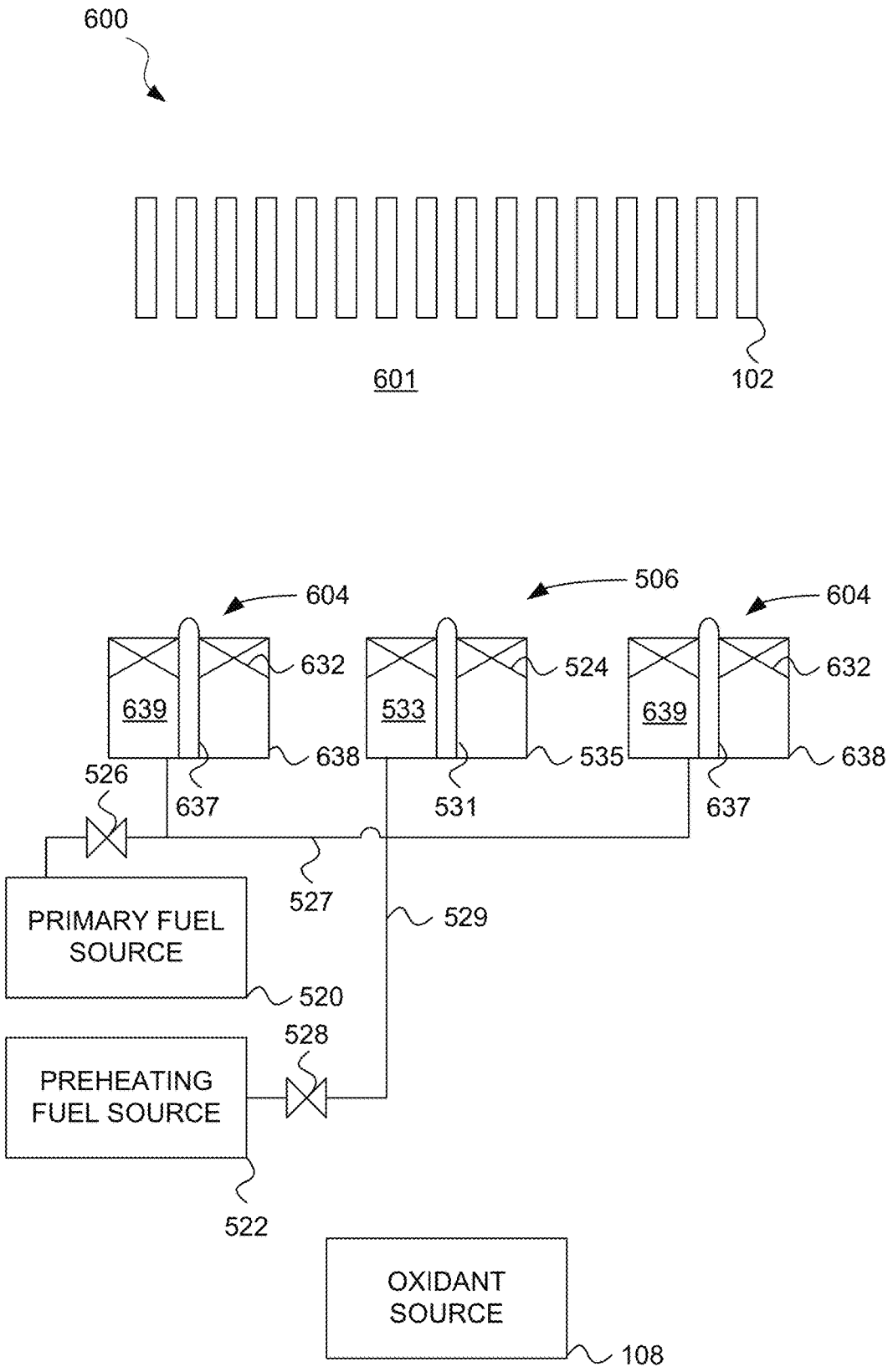
FIGS. 6A-6D are illustrations of a combustion system in various states of operation, according to an embodiment.

FIG. 6A is an illustration of a combustion system 600, according to an embodiment. The combustion system 600 may be similar in many ways to the combustion system 500 of FIG. 5A, except that the combustion system 600 includes primary fuel distributors 604 that are configured to impart a swirling motion to one or both of the primary fuel 116 and the oxidant 110 when in the standard operating state.

Figure 6B:
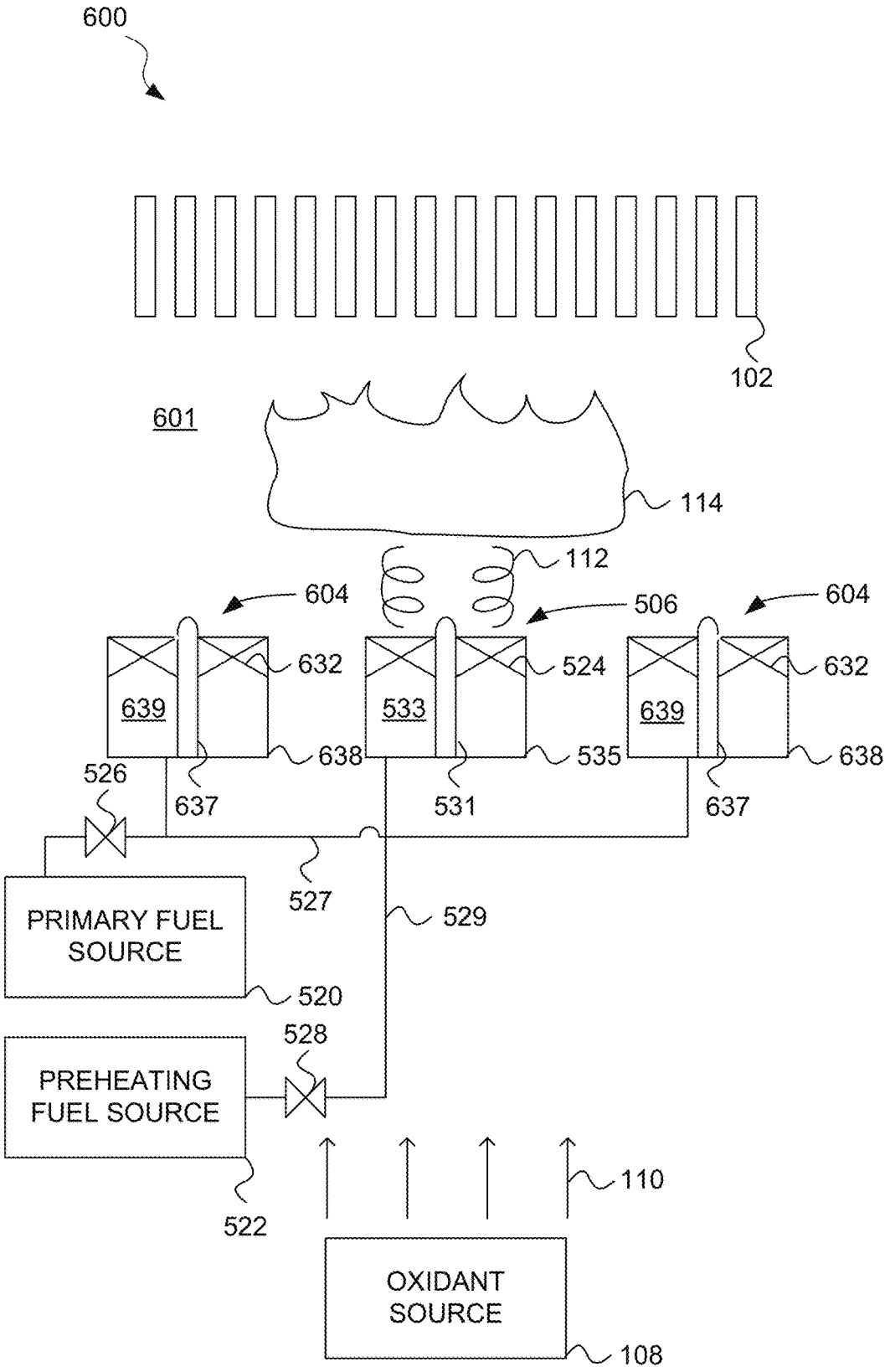

FIG. 6B is an illustration of the combustion system 600 in a preheating state, according to an embodiment. In the preheating state, the oxidant source 108 outputs an oxidant 110. The valve 528 is opened, such that the preheating fuel source 522 can supply the preheating fuel 112 to the preheating fuel distributor 506 via the fuel line 529. The preheating fuel distributor 506 outputs the preheating fuel 112 into the furnace volume 601. The preheating fuel distributor 506 imparts a swirling motion to one or both of the preheating fuel 112 and the oxidant 110. The preheating fuel distributor 506 supports a swirl-stabilized preheating flame 114 of the preheating fuel 112 and the oxidant 110. The swirl-stabilized preheating flame 114 preheats the perforated flame holder 102 to a threshold temperature.

According to an embodiment, in the preheating condition the combustion system 600 can operate in a substantially similar manner as the combustion system 500 as described in relation to FIG. 5B. The preheating fuel distributor 506 can be substantially similar to the preheating fuel distributor 506 as described in relation to any of FIGS. 5B-5E. Alternatively, the preheating fuel distributor 506 can operate to support a swirl-stabilized preheating flame 114 in another suitable manner. Those of skill in the art will recognize, in light of the present disclosure, that the preheating fuel distributor 506 can include swirl-inducing structures other than those described herein. All such other swirl-inducing structures fall within the scope of the present disclosure.

Figure 6C:
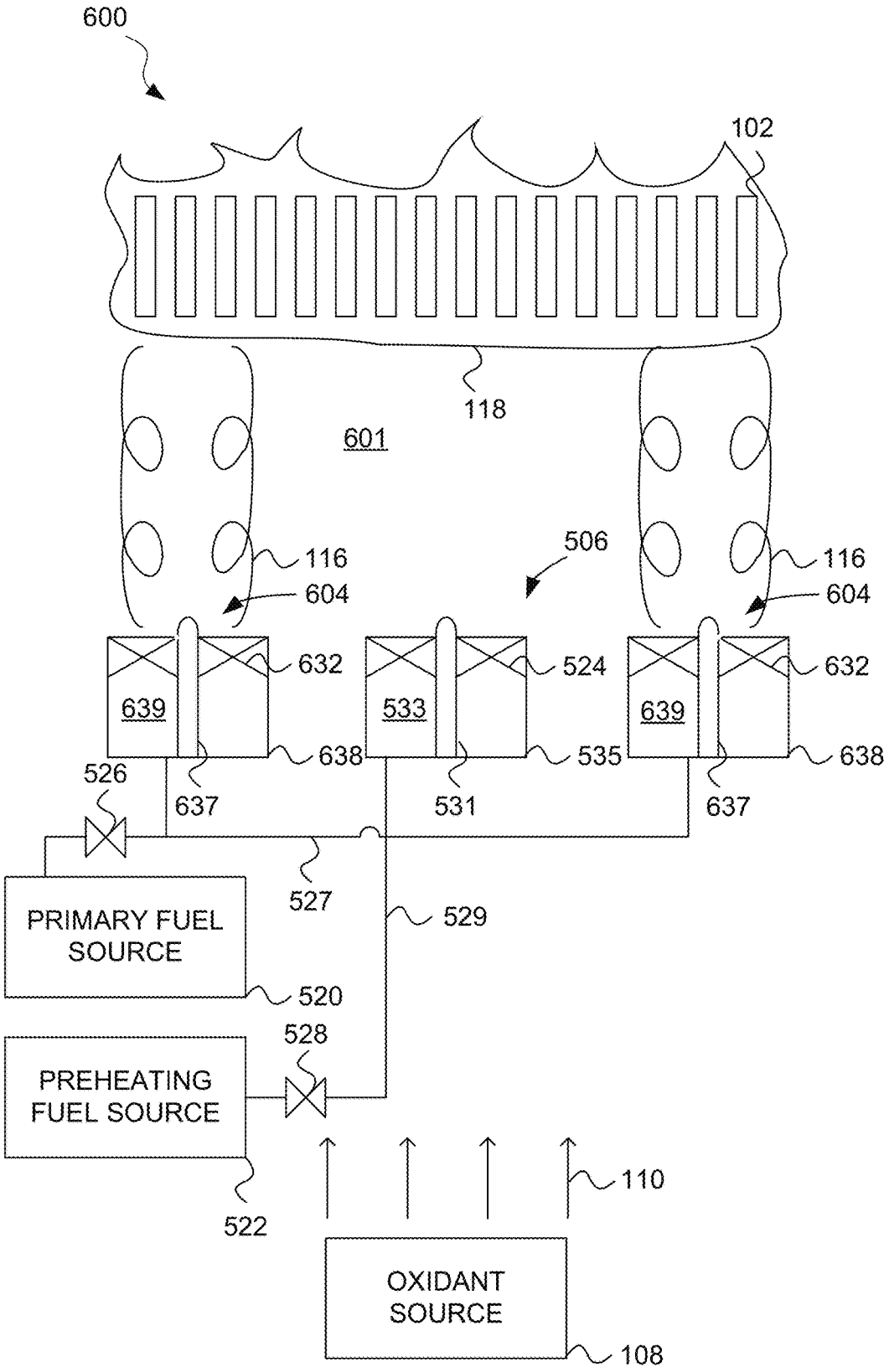

FIG. 6C is an illustration of the combustion system 600 of FIG. 6A in the standard operating state, according to an embodiment. According to an embodiment, each primary fuel distributor 604 includes a swirler 632 configured to impart a swirling motion to one or both of the primary fuel 116 and the oxidant 110. The swirler 632 is coupled to a central hub 637. The primary fuel distributors 604 can each include an outer wall 638 that defines a conduit 639 that passes one or both of the primary fuel 116 and the oxidant 110 to the swirler 632.

According to an embodiment, the primary fuel distributor 604 imparts a swirling motion to the oxidant 110, to the primary fuel 116, or to both the oxidant 110 and the primary fuel 116 as described in relation to FIGS. 5A-5E. The swirling motion of the oxidant 110 and/or the primary fuel 116 enhances mixing of the oxidant 110 and the primary fuel 116. This enables the primary fuel 116 and the oxidant 110 to be well mixed in a relatively short distance before reaching the perforated flame holder 102. If the primary fuel 116 and the oxidant 110 are not well mixed upon being received by the perforated flame holder 102, then it is possible that the perforated flame holder 102 will not sustain a stable combustion reaction 118 of the primary fuel 116 and the oxidant 110. The swirling motion imparted to the oxidant 110 enhances mixing of the primary fuel 116 and the oxidant 110 such that sufficient mixing of the primary fuel 116 and the oxidant 110 can occur in a shorter distance than would occur in the absence of the swirling motion. This in turn enables placing the perforated flame holder 102 nearer to the primary fuel distributors 604 than might otherwise be possible in absence of the swirling motion. This can result in a more compact and efficient combustion system 600. The perforated flame holder 102 receives the mixture of the primary fuel 116 and the oxidant 110 and supports a combustion reaction 118 of the primary fuel 116 and the oxidant 110.

According to an embodiment, the primary fuel distributors 604 differ from the preheating fuel distributor 506 in that they impart a lesser degree of swirl to the primary fuel 116 and/or the oxidant 110 than the preheating fuel distributor 506 imparts to the preheating fuel 112 and/or the oxidant 110. For example, the swirler 524 may result in a swirl number between about 0.6 and 1.0. The swirler 632 may result in a swirl number lower than 0.6.

According to an embodiment, the perforated flame holder 102 sustains the combustion reaction 118 of the primary fuel 116 and the oxidant 110 at least partially within the perforated flame holder 102. The perforated flame holder 102 can also sustain a combustion reaction 118 outside of the perforated flame holder 102 adjacent to the perforated flame holder 102. For example, the perforated flame holder 102 can sustain the combustion reaction 118 downstream, upstream, within, and/or on the sides of the perforated flame holder 102. According to an embodiment, the perforated flame holder 102 can hold the combustion reaction 118 primarily within the perforated flame holder 102 while also holding a portion of the combustion reaction 118 outside of the perforated flame holder 102.

Figure 6D:
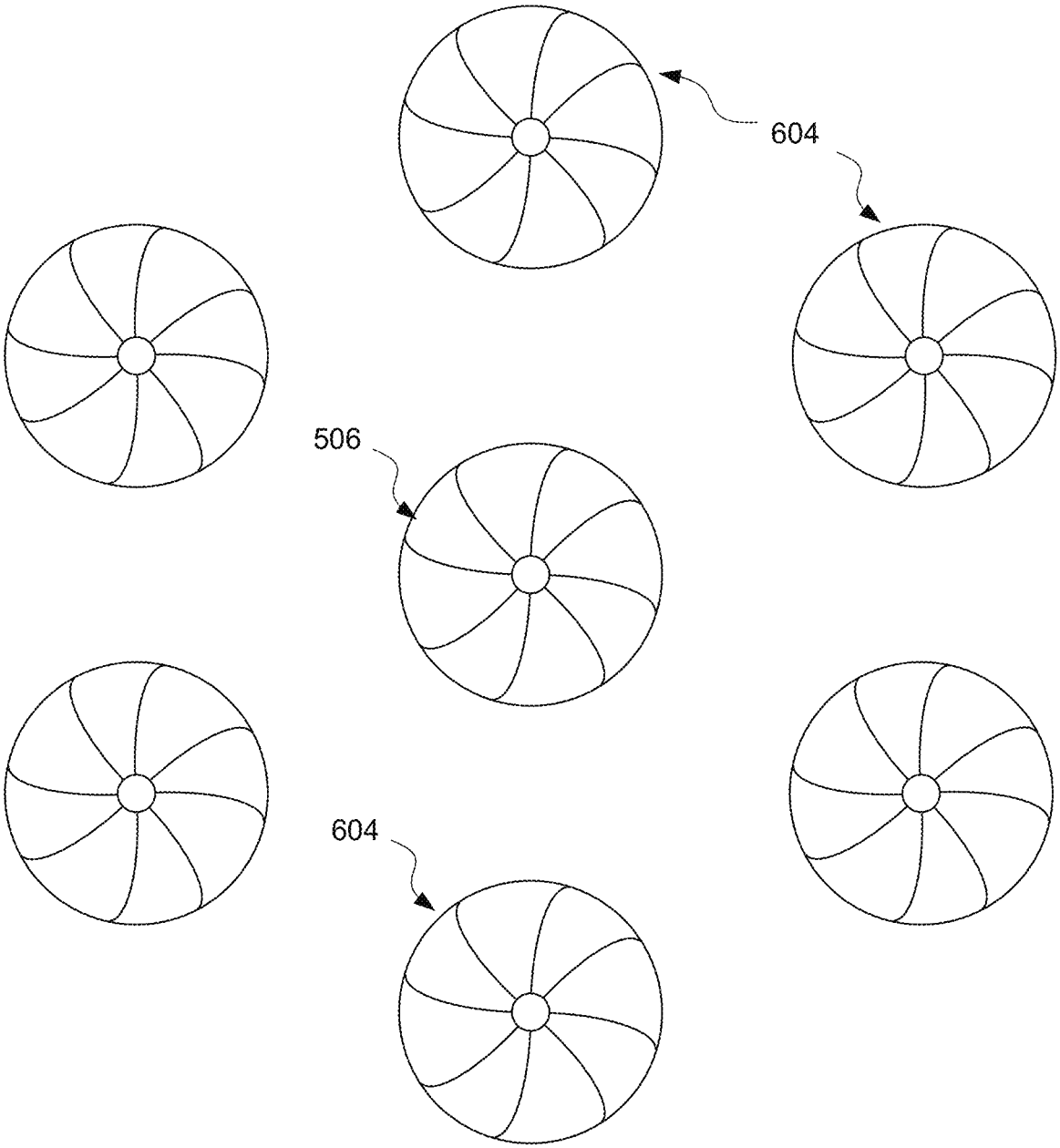

FIG. 6D is a top view of the primary fuel distributor 604 and the preheating fuel distributor 506 of the combustion system 600, according to an embodiment. The top view of FIG. 6D illustrates that the plurality of primary fuel distributors 604 are positioned peripherally to the preheating fuel distributor 506. In particular, the primary fuel distributors 604 laterally surround the preheating fuel distributor 506. The primary fuel distributors 604 can be positioned higher than the preheating fuel distributor 506, lower than the preheating fuel distributor 506, or substantially even with the preheating fuel distributor 506.

Figure 7A:
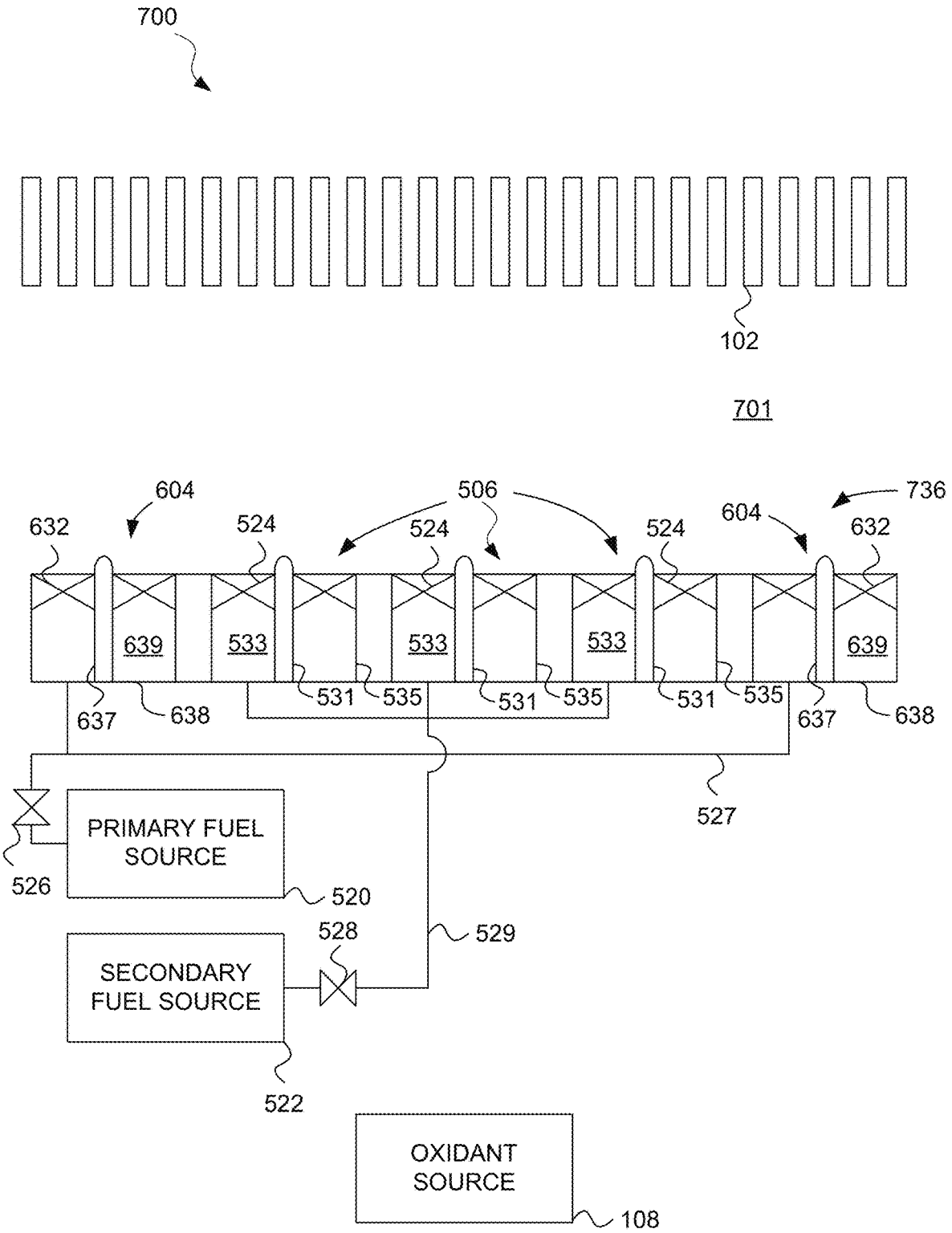
FIGS. 7A-7D are illustrations of a combustion system in various states of operation, according to an embodiment.

FIG. 7A is an illustration of a combustion system 700, according to an embodiment. The combustion system 700 includes a perforated flame holder 102 positioned in a furnace volume 701. The combustion system 700 includes a plurality of preheating fuel distributors 506 and a plurality of primary fuel distributors 604 positioned peripheral to the preheating fuel distributors 506. According to an embodiment, the combustion system 700 can be substantially similar to the combustion system 600 or the combustion system 500, except that the combustion system 700 includes multiple preheating fuel distributors 506 instead of a single preheating fuel distributor 506.

Figure 7B:
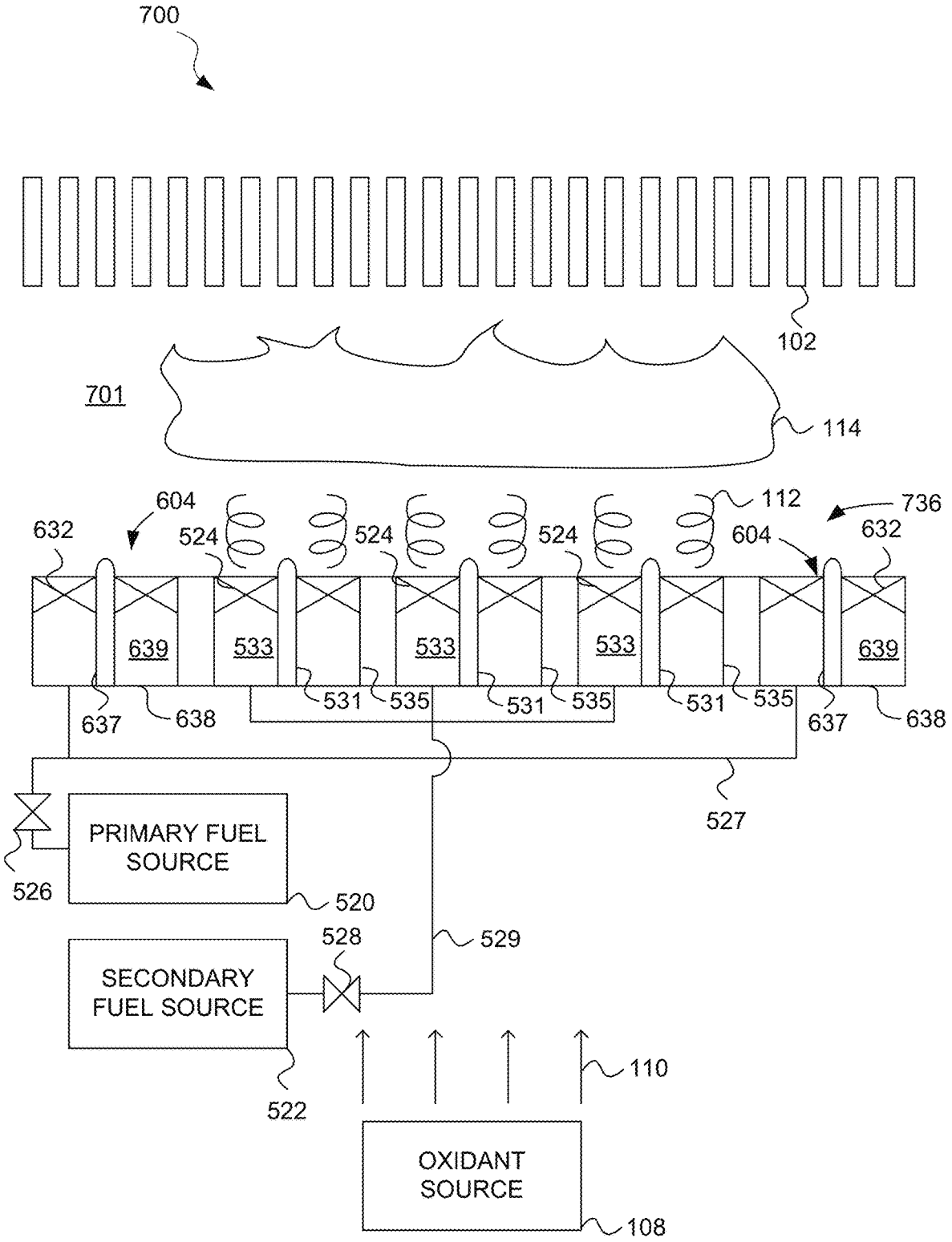

FIG. 7B is an illustration of the combustion system 700 of FIG. 7A in a preheating state, according to an embodiment. In the preheating state, the oxidant source 108 outputs the oxidant 110 and the preheating fuel distributors 506 output the preheating fuel 112 into the furnace volume 701. The preheating fuel distributors 506 impart a swirling motion to one or both of the preheating fuel 112 and the oxidant 110. The preheating fuel distributors 506 collectively support a swirl-stabilized preheating flame 114 of the preheating fuel 112 and the oxidant 110. The swirl-stabilized preheating flame 114 preheats the perforated flame holder 102 to a threshold temperature.

According to an embodiment, in the preheating state the combustion system 700 can operate in a substantially similar manner as the combustion system 500 or as the combustion system 600 as described in relation to FIG. 5B and FIG. 6B, except that multiple preheating fuel distributors 506 support the swirl-stabilized preheating flame 114. Each preheating fuel distributor 506 of the combustion system 700 can be substantially similar to the preheating fuel distributors 506 described in relation to any of FIGS. 5B-5E and FIG. 6B. Alternatively, the preheating fuel distributors 506 can operate to support a swirl-stabilized preheating flame 114 in another suitable manner. Those of skill in the art will recognize, in light of the present disclosure, that the preheating fuel distributor 506 can include swirl-inducing structures other than those described herein. All such other swirl-inducing structures fall within the scope of the present disclosure.

Figure 7C:
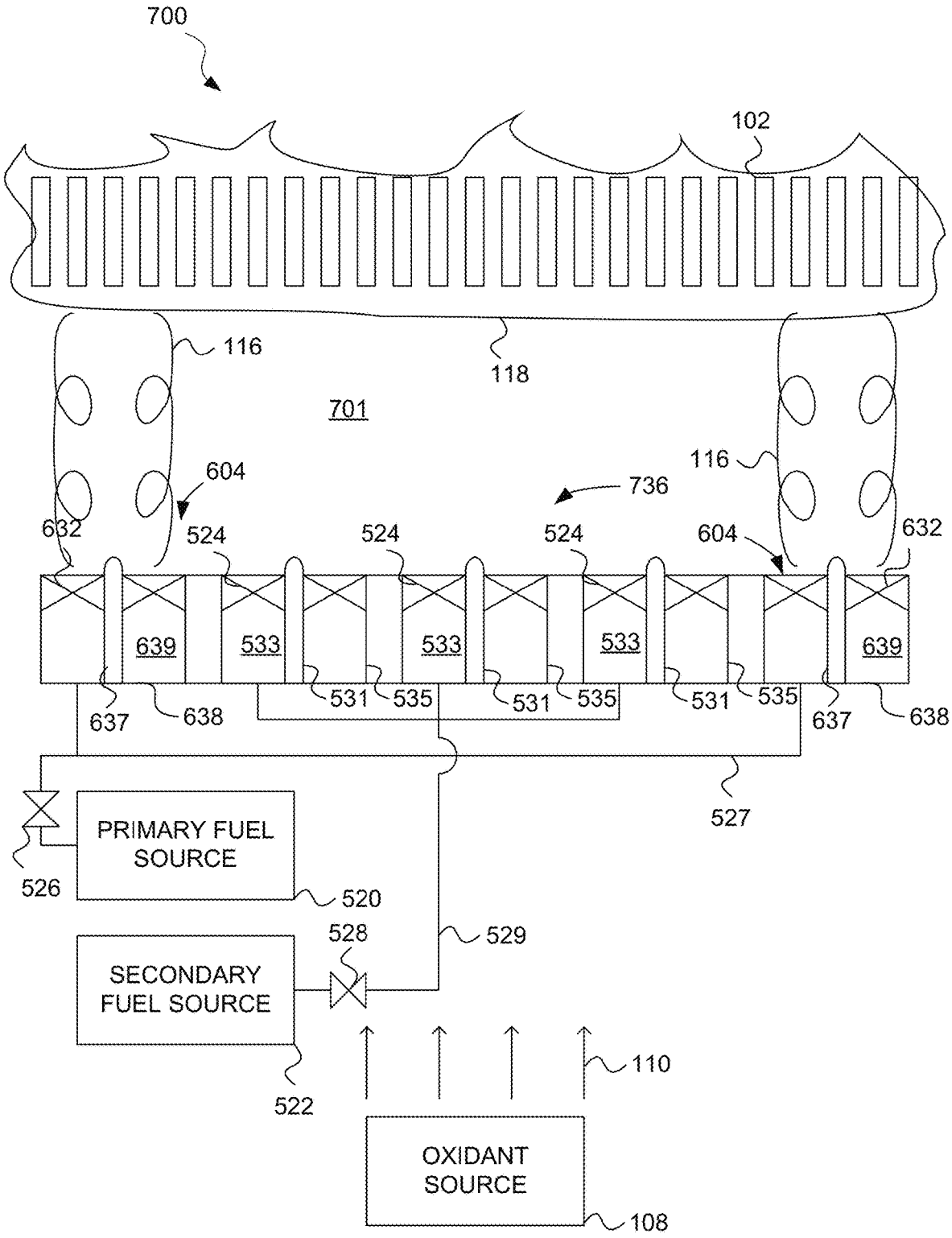

FIG. 7C is an illustration of the combustion system 700 of FIG. 7A in the standard operating state, according to an embodiment. In the standard operating state, the primary fuel distributors 604 output the primary fuel 116 into the furnace volume 701. In the standard operating state, the oxidant source 108 continues to output the oxidant 110 into the furnace volume 701. The perforated flame holder 102 receives the mix of the primary fuel 116 and the oxidant 110 and sustains a combustion reaction 118 of the primary fuel 116 and the oxidant 110.

According to an embodiment, the primary fuel distributors 604 impart a swirling motion to one or both of the primary fuel 116 and the oxidant 110 as described in relation to FIG. 6C. Alternatively, the primary fuel distributors 604 of the combustion system 700 can be similar to the primary fuel distributors 504 of the combustion system 500. The primary fuel distributors 604 of the combustion system 700 can alternatively include structures or characteristics different than those described in relation to the combustion systems 500 and 600.

Figure 7D:
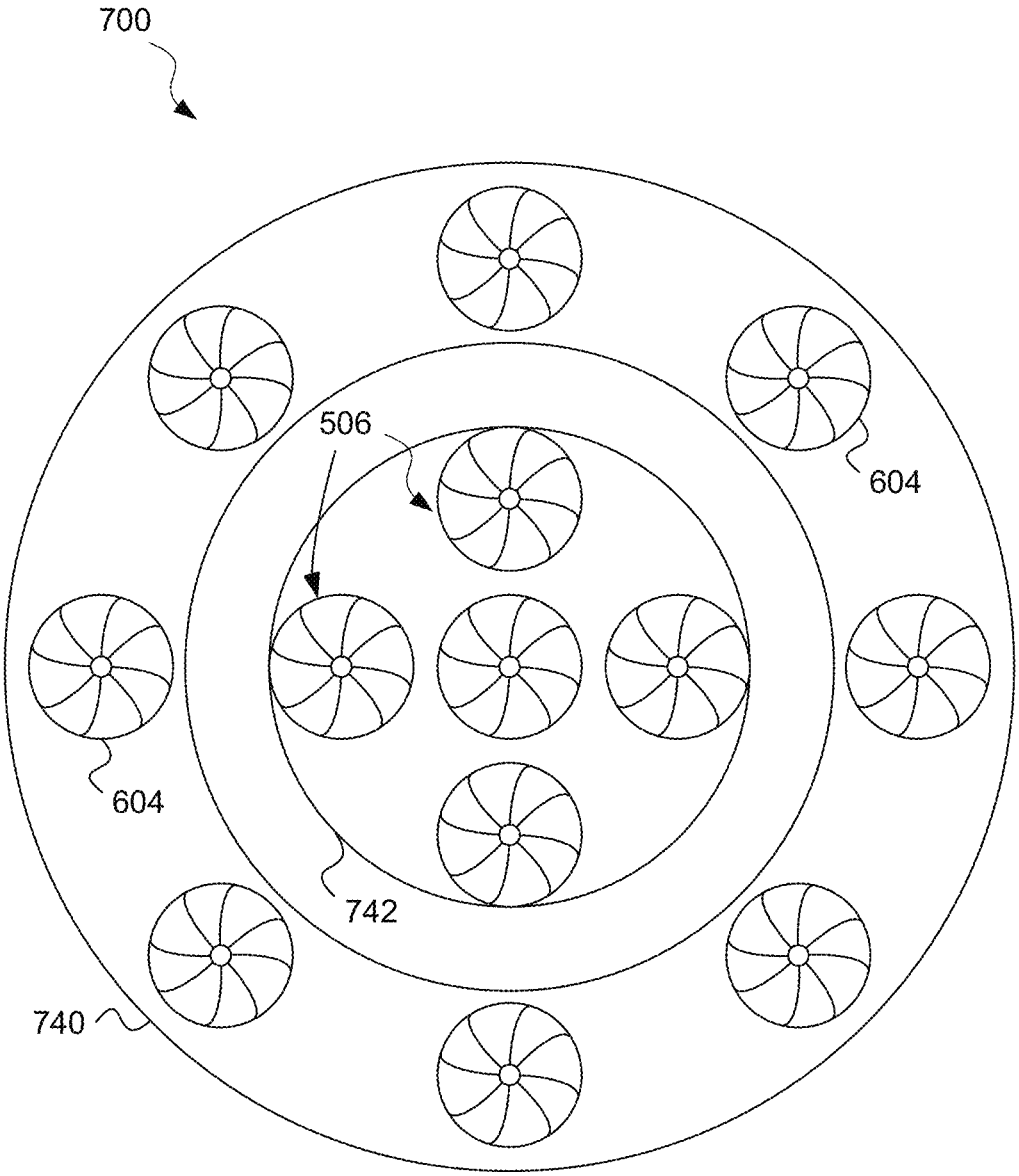

FIG. 7D is a top view of the primary fuel distributors 604 and the preheating fuel distributors 506 of the combustion system 700, according to an embodiment. The top view of FIG. 7D illustrates that the plurality of primary fuel distributors 604 are positioned peripherally to the plurality of preheating fuel distributors 506. In particular, the primary fuel distributors 604 laterally surround the preheating fuel distributor 506. The primary fuel distributors 604 can be positioned higher than the preheating fuel distributor 506, lower than the preheating fuel distributor 506, or substantially even with the preheating fuel distributor 506.

According to an embodiment, the primary fuel distributors 604 are coupled to a primary fuel manifold 740. The primary fuel manifold 740 provides the primary fuel 116 to the primary fuel distributors 604. The primary fuel manifold 740 can be an annular primary fuel manifold. The primary fuel manifold 740 may be part of the fuel line 527.

According to an embodiment, the preheating fuel distributors 506 are coupled to a preheating fuel manifold 742. The preheating fuel manifold 742 provides the preheating fuel 112 to the preheating fuel distributors 506. The preheating fuel manifold 742 may be part of the fuel line 529.

Figure 8A:
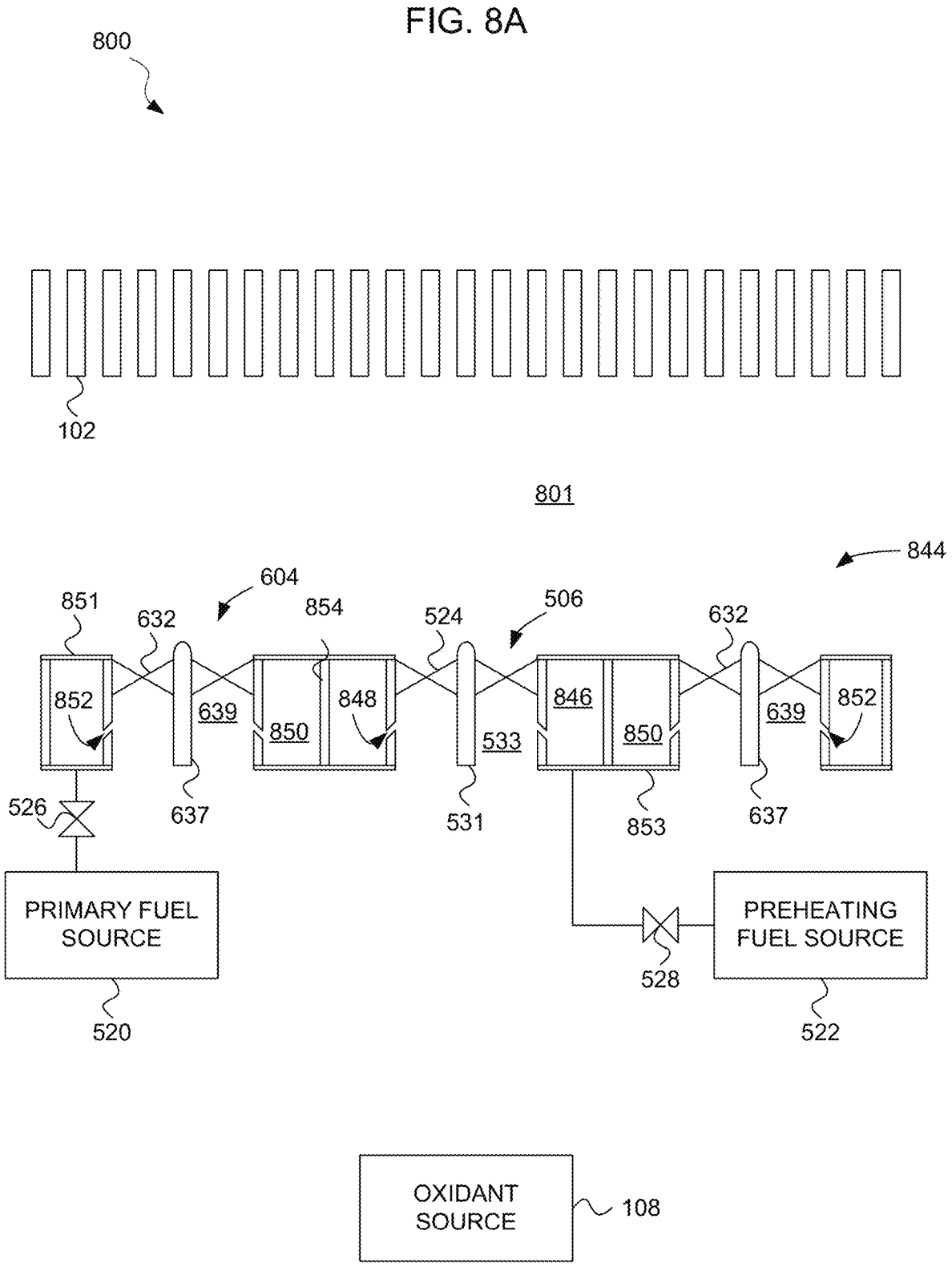
FIGS. 8A-8D are illustrations of a combustion system in various states of operation, according to an embodiment.

FIG. 8A is an illustration of a combustion system 800, according to an embodiment. The combustion system 800 includes a perforated flame holder 102 positioned in a furnace volume 801. The combustion system 800 includes a burner body 844 positioned in the furnace volume 801. The burner body 844 houses a preheating fuel distributor 506 and a plurality of primary fuel distributors 604. The combustion system 800 also includes a primary fuel source 520 and a preheating fuel source 522. The primary fuel source 520 is operatively connected to the primary fuel distributors 604 by a fuel line 527. A valve 526 connects the primary fuel source 520 to the fuel line 527. The preheating fuel source 522 is operatively connected to the preheating fuel distributors 506 by a fuel line 529. A valve 528 connects the preheating fuel source 522 to the fuel line 529. The combustion system 800 also includes an oxidant source 108.

According to an embodiment, the combustion system 800 can be substantially similar to the combustion systems 500, 600, 700, except that the primary fuel distributors 604 and the preheating fuel distributor 506 are housed in the single burner body 844.

According to an embodiment, the burner body 844 defines a preheating fuel manifold 846. The preheating fuel manifold 846 surrounds the preheating fuel distributor 506. The preheating fuel source 522 can supply the preheating fuel 112 into the preheating fuel manifold 846. The preheating fuel manifold 846 is separated from the interior conduit 533 of the preheating fuel distributor 506 by a wall. The preheating fuel manifold 846 can provide the preheating fuel 112 into the interior conduit 533 and the preheating fuel distributor 506 via one or more fuel channels 848 that communicatively couple the preheating fuel manifold 846 to the interior conduit 533 of the preheating fuel distributor 506. According to an embodiment, the fuel channels 848 are angled upward so that the preheating fuel 112 is input into the interior conduit 533 with an upward velocity such that the preheating fuel 112 travels upward to the swirler 524 instead of downward and out the bottom of the interior conduit 533. Though a single preheating fuel distributor 506 is shown in FIG. 8A, the burner body 844 can house multiple preheating fuel distributors 506.

According to an embodiment, the burner body 844 houses a primary fuel manifold 850. The primary fuel manifold 850 surrounds the primary fuel distributors 604. The primary fuel source 520 can supply the primary fuel 116 into the primary fuel manifold 850. The primary fuel manifold 850 is separated from the conduit 639 of the primary fuel distributors 604 by a wall. The primary fuel manifold 850 can provide the primary fuel 116 into the conduits 639 of the primary fuel distributors 604 of the one or more fuel channels 852 that communicatively couple the primary fuel manifold 850 to the conduits 639 of the primary fuel distributors 604. According to an embodiment, the fuel channels 852 are angled upward such that the primary fuel 116 enters the conduits 639 with an upward velocity. The upward velocity helps ensure that the primary fuel 116 will travel upward through the swirlers 632 and avoid passing through the bottom of the conduits 639.

According to an embodiment, the burner body 844 includes a top plate 851 that is an upper bound to the preheating fuel manifold 846 and the primary fuel manifold 850. The burner body 844 can also include a bottom plate 853 that is a lower bound to the preheating fuel manifold 846 and the primary fuel manifold 850.

According to an embodiment, the burner body 844 includes one or more ceramic materials. The ceramic materials of the burner body 844 can be selected from ceramic materials that will ensure the structural integrity of the burner body 844 and a very high temperature environment of the combustion system 800. According to an embodiment, the burner body 844 includes one or more of silicon carbide, zirconia, alumina, or other suitable ceramic materials as will be apparent to those of skill in the art in light of the present disclosure.

Figure 8B:
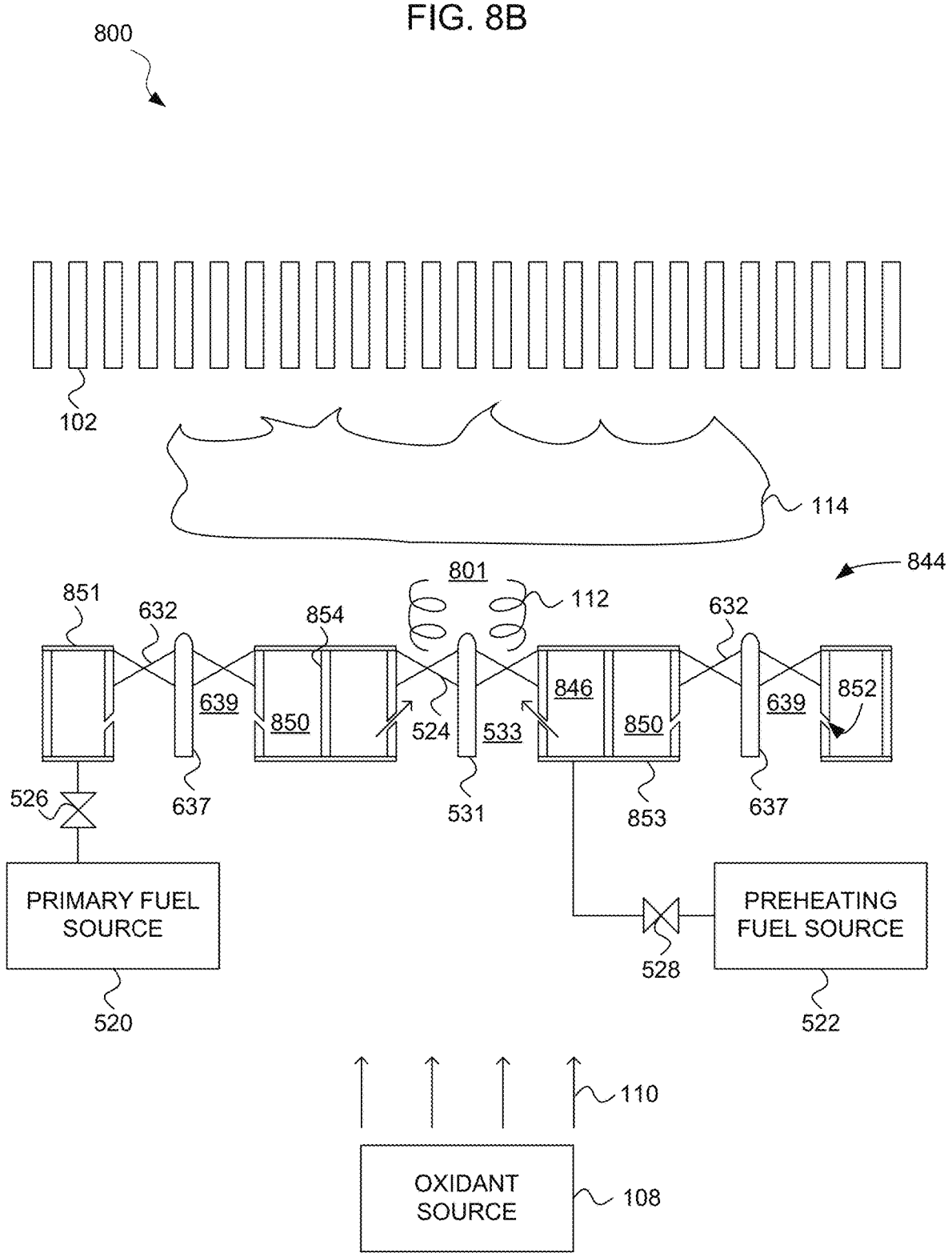

FIG. 8B is an illustration of the combustion system 800 in a preheating state, according to an embodiment. In the preheating state, the oxidant source 108 outputs the oxidant 110. In the preheating state the valve 528 is opened, such that the preheating fuel source 522 can supply the preheating fuel 112 to the preheating fuel manifold 846 via the fuel line 529. The preheating fuel 112 passes from the preheating fuel manifold 846 into the conduit 533 of the preheating fuel distributor 506 via the fuel channels 848. The preheating fuel 112 passes through the swirler 524 by which the preheating fuel distributor 506 outputs the preheating fuel 112 into the furnace volume 801 with a swirling motion.

In the preheating state, oxidant 110 from the oxidant source 108 enters into the conduit 533 and passes through the swirler 524. The swirler 524 imparts a swirling motion to the oxidant 110. The combustion system 800 ignites the preheating fuel 112 and the oxidant 110 via an igniter in order to start a swirl-stabilized preheating flame 114 supported by the preheating fuel distributor 506.

According to an embodiment, in the preheating state the combustion system 800 can operate in a substantially similar manner as the combustion system 500 or as the combustion system 600 as described in relation to FIG. 5B and FIG. 6B, except that the preheating fuel distributor 506 is housed in the burner body 844. The preheating fuel distributor 506 of the combustion system 800 can be substantially similar to the preheating fuel distributors 506 described in relation to any of FIGS. 5B-5E and FIG. 6B. Alternatively, the preheating fuel distributor 506 can operate to support a swirl-stabilized preheating flame 114 in another suitable manner. Those of skill in the art will recognize, in light of the present disclosure, that the preheating fuel distributor 506 can include swirl-inducing structures other than those described herein. All such other swirl-inducing structures fall within the scope of the present disclosure.

Figure 8C:
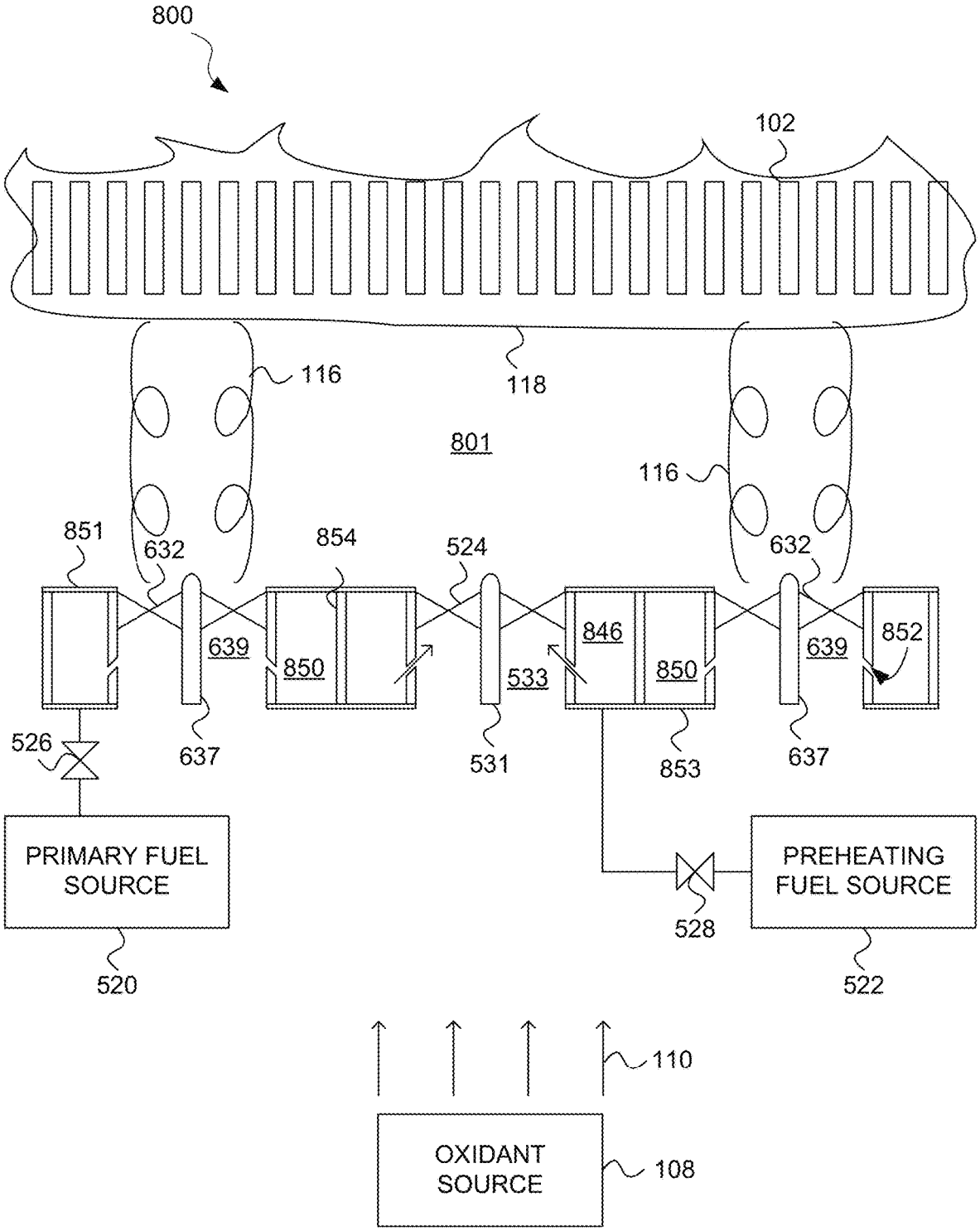

FIG. 8C is an illustration of the combustion system 800 of FIG. 8A in the standard operating state, according to an embodiment. In the standard operating state, the oxidant source 108 outputs the oxidant 110. In the standard operating state, the valve 526 is opened, such that the primary fuel source 520 can supply the primary fuel 116 to the primary fuel manifold 850 via the fuel line 527. The primary fuel 116 passes from the primary fuel manifold 850 into the conduits 639 of the primary fuel distributors 604 via the fuel channels 852. The preheating fuel 112 passes through the swirlers 632 by which the primary fuel distributors 604 output the primary fuel 116 into the furnace volume 801 with a swirling motion.

In the standard operating state, oxidant 110 enters into the conduits 639 of the primary fuel distributors 604 and passes through the swirlers 632. The swirlers 632 to impart a swirling motion to the oxidant 110.

In the standard operating state, the swirling motion of the oxidant 110 and the primary fuel 116 enhances the mixing of the oxidant 110 and the primary fuel 116. The perforated flame holder 102 receives the mixture of the primary fuel 116 and the oxidant 110 and sustains a combustion reaction 118 of the primary fuel 116 and the oxidant 110.

According to an embodiment, in the standard operating state the combustion system 800 can operate in a substantially similar manner as the combustion system 500, as the combustion system 600, or as the combustion system 700 as described in relation to FIG. 5B, FIG. 6B, and FIG. 7B, except that the primary fuel distributors 604 are housed in the burner body 844.

According to an embodiment, the primary fuel distributors 604 impart a swirling motion to only one of the primary fuel 116 and the oxidant 110. The primary fuel distributors 604 can impart a swirling motion to the primary fuel 116 and/or the oxidant 110 in a manner similar to the preheating fuel distributor 506 as described in relation to FIGS. 5B-5E. Alternatively, this can be accomplished in a manner other than those described herein as will be apparent to those of skill in the art in light of the present disclosure.

According to an embodiment, the primary fuel distributors 604 do not impart a swirling motion to either of the oxidant 110 and the primary fuel 116. Therefore, the primary fuel distributors 604 can include structure other than not shown FIGS. 8A-8C. According to an embodiment, the primary fuel distributors 604 are similar to the primary fuel distributors 504 shown in relation to FIG. 5A, except that they are housed in the burner body 844. Those of skill in the art will recognize, in light of the present disclosure, that a burner body 844 in accordance with principles of the present disclosure can house primary fuel distributors 604 and preheating fuel distributors 506 with many other structures and compositions than are shown in relation to FIGS. 8A-8C.

Figure 8D:
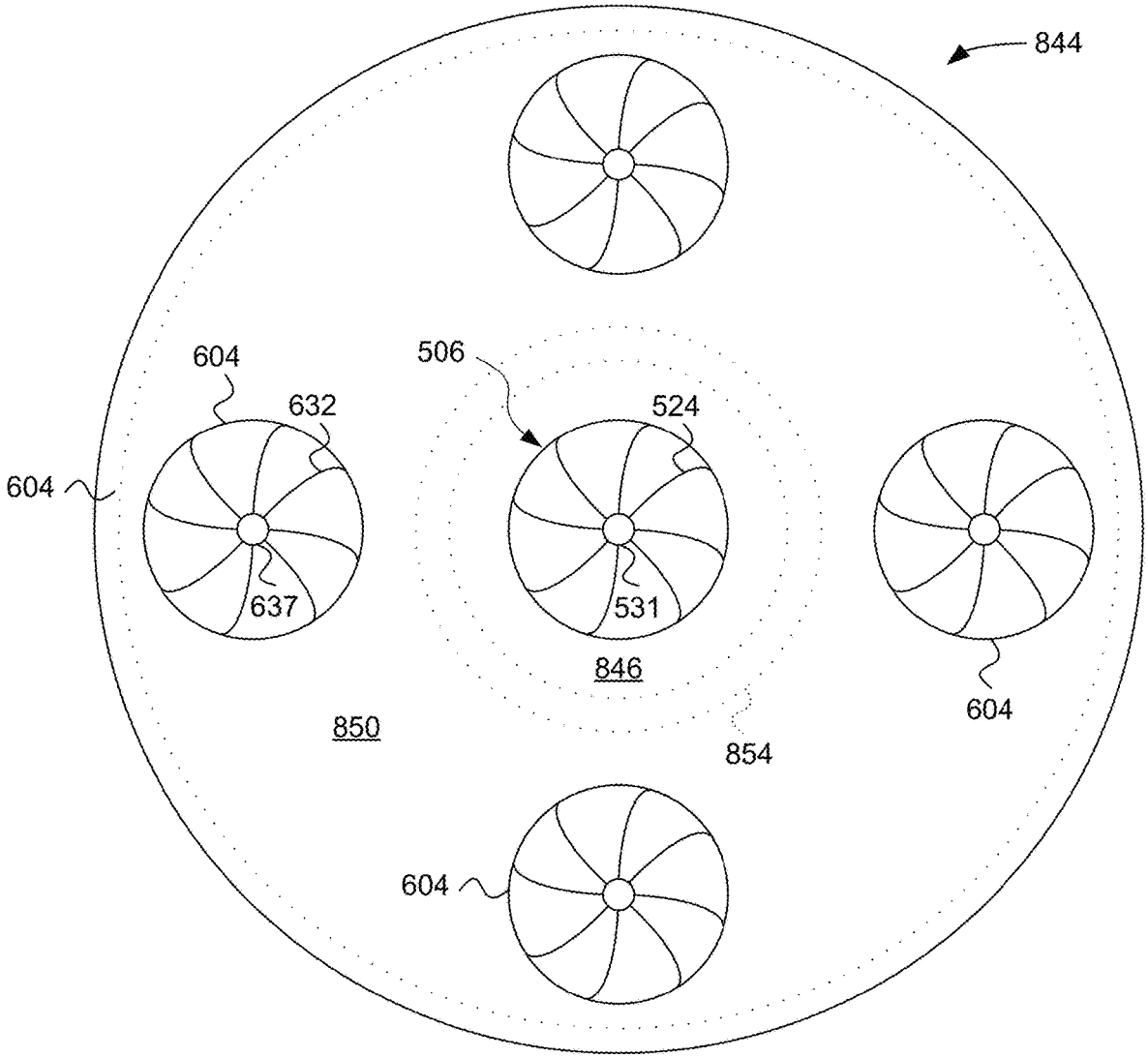

FIG. 8D is a top view of burner body 844 including the primary fuel distributors 604 and the preheating fuel distributor 506, according to an embodiment. The top view of FIG. 8D illustrates that the plurality of primary fuel distributors 604 are positioned peripherally to the preheating fuel distributor 506. A top surface of burner body 844 covers the preheating fuel manifold 846 and the primary fuel manifold 850. A wall 854 separating the primary fuel manifold 850 and the preheating fuel manifold 846 is shown as dashed lines. The wall 854 is positioned between the top plate 851 and the bottom plate 853 of the burner body 844. An outer wall 858 of the burner body 844 and the primary fuel manifold 850 is also shown in dashed lines.

Figure 9:
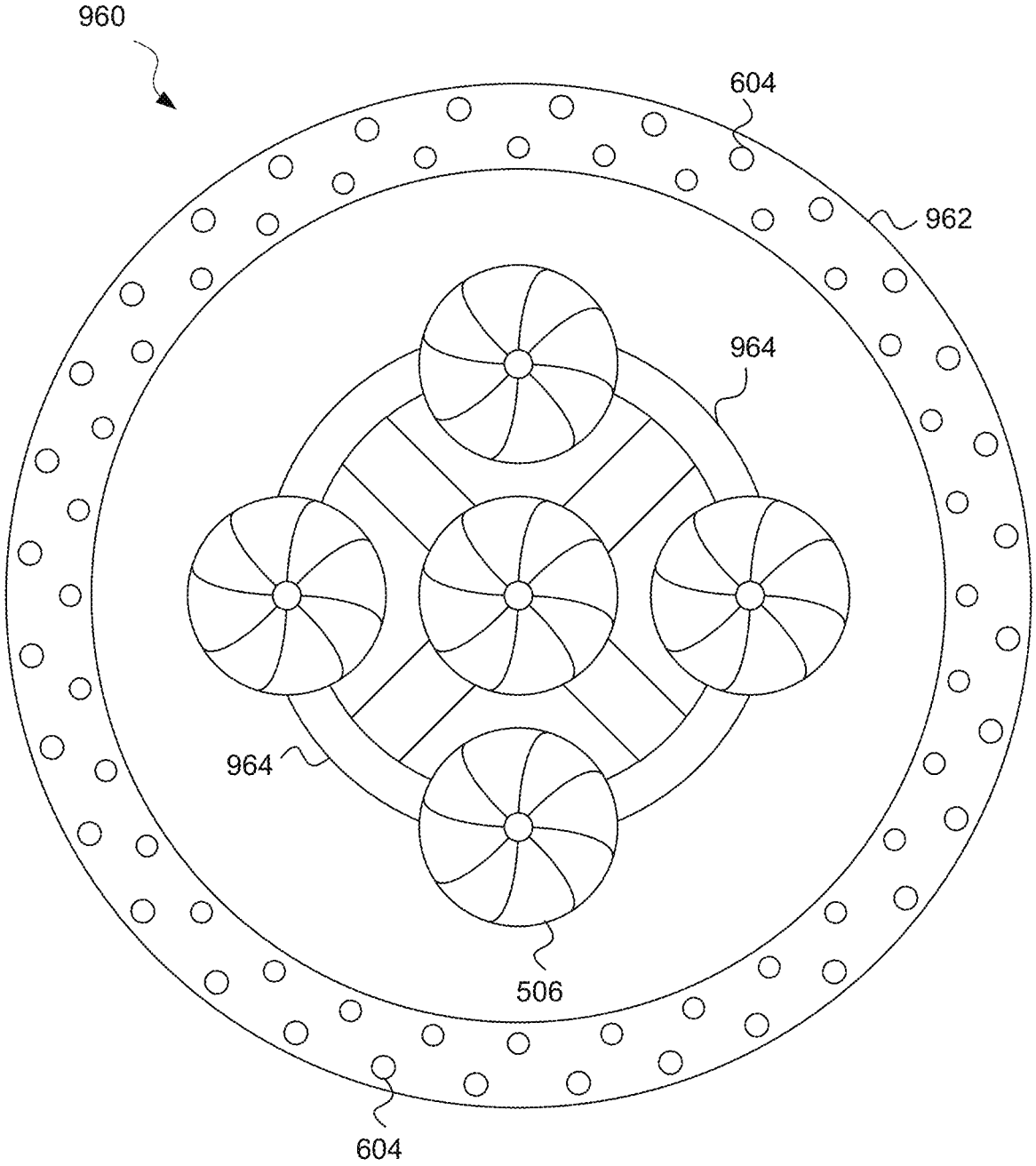
FIG. 9 is a top view of a burner, according to an embodiment.

FIG. 9 is a top view of a burner 960, according to an embodiment. The burner 960 includes a plurality of preheating fuel distributors 506 and a plurality of primary fuel distributors 604. A preheating fuel manifold 964 couples the preheating fuel distributors 506 together and distributes the preheating fuel 112 to the preheating fuel distributors 506. The primary fuel manifold 962 supplies the primary fuel 116 to the primary fuel distributors 604. The primary fuel distributors 604 can correspond to orifices in the primary fuel manifold 962 through which the primary fuel 116 can be expelled. The burner 960 can be positioned in a furnace volume 101 with a perforated flame holder 102 and can operate in a preheating state and a standard operating state as described previously.

Figure 10A:
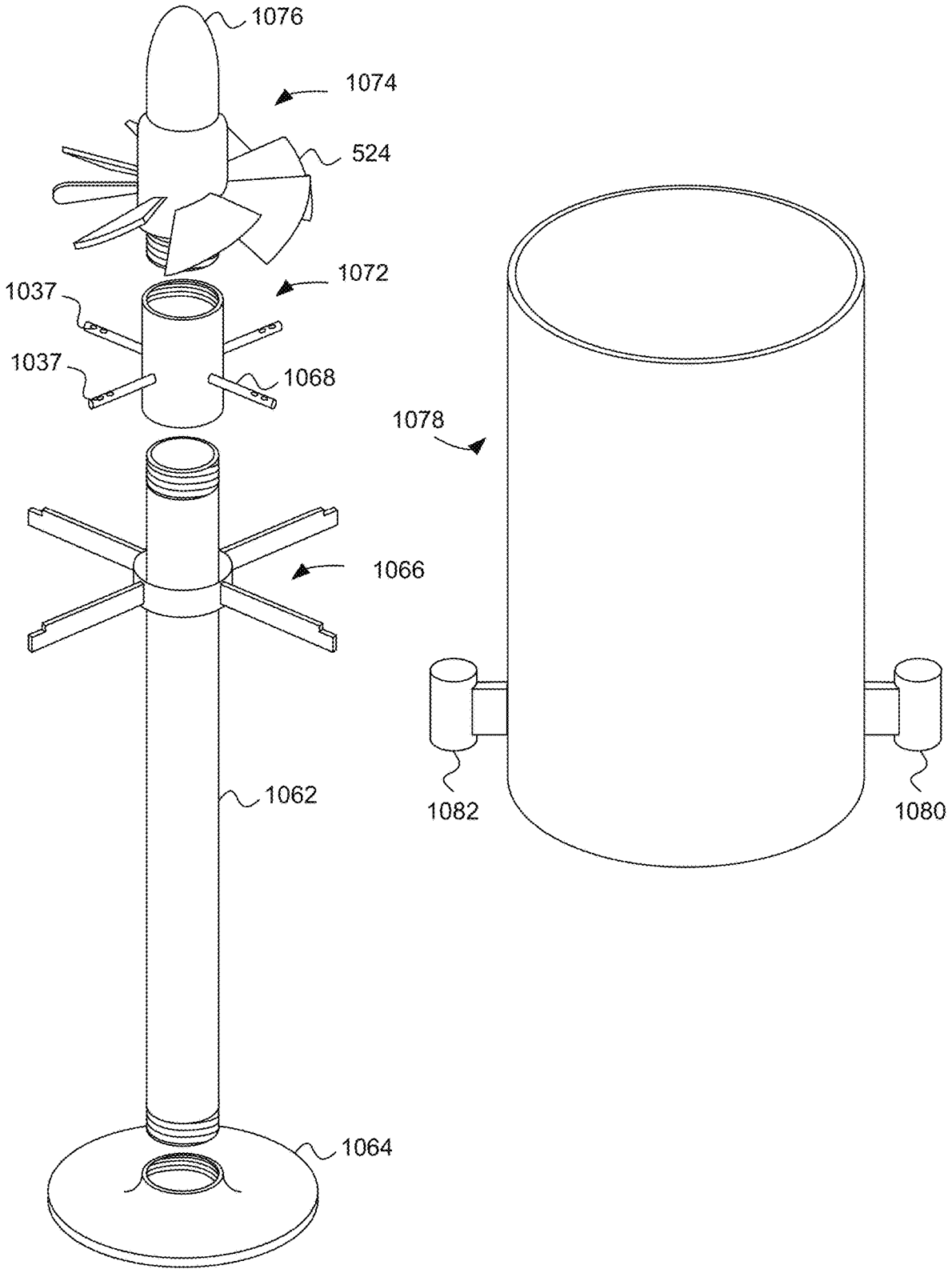
FIG. 10A is a perspective view of various components of a preheating fuel distributor in an unassembled state, according to an embodiment.

FIG. 10A is a perspective view of the various components of a preheating fuel distributor 1006 in a disassembled state, according to an embodiment. The preheating fuel distributor 1006 includes a fuel riser 1062 configured to be coupled to a bottom plate 1064. A support spider 1066 is fastened to the fuel riser 1062. A fuel distribution joint 1072 is configured to be coupled to the fuel riser 1062. The fuel distribution joint 1072 includes fuel distribution arms 1068. Each fuel distribution arm 1068 includes one or more orifices 1037. A swirler support 1074 is configured to be coupled to the fuel distribution joint 1072. A swirler 524 is coupled to the swirler support 1074. An aerodynamic end cap 1076 is coupled to the swirler support 1074. A cylindrical casing 1078 is configured to be positioned on and supported by the support spider 1066. An igniter support 1080 and a flame rod support 1082 are coupled to the cylindrical casing 1078.

According to an embodiment, the bottom end of the fuel riser 1062 is threaded. The bottom plate 1064 includes a threaded joint configured to mate with the threaded bottom end of the fuel riser 1062. Thus, the fuel riser 1062 can be coupled to the bottom plate 1064 by screwing the bottom end of the fuel riser 1062 into the bottom plate 1064.

According to an embodiment, an upper end of the fuel riser 1062 is threaded. A lower end of the fuel distribution joint 1072 is threaded. The fuel distribution joint 1072 can be coupled to the upper end of the fuel riser 1062 by screwing the lower end of the fuel distribution joint 1072 onto the upper end of the fuel riser 1062.

According to an embodiment, the fuel distribution joint 1072 includes a threaded upper end. The swirler support 1074 includes a lower threaded end configured to be screwed onto the threaded upper end of the fuel distribution joint 1072. Thus, the swirler support 1074 can be coupled to the fuel distribution joint 1072 by screwing the threaded lower end of the swirler support 1074 to the threaded upper end of the fuel distribution joint 1072.

According to an embodiment, the support spider 1066 can be fastened to the fuel riser 1062. The support spider 1066 can be selectively fastened to any portion of the fuel riser 1062. The support spider 1066 can be loosened and moved up and down along the fuel riser 1062 to a selected location. The support spider 1066 can be fastened to the fuel riser 1062 at the selected location.

According to an embodiment, a lower end of the cylindrical casing 1078 can be positioned on indented ends of the arms of the support spider 1066. Thus, the indented ends of the arms of the support spider 1066 can support the cylindrical casing 1078 in a selected position. According to an embodiment, the cylindrical casing 1078 will enclose an upper portion of the fuel riser 1062 and the fuel distribution joint 1072.

Figure 10B:
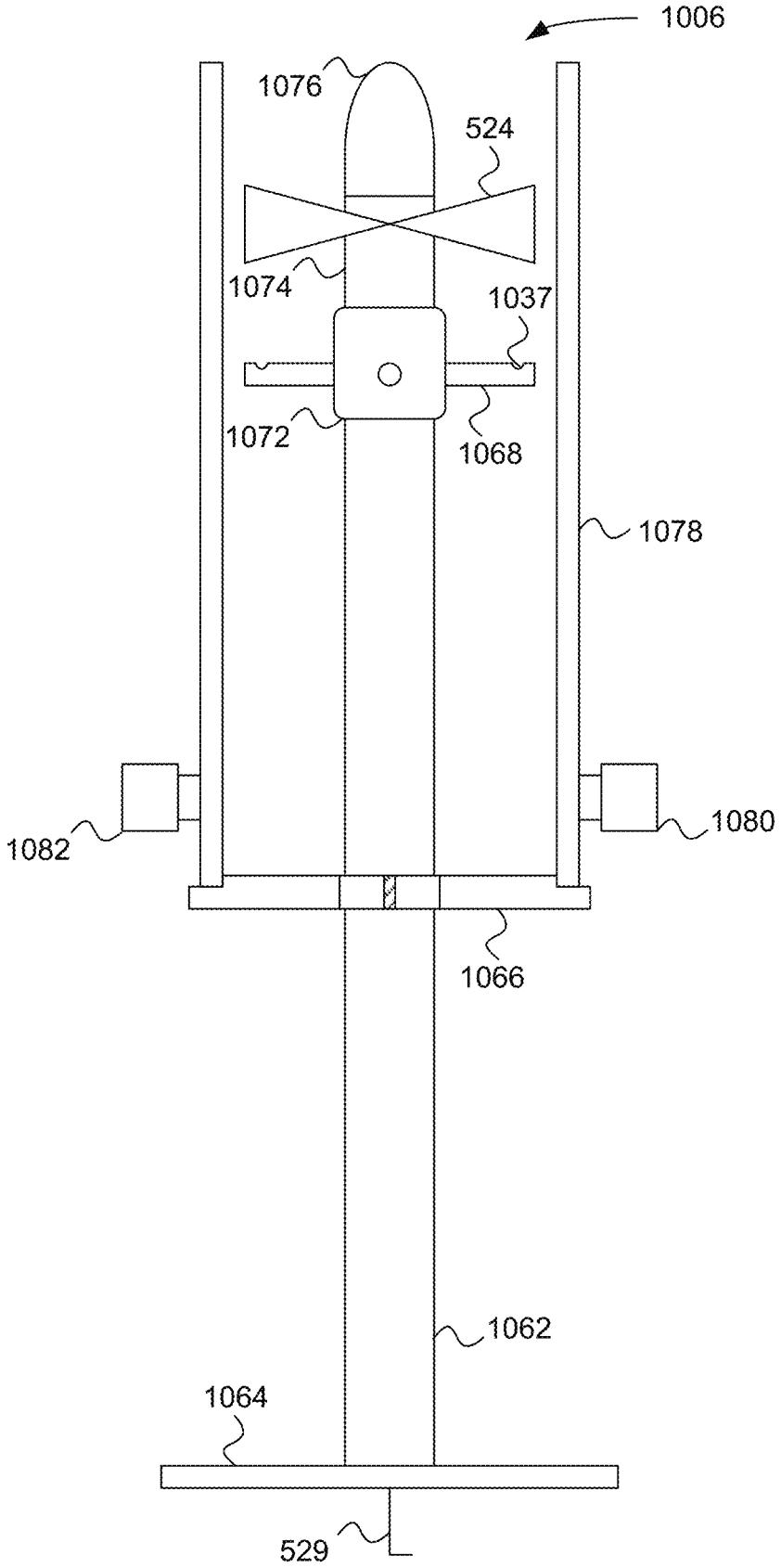
FIG. 10B is a cross-sectional view of the preheating fuel distributor of FIG. 10A in an assembled state, according to an embodiment.

FIG. 10B is a diagram of the preheating fuel distributor 1006 in an assembled state, according to an embodiment. The fuel riser 1062 is coupled to the bottom plate 1064. The support spider 1066 is fastened to the fuel riser 1062. The fuel distribution joint 1072 is coupled to the fuel riser 1062. The swirler support 1074 is coupled to the fuel distribution joint 1072. The cylindrical casing 1078 is positioned on and supported by the support spider 1066. The cylindrical casing 1078 surrounds a portion of the fuel riser 1062, the fuel distribution joint 1072, and the swirler 524.

According to an embodiment, the preheating fuel distributor 1006 is configured to support a swirl-stabilized preheating flame 114 in order to preheat a perforated flame holder 102. In particular, the preheating fuel distributor 1006 is configured to output a preheating fuel 112 into a furnace volume 101. The preheating fuel distributor 1006 is configured to impart a swirling motion to the preheating fuel 112. The preheating fuel distributor 1006 is also configured to impart a swirling motion to an oxidant 110 that passes through the cylindrical casing 1078 of the preheating fuel distributor 1006. Thus, the preheating fuel distributor 1006 is configured to impart a swirling motion to both the preheating fuel 112 and an oxidant 110.

According to an embodiment, a fuel line 529 supplies a preheating fuel 112 into an interior channel of the preheating fuel riser 1062. The preheating fuel 112 flows through the fuel riser 1062 to the fuel distribution joint 1072. The fuel distribution arms 1068 of the fuel distribution joint 1072 each include interior fuel channels communicably coupled to the interior of the fuel riser 1062. The top portion of the fuel distribution joint 1072 is closed off so that the preheating fuel 112 does not flow into the swirler support 1074. The preheating fuel 112 passes into the fuel distribution arms 1068 and is emitted from the fuel distribution arms 1068 through the orifices 1037 upward towards the swirler 524. After the preheating fuel is output from orifices 1037, the preheating fuel 112 passes through the swirler 524, by which the swirler 524 imparts a swirling motion to the preheating fuel 112. The swirling preheating fuel 112 exits the upper end of the cylindrical casing 1078.

According to an embodiment, the oxidant 110 is drafted into the cylindrical casing 1078 through gaps in the support spider 1066. The oxidant 110 flows upward through the cylindrical casing 1078 toward the swirler 524. The oxidant 110 passes through the swirler 524, by which the swirler 524 imparts a swirling motion to the oxidant 110. The swirling oxidant 110 exits the upper end of the cylindrical casing 1078 and mixes with the preheating fuel 112. The swirling mixture of the preheating fuel 112 and the oxidant 110 support a swirl-stabilized preheating flame 114.

According to an embodiment, an igniter, not shown, can be coupled to the igniter support 1080. The igniter can extend from the igniter support to a position at which the igniter can ignite the swirl-stabilized preheating flame 114 via a spark or a pilot flame.

According to an embodiment, a flame rod, not shown, can be coupled to the flame rod support 1082. The flame rod can extend upward to a position at which the flame rod can monitor the swirl-stabilized preheating flame 114 and/or the combustion reaction 118.

Figure 11A:
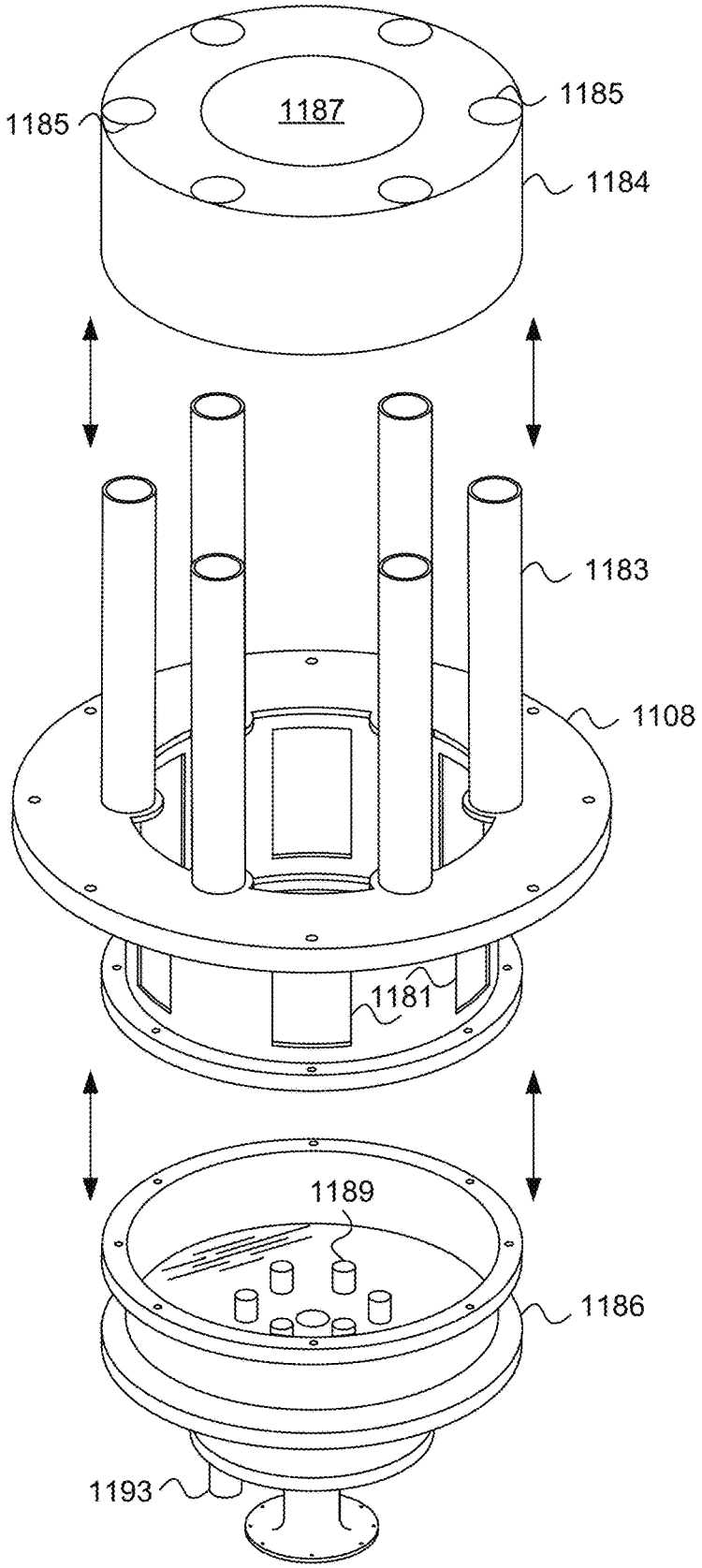
FIG. 11A is a perspective view of a barrel register and a throat insert in an unassembled state, according to an embodiment.

FIG. 11A is a perspective view of a barrel register 1108, a throat insert 1184, and a barrel register bottom 1186 in an unassembled state, according to an embodiment.

According to an embodiment, the barrel register 1108 includes apertures 1181 configured to draft oxidant 110 from an exterior of the barrel register 1108 into an interior of the barrel register 1108. The barrel register 1108 also includes support arm receivers 1183 configured to receive and hold support arms of the support structure. The support structure can be configured to support the perforated flame holder 102 in a furnace volume 101. The barrel register 1108 can include on an upper plate or flange of the barrel register 1108, screw holes by which the barrel register 1108 can be screwed or bolted to a floor or wall of a furnace.

According to an embodiment, the throat insert 1184 is configured to be positioned in an aperture in a floor or wall of a furnace. The throat insert 1184 includes apertures 1185. The apertures 1185 are configured to slide over the support arm receivers 1183 of the barrel register 1108 and rest on the upper portion of the barrel register 1108. When the throat insert 1184 is positioned on the barrel register 1108, the oxidant 110 that passes through the apertures 1181 of the barrel register 1108 continues on through a central aperture 1187 of the throat insert 1184 and into the furnace volume 101.

According to an embodiment, the barrel register bottom 1186 includes fuel riser joints 1189 by which fuel risers 1062 can be coupled to the barrel register bottom 1186. The fuel risers 1062 can extend upward through the barrel register 1108 and through the central aperture 1187 of the throat insert 1184 into the furnace volume 101. The barrel register bottom 1186 also includes an interior primary fuel manifold, not visible in the view of FIG. 11A. The interior primary fuel manifold can receive the primary fuel 116 through the inlet 1193. The fuel riser joints 1189 are configured to enable the primary fuel 116 to pass from the primary fuel manifold into the primary fuel risers 1062 that can be coupled to the fuel riser joints 1189. The barrel register bottom 1186 also includes a bottom plate. The bottom plate is configured to be fastened to the bottom plate 1064 of the preheating fuel distributor 1006. In particular, when the bottom plate 1064 and the preheating fuel distributor 1006 are fastened to the bottom plate of the barrel register bottom 1186, the preheating fuel riser 1062 passes through the central aperture 1187 between the primary fuel riser joints 1189 and upward through the barrel register 1108 and the throat insert 1184. The barrel register bottom 1186 includes screw holes or bolt holes on an upper plate by which the barrel register bottom 1186 can be fastened to a bottom plate of the barrel register 1108 via corresponding screw holes or bolt holes in the bottom plate of the barrel register 1108.

Figure 11B:
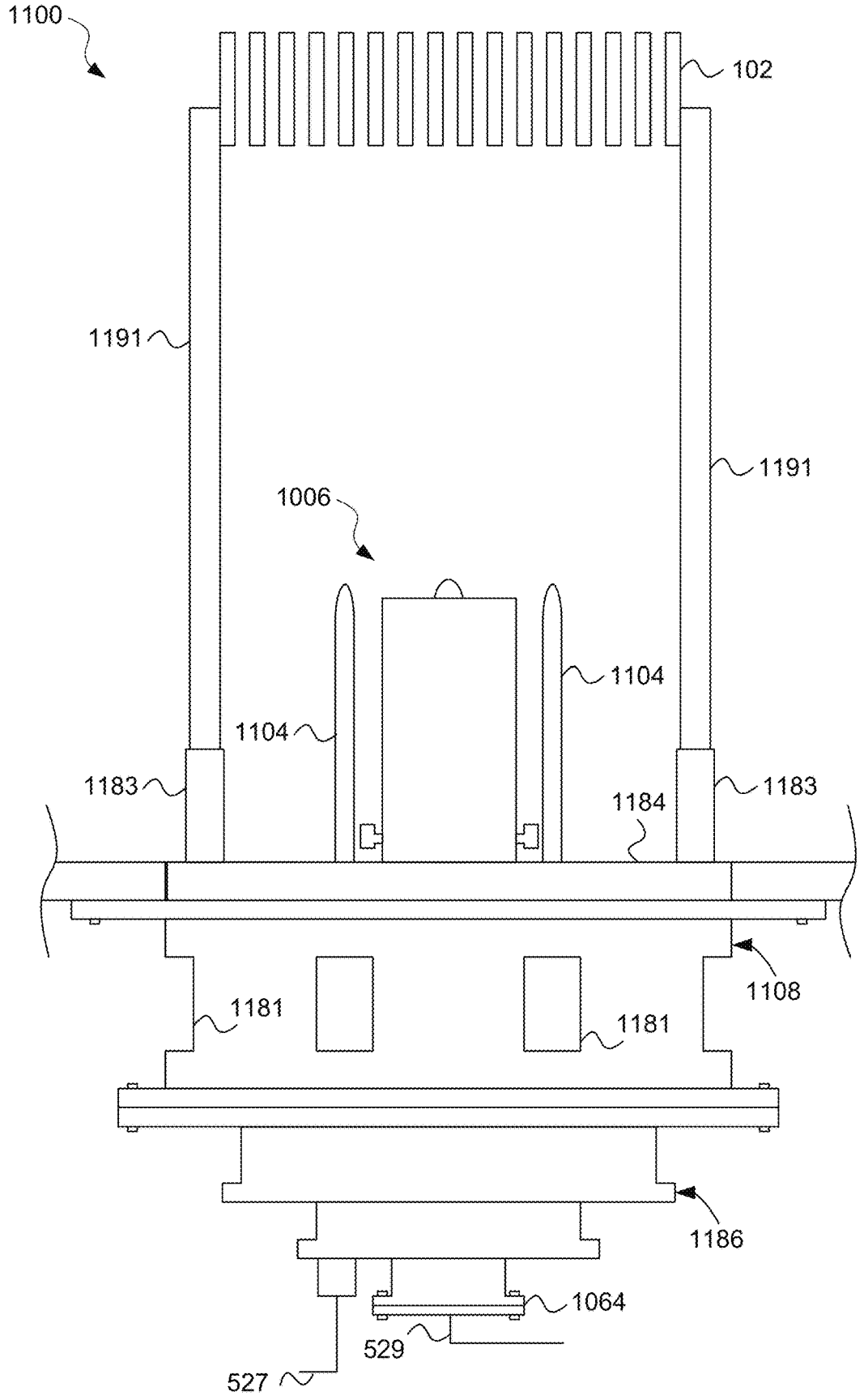
FIG. 11B is a side view of a combustion system including the barrel register and the throat insert of FIG. 11A, according to an embodiment.

FIG. 11B is a side view of a combustion system 1100 including the barrel register 1108, the throat insert 1184, and the barrel register bottom 1186, according to an embodiment. The barrel register 1108 is fastened to a bottom surface of the floor of a furnace. The throat insert 1184 is positioned on the barrel register 1108 and effectively diminishes the area of an aperture in the floor of the furnace such that the effective area of the aperture in the floor of the furnace is the area of the central aperture 1187 of the throat insert 1184. The support arm receivers 1183 pass through the apertures 1185. The preheating fuel distributor 1006 protrudes through the central aperture 1187 in the throat insert 1184. Primary fuel risers 1104 also protrude through the central aperture 1187. The barrel register bottom 1186 is fastened to the barrel register 1108. According to an embodiment, the perforated flame holder 102 is positioned in the furnace volume 101. The perforated flame holder 102 is supported, at least in part, by support legs 1191. The lower ends of the support legs 1191 are positioned within the support arm receivers 1183 of the barrel register 1108.

Figure 11C:
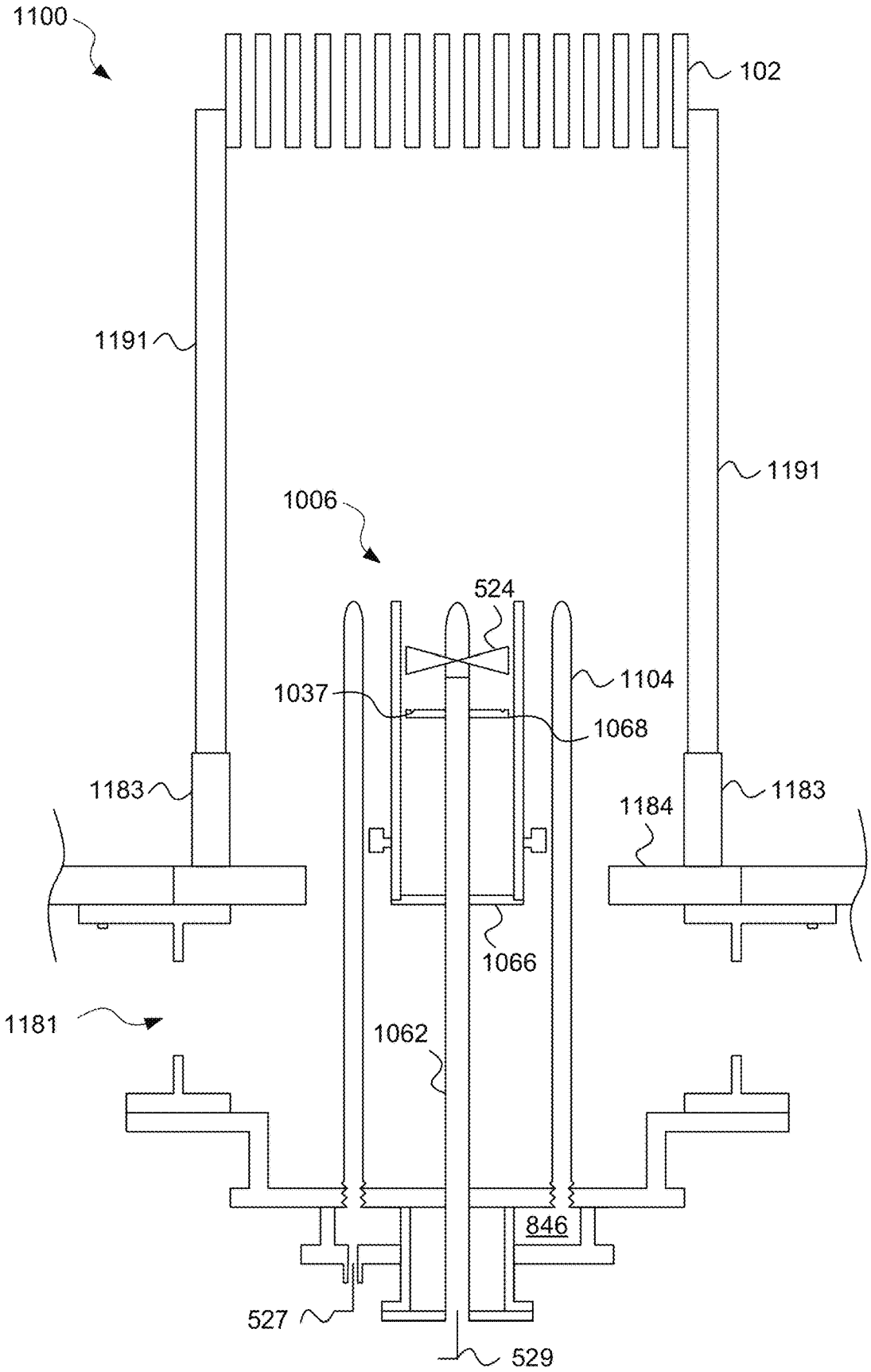
FIG. 11C is a cross-sectional view of the combustion system of FIG. 11B, according to an embodiment.

FIG. 11C is a cross-sectional diagram of the combustion system 1100, according to an embodiment. The cross-sectional view shows the primary fuel manifold 850 positioned within the barrel register bottom 1186. A primary fuel line 527 provides the primary fuel 116 to the primary fuel manifold 850. The primary fuel manifold 850 is communicably coupled to the primary fuel risers 1104 such that the primary fuel 116 can be provided to the primary fuel risers 1104 from the primary fuel manifold 850.

According to an embodiment, a preheating fuel line 529 supplies the preheating fuel 112 to the preheating fuel riser 1062 via an aperture in the bottom support plate 1064 of the preheating fuel distributor 1006. The bottom support plate 1064 is coupled to the bottom plate of the barrel register bottom 1186.

According to an embodiment, the oxidant 110 flows into the barrel register 1108 via the apertures 1181. A portion of the oxidant 110 passes into the cylindrical casing 1078 of the preheating fuel distributor 1006 via the lower end of the cylindrical casing 1078, passes through the swirler 524, and is output from the upper opening of the cylindrical casing 1078 with a swirling motion. A portion of the oxidant 110 passes through the central aperture 1187 of the throat insert 1184 and into the furnace volume 101.

Figure 11D:
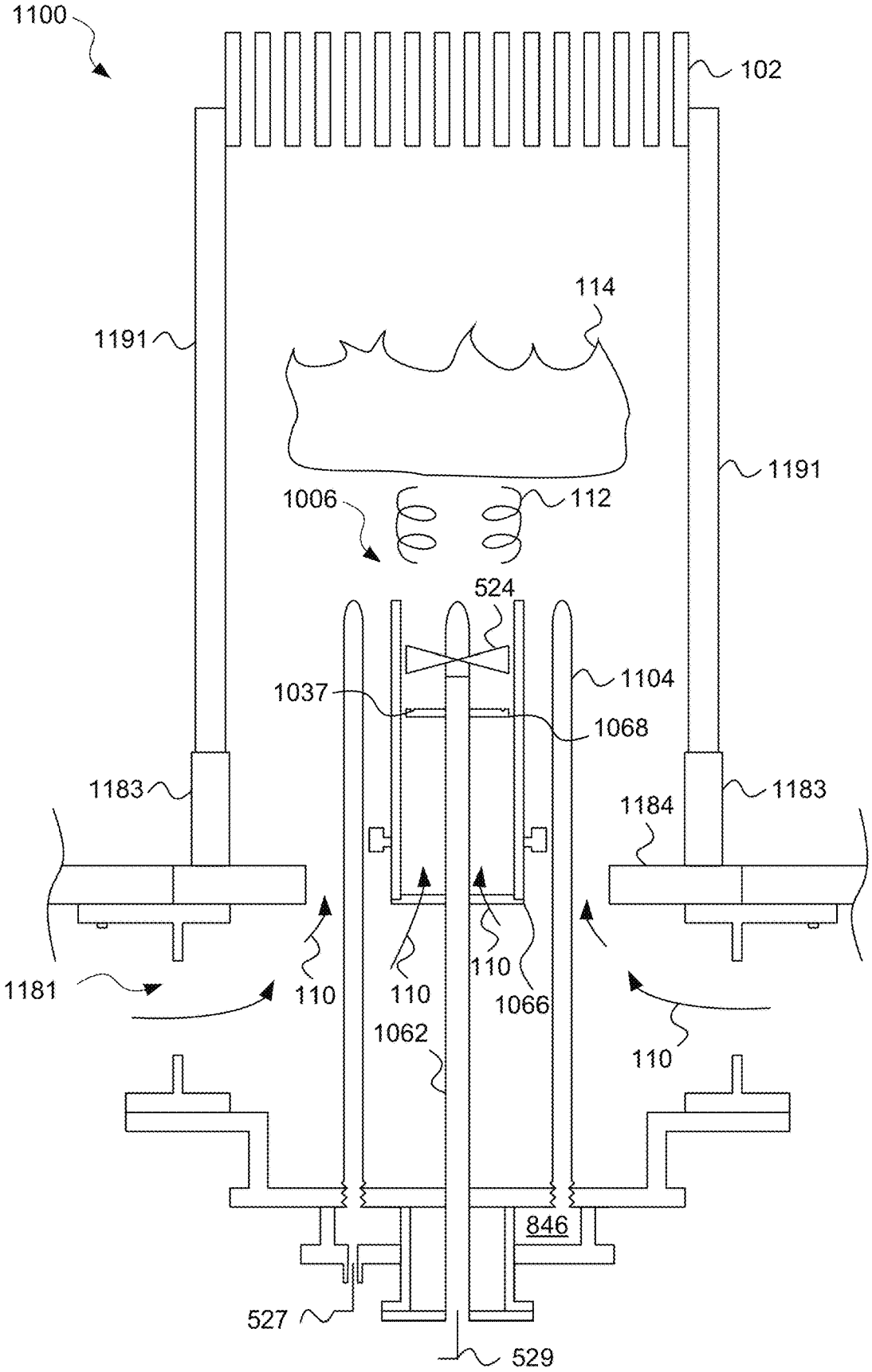
FIG. 11D is a cross-sectional view of the combustion system of FIG. 11B in a preheating state, according to an embodiment.

FIG. 11D is a cross-sectional diagram of the combustion system 1100 in a preheating state, according to an embodiment. In the preheating state, the fuel line 529 supplies a preheating fuel 112 into the preheating fuel riser 1062. The preheating fuel 112 passes upward through the interior of the preheating fuel riser 1062 until the preheating fuel 112 arrives at the fuel distribution joint 1072. The preheating fuel 112 passes from the preheating fuel riser 1062 and into the interior channel of the fuel distribution arms 1068 of the fuel distribution joint 1072. The preheating fuel 112 is output from the orifices 1037 in the fuel distribution arms 1068 upward toward the swirler 524. The preheating fuel 112 passes through the swirler 524. The swirler 524 imparts a swirling motion to the preheating fuel 112. The preheating fuel 112 passes from the cylindrical casing 1078 toward the perforated flame holder 102.

According to an embodiment, in the preheating state the oxidant 110 enters into the barrel register 1108 via the apertures 1181. A portion of the oxidant 110 passes into the cylindrical casing 1078 at the lower end. The oxidant 110 passes upward through the cylindrical casing 1078 toward the swirler 524. The oxidant 110 passes through the swirler 524. The swirler 524 imparts a swirling motion to the oxidant 110.

According to an embodiment, the swirling preheating fuel 112 and the swirling oxidant 110 mix together over a short distance as they travel toward the perforated flame holder 102. An igniter, extending from the igniter support 1080, ignites the mixture of the preheating fuel 112 and the oxidant 110, thereby initializing the swirl-stabilized preheating flame 114. The swirl-stabilized preheating flame 114 heats the perforated flame holder 102 to a threshold temperature. After the perforated flame holder 102 has been heated to the threshold temperature, the combustion system 1100 exits the preheating state and enters the standard operating state.

Figure 11E:
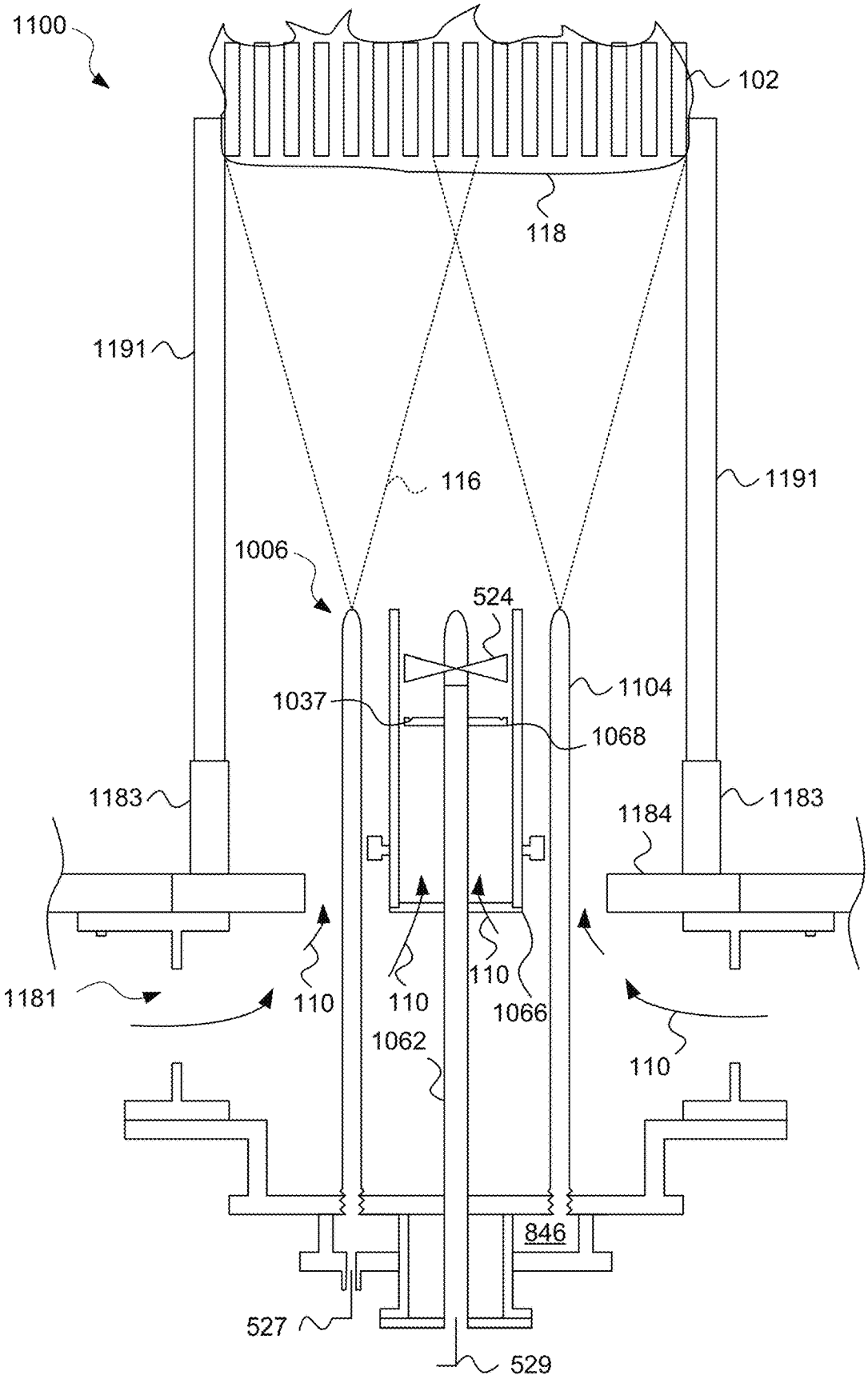
FIG. 11E is a cross-sectional view of the combustion system of FIG. 11B in a standard operating state, according to an embodiment.

FIG. 11E is a diagram of the combustion system 1100 of FIG. 11C in the standard operating state, according to an embodiment. In the standard operating state, the fuel line 529 no longer provides the preheating fuel 112 to the preheating fuel riser 1062. The swirl-stabilized preheating flame 114 is extinguished.

According to an embodiment, in the standard operating state the fuel line 527 supplies the primary fuel 116 to the primary fuel manifold 850. The primary fuel 116 passes from the primary fuel manifold 850 into the primary fuel risers 1104. The primary fuel 116 passes upward through the interior of the primary fuel risers 1104 toward an upper end of the primary fuel risers 1104. Primary fuel 116 is output from one or more apertures of an upper end of the primary fuel risers 1104. The primary fuel risers 1104 can each include a fuel nozzle coupled to an upper end of the primary fuel riser 1104. Each fuel nozzle can include one or more orifices that output the primary fuel 116 toward the perforated flame holder 102.

According to an embodiment, in the standard operating state the oxidant 110 enters into the barrel register 1108 via the apertures 1181. A portion of the oxidant 110 flows through the central aperture 1187 of the throat insert 1184.

According to an embodiment, the primary fuel 116 mixes with the oxidant 110 as the primary fuel 116 travels toward the perforated flame holder 102. The perforated flame holder 102 supports the combustion reaction 118 of the primary fuel 116 and the oxidant 110.

Figure 12A:
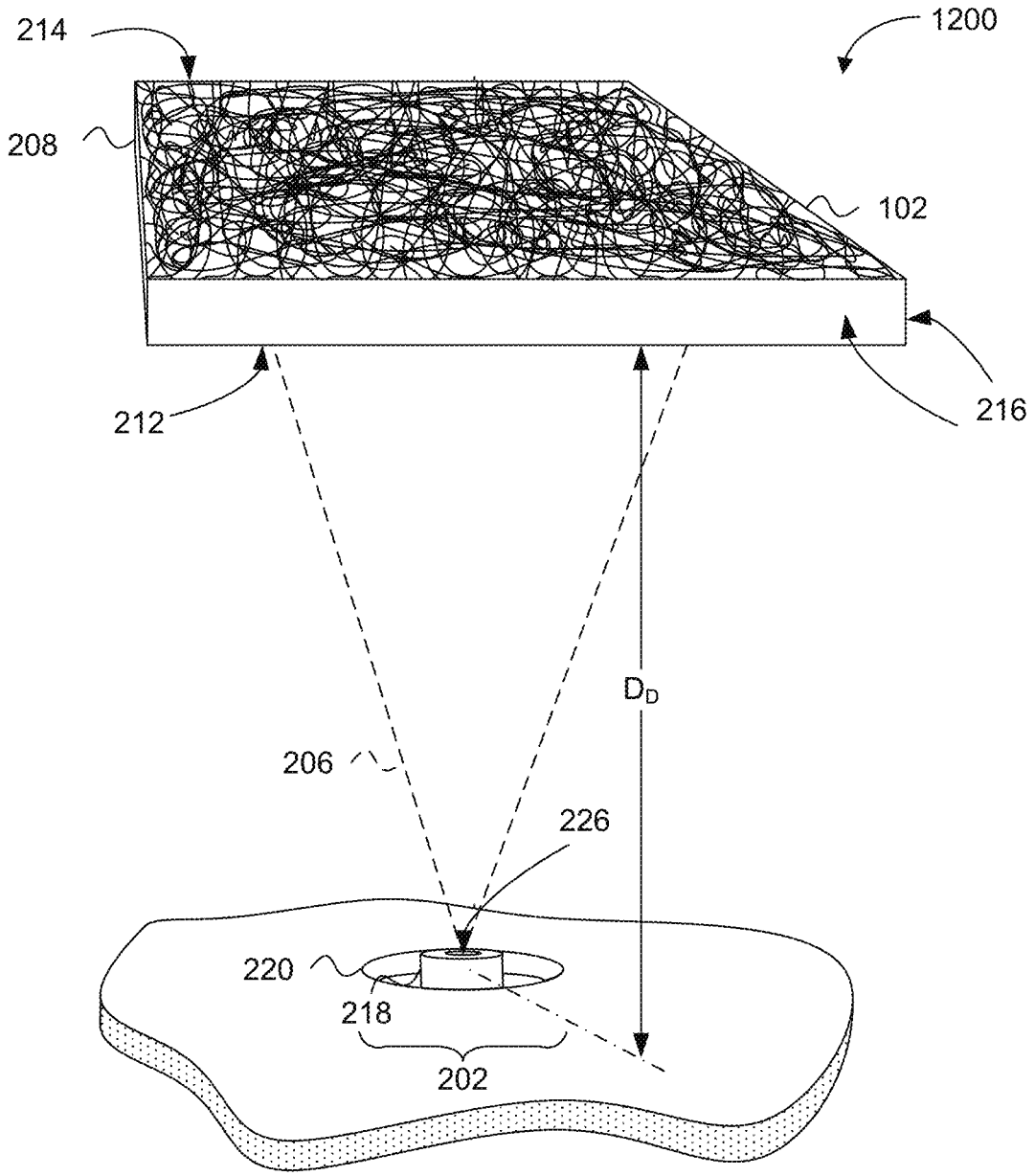
FIG. 12A is a simplified diagram of a burner system, including a perforated flame holder configured to hold a combustion reaction, according to an embodiment.
Figure 12B:
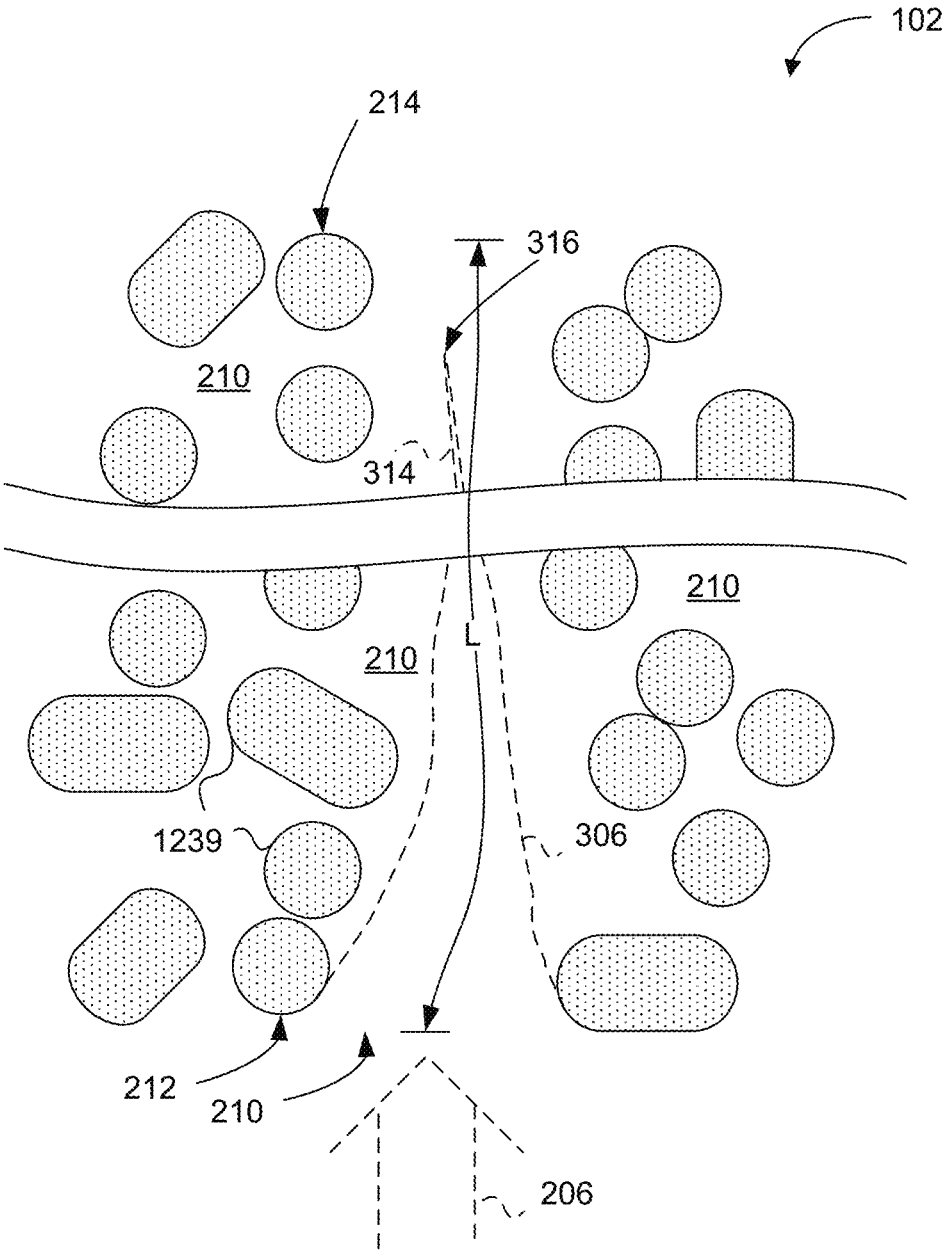
FIG. 12B is a side sectional diagram of a portion of the perforated flame holder of FIG. 12A, according to an embodiment.

FIG. 12A is a simplified perspective view of a combustion system 1200, including another alternative perforated flame holder 102, according to an embodiment. The perforated flame holder 102 is a reticulated ceramic perforated flame holder, according to an embodiment. FIG. 12B is a simplified side sectional diagram of a portion of the reticulated ceramic perforated flame holder 102 of FIG. 12A, according to an embodiment. The perforated flame holder 102 of FIGS. 12A, 12B can be implemented in the various combustion systems described herein, according to an embodiment. The perforated flame holder 102 is configured to support a combustion reaction of the fuel and oxidant 206 at least partially within the perforated flame holder 102 between an input face 212 and an output face 214. According to an embodiment, the perforated flame holder 102 can be configured to support a combustion reaction of the fuel and oxidant 206 upstream, downstream, within, and adjacent to the reticulated ceramic perforated flame holder 102.

According to an embodiment, the perforated flame holder body 208 can include reticulated fibers 1239. The reticulated fibers 1239 can define branching perforations 210 that weave around and through the reticulated fibers 1239.

According to an embodiment, the perforations 210 are formed as passages between the reticulated ceramic fibers 1239.

According to an embodiment, the reticulated fibers 1239 are formed as a reticulated ceramic foam. According to an embodiment, the reticulated fibers 1239 are formed using a reticulated polymer foam as a template. According to an embodiment, the reticulated fibers 1239 can include alumina silicate. According to an embodiment, the reticulated fibers 1239 can include Zirconia. According to an embodiment, the reticulated fibers 1239 are formed from an extruded ceramic material. According to an embodiment, the reticulated fibers 1239 can be formed from extruded mullite or cordierite. According to an embodiment, the reticulated fibers 1239 can include silicon carbide.

The term "reticulated fibers" refers to a netlike structure. In reticulated fiber embodiments, the interaction between the fuel and oxidant 206, the combustion reaction, and heat transfer to and from the perforated flame holder body 208 can function similarly to the embodiment shown and described above with respect to FIGS. 2-4. One difference in activity is a mixing between perforations 210, because the reticulated fibers 1239 form a discontinuous perforated flame holder body 208 that allows flow back and forth between neighboring perforations 210.

According to an embodiment, the reticulated fiber network is sufficiently open for downstream reticulated fibers 1239 to emit radiation for receipt by upstream reticulated fibers 1239 for the purpose of heating the upstream reticulated fibers 1239 sufficiently to maintain combustion of a fuel and oxidant 206. Compared to a continuous perforated flame holder body 208, heat conduction paths 312 between fibers 1239 are reduced due to separation of the fibers 1239. This may cause relatively more heat to be transferred from the heat-receiving region 306 (heat receiving area) to the heat-output region 310 (heat output area) of the reticulated fibers 1239 via thermal radiation.

According to an embodiment, individual perforations 210 may extend between an input face 212 to an output face 214 of the perforated flame holder 102. Perforations 210 may have varying lengths L. According to an embodiment, because the perforations 210 branch into and out of each other, individual perforations 210 are not clearly defined by a length L.

According to an embodiment, the perforated flame holder 102 is configured to support or hold a combustion reaction or a flame at least partially between the input face 212 and the output face 214. According to an embodiment, the input face 212 corresponds to a surface of the perforated flame holder 102 proximal to the fuel nozzle 218 or to a surface that first receives fuel. According to an embodiment, the input face 212 corresponds to an extent of the reticulated fibers 1239 proximal to the fuel nozzle 218. According to an embodiment, the output face 214 corresponds to a surface distal to the fuel nozzle 218 or opposite the input face 212. According to an embodiment, the input face 212 corresponds to an extent of the reticulated fibers 1239 distal to the fuel nozzle 218 or opposite to the input face 212.

According to an embodiment, the formation of boundary layers 314, transfer of heat between the perforated reaction holder body 208 and the gases flowing through the perforations 210, a characteristic perforation width dimension D, and the length L can be regarded as related to an average or overall path through the perforated reaction holder 102. In other words, the dimension D can be determined as a root-mean-square of individual Dn values determined at each point along a flow path. Similarly, the length L can be a length that includes length contributed by tortuosity of the flow path, which may be somewhat longer than a straight line distance $T_{RH}$ from the input face 212 to the output face 214 through the perforated reaction holder 102. According to an embodiment, the void fraction (expressed as (total perforated reaction holder 102 volume−fiber 1239 volume)/total volume)) is about 70%.

According to an embodiment, the reticulated ceramic perforated flame holder 102 is a tile about 1"×4"×4". According to an embodiment, the reticulated ceramic perforated flame holder 102 includes about 100 pores per square inch of surface area. Other materials and dimensions can also be used for a reticulated ceramic perforated flame holder 102 in accordance with principles of the present disclosure.

According to an embodiment, the reticulated ceramic perforated flame holder 102 can include shapes and dimensions other than those described herein. For example, the perforated flame holder 102 can include reticulated ceramic tiles that are larger or smaller than the dimensions set forth above. Additionally, the reticulated ceramic perforated flame holder 102 can include shapes other than generally cuboid shapes.

According to an embodiment, the reticulated ceramic perforated flame holder 102 can include multiple reticulated ceramic tiles. The multiple reticulated ceramic tiles can be joined together such that each ceramic tile is in direct contact with one or more adjacent reticulated ceramic tiles. The multiple reticulated ceramic tiles can collectively form a single perforated flame holder 102. Alternatively, each reticulated ceramic tile can be considered a distinct perforated flame holder 102.

Figure 13:
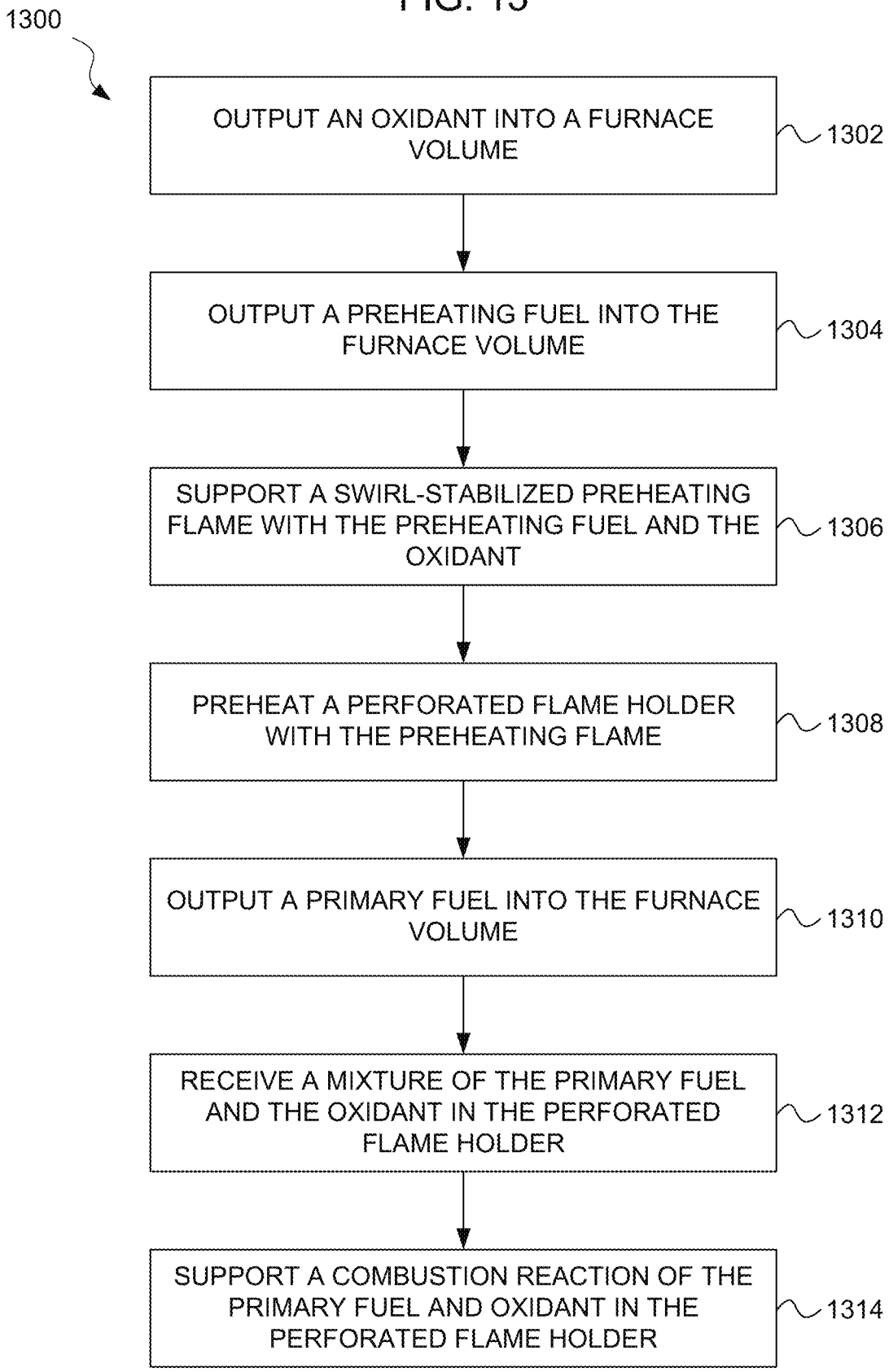
FIG. 13 is a flow diagram of a process for operating a combustion system, according to an embodiment.

FIG. 13 is a flow diagram of a process 1300 for operating a combustion system, according to an embodiment. At 1302, an oxidant is output into a furnace volume. At 1304, a preheating fuel is output into the furnace volume. At 1306, a swirl-stabilized preheating flame is supported with the preheating fuel and the oxidant. At 1308, a perforated flame holder is preheated with the preheating flame. At 1310, the primary fuel is output into the furnace volume. At 1312, a mixture of the primary fuel and the oxidant is received in the perforated flame holder. At 1314, a combustion reaction of the primary fuel and the oxidant is supported in the perforated flame holder.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A combustion system, comprising:

an oxidant source configured to output an oxidant into a furnace volume;

one or more preheating fuel distributors configured to output a preheating fuel and to support a swirl-stabilized preheating flame of the preheating fuel and the oxidant during a preheating state;

one or more primary fuel distributors positioned peripherally to the one or more preheating fuel distributors and configured to output a primary fuel into the furnace volume during a standard operating state; and a perforated flame holder positioned to be preheated by the preheating flame during the preheating state and then to receive a mixture of the primary fuel and the oxidant after preheating is complete, during the standard operating state, the perforated flame holder being configured to hold a combustion reaction of the primary fuel and the oxidant within the perforated flame holder.

2. The combustion system of claim 1, wherein the preheating fuel and the primary fuel are different fuels.

3. The combustion system of claim 1, wherein the preheating fuel distributor includes a swirler that is configured and positioned to impart a swirling motion to at least one of the preheating fuel and the oxidant.

4. The combustion system of claim 1, wherein the swirl-stabilized preheating flame is swirl-stabilized to remain at a stable position relative to the preheating fuel distributor without any flame-holding structure to hold the preheating flame in the stable position.

5. The combustion system of claim 3, wherein the swirler is positioned to receive both of the preheating fuel and the oxidant and to pass both of the preheating fuel and the oxidant through the swirler.

6. The combustion system of claim 1, wherein the primary fuel distributor includes a swirler that is configured and positioned to impart a swirling motion to at least one of the primary fuel and the oxidant.

7. The combustion system of claim 6, wherein the swirler is configured and positioned to pass both of the primary fuel and the oxidant through the swirler.

8. The combustion system of claim 1, further comprising a plurality of preheating fuel distributors and a plurality of primary fuel distributors.

9. The combustion system of claim 8, wherein the plurality of primary fuel distributors laterally surround the plurality of preheating fuel nozzles.

10. The combustion system of claim 9, wherein each of the plurality of primary fuel distributors receives the primary fuel from a primary fuel manifold, and wherein the plurality of primary fuel distributors include a plurality of orifices that output the primary fuel from the primary fuel manifold into the furnace volume.

11. The combustion system of claim 10, further comprising a burner body that includes the primary fuel distributors and the preheating fuel distributors.

12. The combustion system of claim 3, wherein the preheating fuel distributor includes:

a fluid chamber configured to receive at least one of the preheating fuel and the oxidant;

wherein the swirler includes a central hub and a plurality of swirl vanes; and wherein the preheating fuel distributor outputs the preheating fuel from the central hub.

13. The combustion system of claim 1, wherein the perforated flame holder is a reticulated ceramic perforated flame holder.

14. The combustion system of claim 13, wherein the perforated flame holder includes a plurality of reticulated fibers.

15. The combustion system of claim 14, wherein the perforated flame holder includes about 100 pores per square inch of surface area.

16. The combustion system of claim 14, wherein the perforations are formed as passages between the reticulated fibers.

17. The combustion system of claim 16, wherein the perforations are branching perforations.

18. The combustion system of claim 16, wherein the perforated flame holder includes:

an input face corresponding to an extent of the reticulated fibers proximal to the one or more primary fuel distributors; and an output face corresponds to an extent of the reticulated fibers distal to the one or more primary fuel distributors; and wherein the perforations extend between the input face and the output face.

19. A method comprising:

outputting an oxidant into a furnace volume;

outputting a preheating fuel into the furnace volume;

supporting a swirl-stabilized preheating flame with the preheating fuel and the oxidant;

preheating a perforated flame holder positioned in the furnace volume with the preheating flame;

outputting a primary fuel into the furnace volume;

receiving a mixture of the primary fuel and the oxidant in the perforated flame holder; and supporting a combustion reaction of the primary fuel and the oxidant in the perforated flame holder.

20. The method of claim 19, wherein supporting the swirl-stabilized preheating flame includes swirling one of the oxidant and the preheating fuel.

21. The method of claim 19, wherein the steps are performed sequentially in the recited order.

22. The method of claim 20, wherein supporting the swirl-stabilized preheating flame includes swirling both the oxidant and the preheating fuel.

23. The method of claim 22, wherein swirling both the oxidant and the preheating fuel includes swirling the preheating fuel and the oxidant in opposite directions.

24. The method of claim 19, further comprising imparting the swirling motion to at least one of the preheating fuel and the oxidant with a fuel nozzle of a preheating fuel distributor.

25. The method of claim 19, wherein the step of outputting the primary fuel into the furnace volume further comprises mixing the primary fuel and the oxidant as the primary fuel travels toward the perforated flame holder.

26. A combustion system, comprising:

a perforated flame holder positioned in a furnace volume;

an oxidant source configured to output an oxidant into the furnace volume;

a preheating fuel distributor, including:

a preheating fuel riser having an interior channel configured to convey a preheating fuel;

one or more orifices communicably coupled to the interior channel of the preheating fuel riser and configured to output the preheating fuel; and a swirler positioned downstream from the orifices and configured to impart a swirling motion to the preheating fuel, the preheating fuel distributor being configured to support a swirl-stabilized preheating flame of the preheating fuel and the oxidant at a position selected to preheat the perforated flame holder; and a primary fuel distributor configured to output a primary fuel toward the perforated flame holder after the perforated flame holder has been preheated by the preheating flame, the perforated flame holder being configured to support a combustion reaction of the preheating flame at least partially within the perforated flame holder.

27. The combustion system of claim 26, wherein the preheating fuel distributor includes a cylindrical casing surrounding a portion of the preheating fuel riser.

28. The combustion system of claim 27, wherein the oxidant source is configured to pass the oxidant into the cylindrical casing downstream from the swirler.

29. The combustion system of claim 28, wherein the swirler is configured to impart a swirling motion to the oxidant.

30. The combustion system of claim 27, wherein the orifices are positioned within the cylindrical casing.

31. The combustion system of claim 27, further comprising a support spider including one or more arms extending from the preheating fuel riser and wherein the cylindrical casing is supported on the arms of the support spider.

32. The combustion system of claim 26, further comprising a fuel distribution joint coupled to the preheating fuel riser and including one or more fuel distribution arms, each including a respective interior channel.

33. The combustion system of claim 32, wherein the one or more orifices are positioned on the fuel distribution arms, wherein the interior channels of the fuel distribution arms each communicably couple one or more of the orifices to the interior channel of the preheating fuel riser.

34. The combustion system of claim 26, wherein the primary fuel distributor includes one or more primary fuel risers configured to output the primary fuel toward the perforated flame holder after the perforated flame holder has been preheated to a threshold temperature.

35. The combustion system of claim 34, wherein the perforated flame holder is configured to support a combustion reaction of the primary fuel and the oxidant at least partially within the perforated flame holder.

36. The combustion system of claim 26, wherein the oxidant source includes a barrel register.

37. The combustion system of claim 36, wherein the barrel register is coupled to a furnace floor.

38. The combustion system of claim 37, further comprising a barrel register bottom coupled to a bottom of the barrel register.

39. The combustion system of claim 38, wherein the preheating fuel riser is coupled to a barrel register support.

40. The combustion system of claim 39, wherein the barrel register includes the primary fuel manifold.

41. The combustion system of claim 40, wherein the primary fuel risers are coupled to the barrel register bottom and are configured to receive the primary fuel from the primary fuel manifold.

42. The combustion system of claim 37, further comprising a throat insert supported by the barrel register and positioned in an opening in the furnace floor, the throat insert including a central aperture configured to pass the oxidant from the barrel register into the furnace volume.

43. The combustion system of claim 42, further comprising support arms configured to support the perforated flame holder above the furnace floor.

44. The combustion system of claim 42, wherein the barrel register includes support arm receivers configured to hold the support arms.

45. The combustion system of claim 44, wherein the support arm receivers extend from the barrel register and protrude through outer apertures of the throat insert.

46. The combustion system of claim 26, wherein the perforated flame holder includes a reticulated ceramic tile.

47. The combustion system of claim 26, wherein the reticulated ceramic tile is silicon carbide.

* * * * *